US008836688B2

(12) United States Patent
Yamauchi

(10) Patent No.: US 8,836,688 B2
(45) Date of Patent: Sep. 16, 2014

(54) DISPLAY DEVICE

(75) Inventor: Yoshimitsu Yamauchi, Osaka (JP)
(73) Assignee: Sharp Kabushiki Kaisha, Osaka (JP)

( * ) Notice: Subject to any disclaimer, the term of this patent is extended or adjusted under 35 U.S.C. 154(b) by 287 days.

(21) Appl. No.: 13/522,618
(22) PCT Filed: Nov. 19, 2010

(86) PCT No.: PCT/JP2010/070674
§ 371 (c)(1),
(2), (4) Date: Jul. 17, 2012

(87) PCT Pub. No.: WO2011/089781
PCT Pub. Date: Jul. 28, 2011

(65) Prior Publication Data
US 2012/0299899 A1 Nov. 29, 2012

(30) Foreign Application Priority Data
Jan. 22, 2010 (JP) ..... 2010-012217

(51) Int. Cl.
*G09G 5/00* (2006.01)
*G09G 3/36* (2006.01)

(52) U.S. Cl.
CPC ..... *G09G 3/3648* (2013.01); *G09G 3/3659* (2013.01); *G09G 2300/0819* (2013.01); *G09G 3/36* (2013.01); *G09G 3/3614* (2013.01); *G09G 2300/043* (2013.01); *G09G 3/3655* (2013.01); *G09G 2320/0247* (2013.01); *G09G 2310/08* (2013.01); *G09G 2330/021* (2013.01); *G09G 2300/0814* (2013.01); *G09G 3/3618* (2013.01); *G09G 2300/0852* (2013.01); *G09G 2300/0465* (2013.01); *G09G 2300/0876* (2013.01); *G09G 2320/043* (2013.01)
USPC ..... 345/211; 345/87; 345/103; 349/33; 349/42; 349/19; 349/41; 349/43

(58) Field of Classification Search
CPC ..... G09G 5/00; G09G 3/3696; G09G 3/3233; G09G 3/36; G09G 3/20; G09G 3/3614; G09G 3/30; G09G 3/3208; G09G 3/3677; G09G 3/3648; G09G 3/3688; G09G 2300/0819; G09G 23/0852; G09G 3/00; G09G 2300/0861
USPC ..... 345/211, 87–103; 349/42, 41, 43, 44, 349/33, 19
See application file for complete search history.

(56) References Cited

U.S. PATENT DOCUMENTS

2005/0068279 A1* 3/2005 Hirota et al. ..... 345/87
2010/0134460 A1* 6/2010 Hashimoto ..... 345/211

FOREIGN PATENT DOCUMENTS

JP 2005-122110 A 5/2005
JP 2007-334224 A 12/2007
WO 2006/123552 A1 11/2006

OTHER PUBLICATIONS

Official Communication issued in International Patent Application No. PCT/JP2010/070674, mailed on Feb. 22, 2011.

*Primary Examiner* — Olga Merkoulova
(74) *Attorney, Agent, or Firm* — Keating & Bennett, LLP

(57) ABSTRACT

A display device which can prevent deterioration of a liquid crystal and reduction in display quality at low power consumption without lowering an aperture ratio is provided. An opposite voltage (Vcom) is applied to an opposite electrode (80) of a liquid crystal capacitive element (Clc). One ends of a pixel electrode (20), a first switch circuit (22), a second switch circuit (23), and a first terminal of a second transistor (T2) form an internal node (N1). The other ends of the first switch circuit (22) and the second switch circuit (23) are connected to a source line (SL) and a voltage supply line (VSL), respectively. A control terminal of a first transistor (T1) in the second switch circuit (23), a second terminal of the second transistor (T2), and one end of a boost capacitive element (Cbst) form an output node (N2). The other end of the boost capacitive element (Cbst) and the control terminal of the second transistor (T2) are connected to a boost line (BST) and a reference line (REF), respectively. This configuration makes it possible to perform an action (self-refresh action) to return the absolute value of the voltage between both ends of a display element part to the value at the time of a last writing action without performing a writing action.

9 Claims, 48 Drawing Sheets

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | OFF | ON |
| T2(L) | ON | ON | OFF | OFF | OFF | OFF | OFF | OFF | ON |
| T3 | OFF | OFF | OFF | OFF | ON | OFF | OFF | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | ON | ON | ON | ON | ON | ON | ON | ON | ON |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | OFF | OFF | OFF | OFF | OFF | ON | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | OFF | OFF | OFF | OFF | OFF | ON | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | OFF | OFF | OFF | OFF | OFF | ON | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | OFF | OFF | OFF | OFF | OFF | ON | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | OFF | OFF | OFF | OFF | OFF | ON | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | OFF | OFF | OFF | ON | ON | ON | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | OFF | OFF | OFF | ON | ON | ON | OFF | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | ON | ON | ON | ON | ON | ON | ON | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |
| T4 | OFF | ON | ON | ON | ON | ON | ON | ON | OFF |

| | | | | | | | | | |
|---|---|---|---|---|---|---|---|---|---|
| T1(H) | OFF | ON | ON | ON | ON | ON | ON | OFF | OFF |
| T1(L) | OFF | OFF | OFF | OFF | OFF | OFF | OFF | OFF | OFF |
| T2(H) | OFF | OFF | OFF | OFF | OFF | OFF | OFF | ON | ON |
| T2(L) | ON | ON | OFF | OFF | OFF | OFF | OFF | ON | ON |
| T3 | OFF | OFF | OFF | OFF | ON | OFF | OFF | OFF | OFF |

DISPLAY DEVICE

TECHNICAL FIELD

The present invention relates to a pixel circuit and a display device provided with the same, and more particularly to an active matrix type display device.

BACKGROUND ART

A mobile terminal such as a mobile telephone or a mobile game machine uses a liquid crystal display device as its displaying means, in general. In addition, since the mobile telephone or the like is driven by a battery, it is strongly required to reduce power consumption. Therefore, information such as a time or remaining battery level which needs to be constantly displayed is displayed on a reflective subpanel. In addition, recently, a normal display by way of a full-color display and a reflective constant display are both required to be displayed on the same main panel.

FIG. 47 shows an equivalent circuit of a pixel circuit of a general active matrix type liquid crystal display device. In addition, FIG. 48 shows a circuit arrangement example of the general active matrix type liquid crystal display device having m×n pixels. In addition, each of the numbers m and n is two or more integer.

As shown in FIG. 48, a switch element composed of a thin film transistor (TFT) is provided at each intersecting point of m source lines SL1, SL2, . . . , SLm and n scanning lines GL1, GL2, . . . , GLn. In FIG. 47, the source lines SL1, SL2, . . . , SLm are represented by a source line SL, and similarly, the scanning lines GL1, GL2, . . . , GLn are represented by a scanning line GL.

As shown in FIG. 47, a liquid crystal capacitive element Clc and an auxiliary capacitive element Cs are connected parallel to each other through the TFT. The liquid crystal capacitive element Clc has a laminated structure in which a liquid crystal layer is provided between a pixel electrode 20 and an opposite electrode 80. The opposite electrode is also referred to as a common electrode.

In addition, in FIG. 48, the TFT and the pixel electrode (black rectangular part) are simply shown in the pixel circuit.

The auxiliary capacitance Cs has one end (one electrode) connected to the pixel electrode 20, and the other end (the other electrode) connected to an auxiliary capacitance line CSL, and is provided to stabilize a voltage of the pixel data held in the pixel electrode 20. The auxiliary capacitance Cs has an effect of preventing a fluctuation in the voltage of the pixel data held in the pixel electrode due to a leak current of the TFT, a fluctuation in electric capacitance of the liquid crystal capacitive element Clc between a black display and a white display due to dielectric constant anisotropy of liquid crystal molecules, and a voltage fluctuation generated through parasitic capacitance between the pixel electrode and a surrounding wiring. By sequentially controlling voltages of the scanning lines, the TFTs connected to one scanning line are turned on, and voltages of pixel data supplied to respective source lines are written in the corresponding pixel electrodes with respect to each scanning line.

As for the normal display by way of the full-color display, even when display contents are still images, the same display contents are repeatedly written in the same pixel with respect to each frame. Thus, the voltage of the pixel data held in the pixel electrode is updated, so that the voltage fluctuation of the pixel data is minimized, and a high-quality display of the still image can be maintained.

Power consumption to drive the liquid crystal display device is mainly dominated by power consumption to drive a source line by a source driver, and roughly expressed by a relational expression shown in the following formula 1. In addition, in the formula 1, P represents power consumption, f represents a refreshing rate (the number of times a refreshing action is performed for one frame per unit time), C represents load capacitance driven by the source driver, V represents a drive voltage of the source driver, n represents the number of scanning lines, and m represents the number of source lines. Here, the refreshing action means an action to apply the voltage to the pixel electrode through the source line while maintaining the display contents.

$$P \propto f \cdot C \cdot V^2 \cdot n \cdot m \quad \text{(Formula 1)}$$

Meanwhile, in the case of the constant display, since the display contents are still images, it is not always necessary to update the voltage of the pixel data with respect to each frame. Therefore, in order to further reduce the power consumption in the liquid crystal display device, a refreshing frequency is reduced at the time of this constant display. However, when the refreshing frequency is reduced, the pixel data voltage held in the pixel electrode fluctuates due to a leak current of the TFT. The voltage fluctuation leads to a fluctuation of display brightness (transmittance of liquid crystal) of each pixel, and this is recognized as a flicker. In addition, since an average potential is also reduced in each frame period, a display quality could be reduced such that a sufficient contrast cannot be provided.

Here, as a method to solve the problem that the display quality is reduced due to the reduction in the refreshing frequency and to cut the power consumption at the same time in constantly displaying the still image of the remaining battery level or the time display, a configuration is disclosed in the following patent document 1. According to the configuration disclosed in the patent document 1, a liquid crystal display can be implemented by both transmissive and reflective functions, and moreover, a memory part is provided in a pixel circuit in a pixel region in which the reflective liquid crystal display can be provided. This memory part holds information to be displayed in the reflective liquid crystal display part as a voltage signal. At the time of the reflective liquid crystal display, information corresponding to this voltage is displayed when the pixel circuit reads the voltage held in the memory part.

According to the patent document 1, since the memory part is composed of a SRAM, and the voltage signal is statically held, the refreshing action is not needed, so that the display quality can be maintained, and the power consumption can be reduced at the same time.

PRIOR ART DOCUMENT

Patent Document

Patent document 1: Japanese Unexamined Patent Publication No. 2007-334224

DISCLOSURE OF THE INVENTION

Problems to be Solved by the Invention

However, when the above-described configuration is employed in the liquid crystal display device used in the mobile telephone, it is necessary to provide a memory part to store pixel data with respect to each pixel or each pixel group, in addition to an auxiliary capacitive element to hold the voltage of the pixel data serving as analog information at the time of a normal action. This causes an increase in the number of the elements and the number of signal lines to be formed on an array substrate (active matrix substrate) in the display part of the liquid crystal display device, so that an aperture ratio is reduced in a transmissive mode. In addition, when a polarity reversion drive circuit to perform AC driving for the liquid crystal is provided together with the above memory part, the aperture ratio is further reduced. Thus, when the aperture ratio is reduced due to the increase in the number of the elements and the signal lines, brightness of the display image is reduced in the normal display mode.

Meanwhile, in a case where the above memory part is not provided, a leak current is generated between the pixel electrode 20 and the source line SL through the TFT, so that the potential of the pixel electrode 20 fluctuates and this appears as the flicker as described above.

The present invention was made in view of the above problems, and it is an object of the present invention to provide a display device in which a liquid crystal is prevented from deteriorating and a display quality is prevented from being reduced at low power consumption without lowering an aperture ratio.

Means for Solving the Problem

In order to attain the above object, a display device according to the present invention has a pixel circuit group provided by arranging a plurality of pixel circuits, in which each of the pixel circuits includes a display element part including a unit display element, an internal node serving as a part of the display element part, and holding a voltage of pixel data applied to the display element part, a first switch circuit transferring the voltage of the pixel data supplied from a data signal line to the internal node through at least a predetermined switch element, a second switch circuit transferring a voltage supplied to a predetermined voltage supply line to the internal node without passing through the predetermined switch element, and a control circuit holding a predetermined voltage corresponding to the voltage of the pixel data held in the internal node, at one end of a first capacitive element, and controlling on/off of the second switch circuit, the second switch circuit has a first transistor element, and the control circuit has a second transistor element, each of the first and second transistor elements having a first terminal, a second terminal, and a control terminal controlling conduction between the first and the second terminals, the control circuit includes a series circuit of the second transistor element and the first capacitive element, one end of the first switch circuit is connected to the data signal line, one end of the second switch circuit is connected to the voltage supply line, the other end of the first switch circuit, the other end of the second switch circuit, and the first terminal of the second transistor element are connected to the internal node, the control terminal of the first transistor element, the second terminal of the second transistor element, and the one end of the first capacitive element are connected to each other to form an output node of the control circuit, the control terminal of the second transistor element is connected to a first control line, the other end of the first capacitive element is connected to a second control line, the predetermined switch element is a third transistor element having a first terminal, a second terminal, and a control terminal controlling conduction between the first and second terminals, the control terminal being connected to a scan signal line, the display device includes a data signal line drive circuit driving the data signal line separately, a control line drive circuit driving the first control line, the second control line, and the voltage supply line separately, and a scan signal line drive circuit driving the scan signal line, at a time of a self refreshing action to compensate voltage fluctuation of the internal node in each of the plurality of pixel circuits at the same time by activating the second switch circuit and the control circuit, the data signal line drive circuit, the control line drive circuit, and the scan signal line drive circuit control the action according to a predetermined sequence, and the predetermined sequence includes a first step in which the scan signal line drive circuit applies a first scan voltage to the scan signal line connected to each of the pixel circuits included in the pixel circuit group to turn off the third transistor element, a second step in which the control line drive circuit applies a first control voltage to the first control line so that when a voltage state of binary pixel data held by the internal node is a first voltage state, a current from the one end of the first capacitive element toward the internal node is cut off by the second transistor element, and when the voltage state is a second voltage state, the second transistor element is turned on, a third step in which after the first and second steps, the control line drive circuit applies a first boost voltage to the second control line to apply a voltage change generated due to capacitive coupling through the first capacitive element, to the one end of the first capacitive element, so that when a voltage of the internal node is in the first voltage state, the voltage change is not suppressed and the first transistor element is turned on, and when the voltage of the internal node is in the second voltage state, the first transistor element is turned off, a fourth step in which after the third step, the control line drive circuit changes the voltage applied to the first control line to a second control voltage to cut off the current from the one end of the first capacitive element toward the internal node by the second transistor element regardless of whether the voltage state of the internal node is the first voltage state or the second voltage state, a fifth step in which after the fourth step, the scan signal line drive circuit applies a second scan voltage to the scan signal line connected to each of the pixel circuits included in the pixel circuit group to turn on the third transistor element, and the data line drive control circuit applies the voltage of the pixel data in the second voltage state to the data signal line, and a sixth step in which after the fifth step, the scan signal line drive circuit applies the first scan voltage to the scan signal line connected to each of the pixel circuits included in the pixel circuit group to turn off the third transistor element, and the control line drive circuit applies a voltage of the pixel data in the first voltage state to each of the voltage supply lines connected to the pixel circuits that are a target of the self refreshing action.

In addition to the above characteristics, the display device of the present invention has another characteristics that the second switch circuit includes a series circuit of a fourth transistor element having a control terminal connected to a third control line and the first transistor element, the control line drive circuit drives the third control line in addition to the first and the second control lines, and the sixth step of the predetermined sequence is an action in which the control line drive circuit applies a predetermined voltage to the third control line to turn on the fourth transistor element, and then applies the voltage of the pixel data in the first voltage state to the voltage supply line connected to each of the pixel circuits that are the target of the self refreshing action.

In addition to the above characteristics, the display device of the present invention has another characteristics that the data signal line also serves as the voltage supply line, and the sixth step of the predetermined sequence is an action in which instead of the control line drive circuit, the data line drive circuit applies the voltage of the pixel data in the first voltage state to the data signal line also serving as the voltage supply line connected to each of the pixel circuits that are the target of the self refreshing action.

In addition to the above characteristics, the display device of the present invention has another characteristics that each of the pixel circuits further includes a second capacitive element having one end connected to the internal node, and the other end connected to a fourth control line, the fourth control line also serves as the voltage supply line, and the predetermined sequence has an action in which the control line drive circuit applies the voltage of the pixel data in the first voltage state to the fourth control line connected to each of the pixel circuits that are the target of the self refreshing action during the first to sixth steps.

In addition to the above characteristics, the present invention has another characteristics that the first switch circuit of each of the pixel circuits includes a series circuit of the third transistor element in the second switch circuit and the fourth transistor element, or a series circuit of a fifth transistor having a control terminal connected to the control terminal of the third transistor element in the second switch circuit and the third transistor element, and the predetermined sequence has an action in which the control line drive circuit applies a predetermined voltage to the third control line to turn on the fourth transistor element in at least the fifth step and the sixth step.

In addition to the above characteristics, the present invention has another characteristics that the second switch circuit includes a series circuit of a fourth transistor element having a control terminal connected to the second control line and the first transistor element.

In addition to the above characteristics, the present invention has another characteristics that the data signal line also serves as the voltage supply line, and the sixth step in the predetermined sequence is an action in which instead of the control line drive circuit, the data line drive circuit applies the voltage of the pixel data in the first voltage state to the data signal line also serving as the voltage supply line connected to each of the pixel circuits that are the target of the self refreshing action.

In addition to the above characteristics, the present invention has another characteristics that the first switch circuit of each of the pixel circuits includes a series circuit of the third transistor element in the second switch circuit and the fourth transistor element, or a series circuit of a fifth transistor having a control terminal connected to the control terminal of the third transistor element in the second switch circuit and the fourth transistor element.

In addition to the above characteristics, the present invention has another characteristics that the predetermined sequence has a seventh step in which after the sixth step, the control line drive circuit changes the voltage applied to the first control line to a third control voltage to turn on the second transistor element regardless of whether the voltage state of the internal node is the first voltage state or the second voltage state, and equalize potentials of the internal node and the output node.

Effect of the Invention

According to the configuration of the present invention, the action (self refreshing action) to return the absolute value of the voltage between both ends of the display element part to the value at the time of a last writing action can be executed without using the writing action. Especially, according to the present invention, the pixel circuit written in the first voltage state just before is refreshed to the first voltage state, and the pixel circuit written in the second voltage state is refreshed to the second voltage state by similarly controlling the signal lines connected to all of the pixel circuits of the self refreshing target without controlling the pixel circuits separately. Thus, complicated control is not needed, and the number of driving actions for the signal lines can be considerably reduced, and power consumption can be reduced, compared with the case where the refreshing is performed by the normal writing action.

MODE FOR CARRYING OUT THE INVENTION

Figure 47:
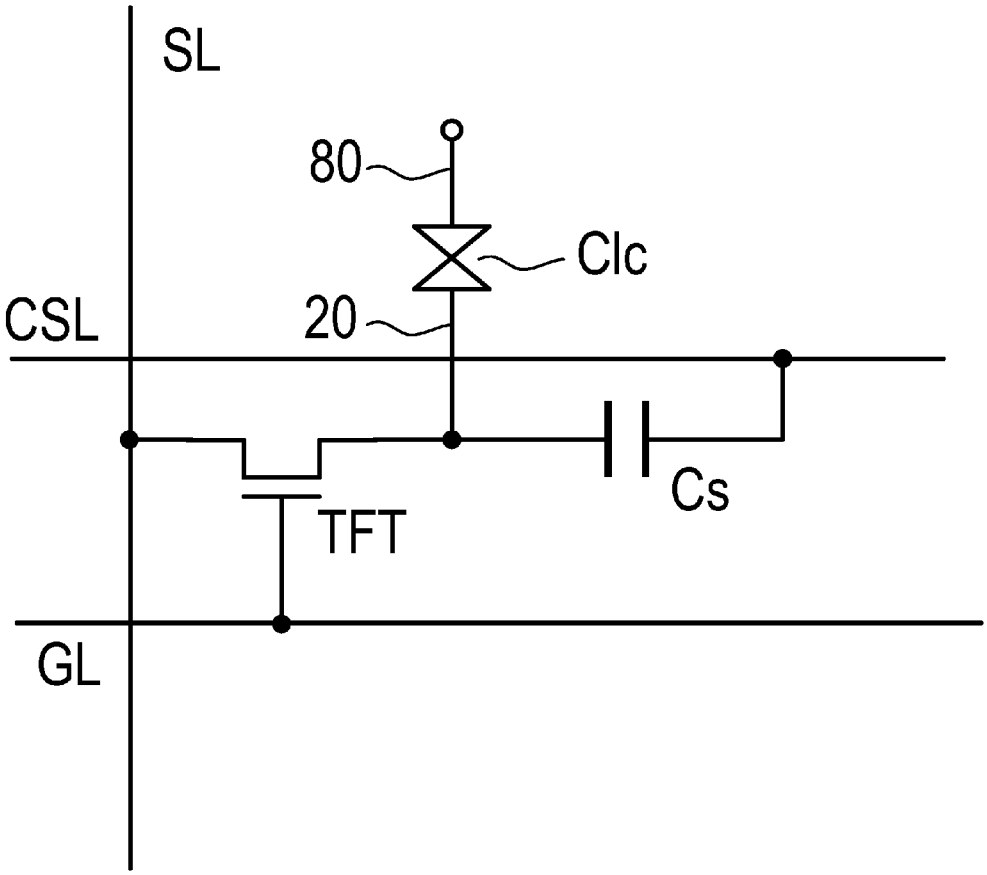
FIG. 47 is an equivalent circuit diagram of a pixel circuit of a general active matrix type liquid crystal display device.
Figure 48:
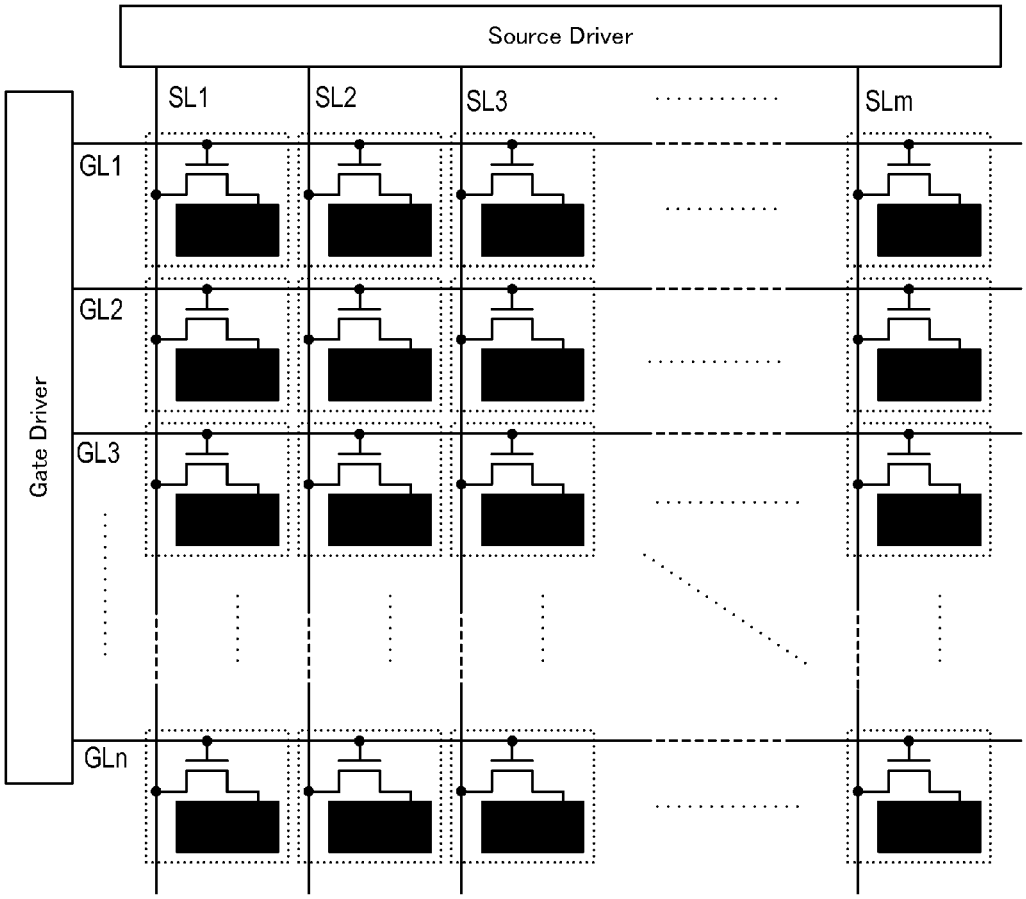
FIG. 48 is a block diagram showing a circuit arrangement example of an active matrix type liquid crystal display device having m×n pixels.

Hereinafter, a description will be given of each embodiment of a pixel circuit and a display device of the present invention with reference to the drawings. In addition, the same components as those in FIGS. 47 and 48 are marked with the same references.

[First Embodiment]

In a first embodiment, a description will be given of configurations of the display device of the present invention (hereinafter, simply referred to as the "display device") and the pixel circuit included therein.

<<Display Device>>

Figure 1:
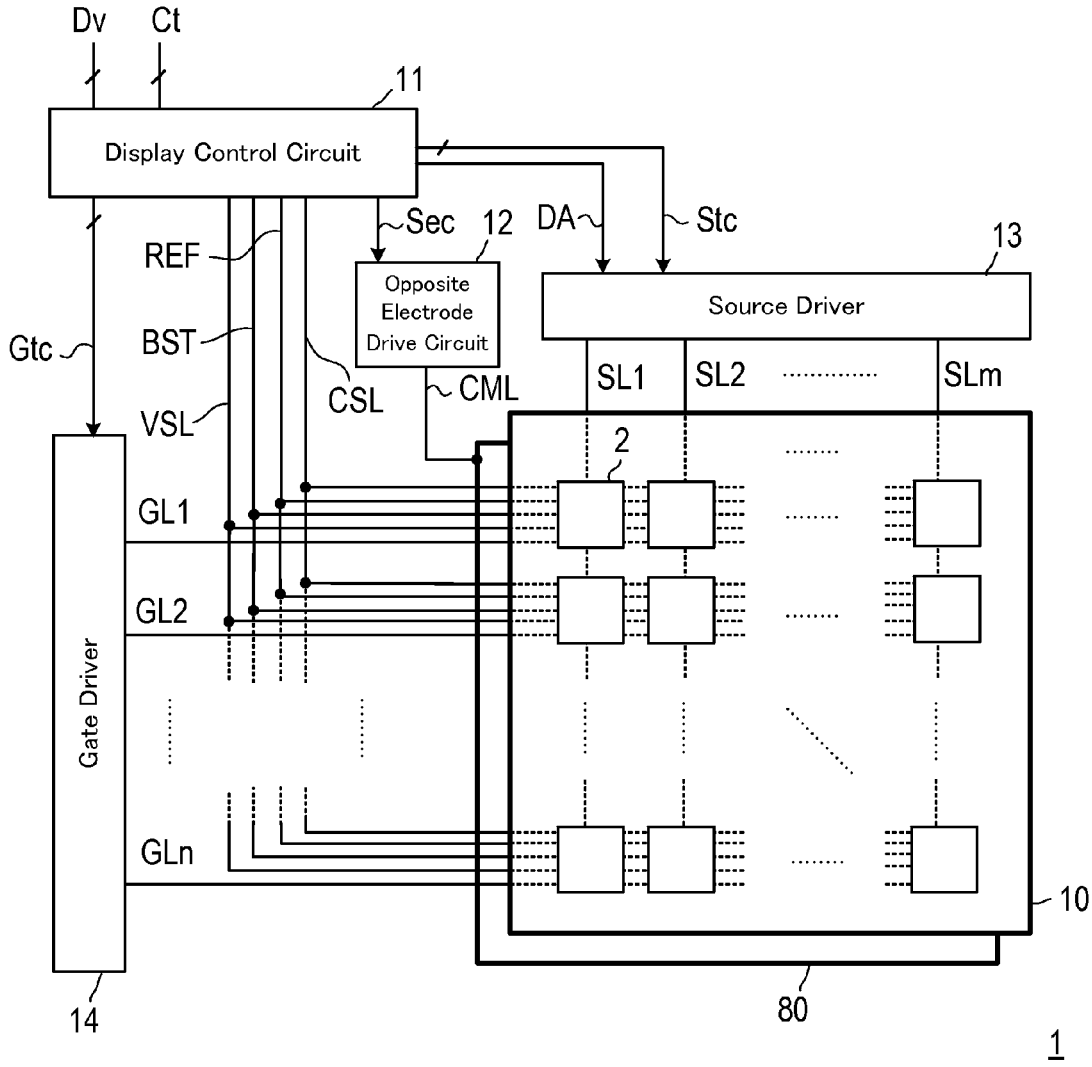
FIG. 1 is a block diagram showing one example of a schematic configuration of a display device according to the present invention.

FIG. 1 shows a schematic configuration of a display device 1. The display device 1 includes an active matrix substrate 10, an opposite electrode 80, a display control circuit 11, an opposite electrode drive circuit 12, a source driver 13, a gate driver 14, and various signal lines which will be described below. On the active matrix substrate 10, a plurality of pixel circuits 2 are arranged in a raw and a column directions, respectively, and a pixel circuit array is formed.

In addition, the pixel circuit 2 is shown as a block in FIG. 1 so as to prevent the drawing from becoming complicated. Moreover, for descriptive purposes, the active matrix substrate 10 is shown above the opposite electrode 80 so as to make it clear that the various signal lines are formed on the active matrix substrate 10.

According to this embodiment, the display device 1 can make a screen display in two display modes such as a normal display mode and a constant display mode with the same pixel circuit 2. In the normal display mode, a moving image or a still image is displayed in full color and a transmissive liquid crystal display is made with a backlight. Meanwhile, in the constant display mode in this embodiment, two gradations (black and white) are displayed for each pixel circuit, and the three adjacent pixel circuits 2 are allocated to each of three primary colors (R, G, B), so that 8 colors are displayed. In addition, in the constant display mode, the number of display colors can be increased by an area coverage modulation by further combining a plurality of sets of the three adjacent pixel circuits. Moreover, the constant display mode in this embodiment can be used in the transmissive liquid crystal display and a reflective liquid crystal display.

In the following description, for descriptive purposes, a minimum display unit corresponding to the one pixel circuit 2 is referred to as the "pixel", and "pixel data" to be written in each pixel circuit is gradation data of each color, in a case of a color display with the three primary colors (R, G, B). In a case of a color display including brightness data of the black and white, in addition to the three primary colors, the brightness data is also included in the pixel data.

Figure 2:
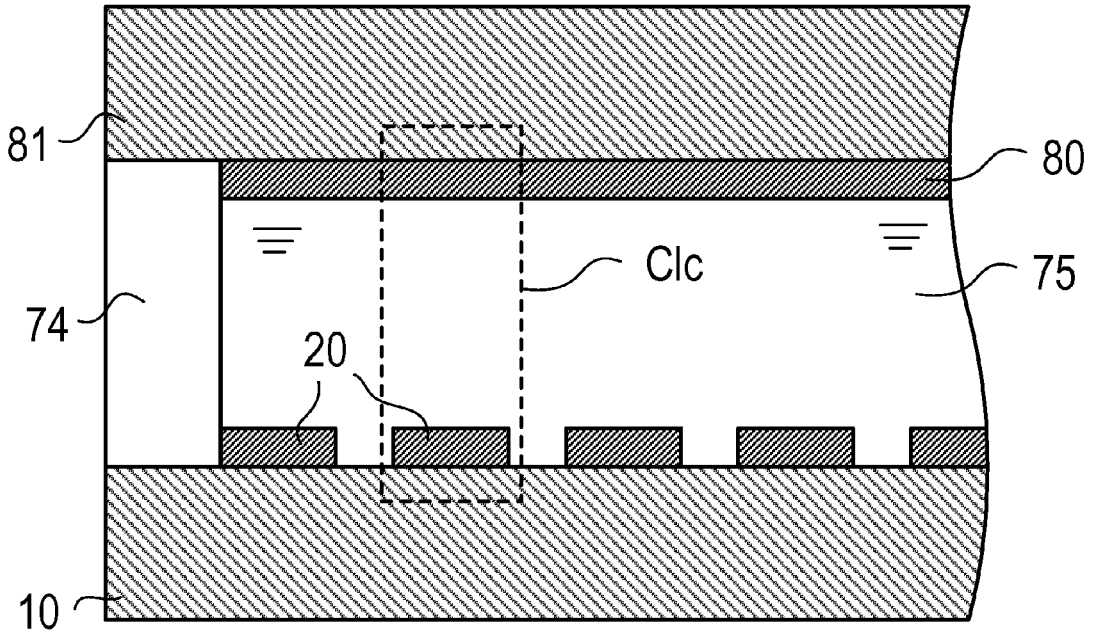
FIG. 2 is a partially cross-sectional structure view of a liquid crystal display device.

FIG. 2 is a schematic cross-sectional structure view showing a relationship between the active matrix substrate 10 and the opposite electrode 80, and shows a structure of a display element part 21 (refer to FIG. 4) serving as a component of the pixel circuit 2. The active matrix substrate 10 is a light transmissive transparent substrate composed of glass or plastic.

As shown in FIG. 1, the pixel circuits 2 each including the signal lines are formed on the active matrix substrate 10. In FIG. 2, a pixel electrode 20 is shown as a representative of the component of the pixel circuit 2. The pixel electrode 20 is composed of a light transmissive transparent conductive material such as ITO (indium tin oxide).

A light transmissive opposite substrate 81 is arranged so as to be opposed to the active matrix substrate 10, and a liquid crystal layer 75 is held in a gap between the substrates. A polarization plate (not shown) is attached to an outer surface of each substrate.

The liquid crystal layer 75 is sealed with a sealing material 74, in a surrounding area of both substrates. On the opposite substrate 81, the opposite electrode 80 composed of the light transmissive transparent conductive material such as ITO is formed so as to be opposed to the pixel electrode 20. This opposite electrode 80 is formed as a single film so as to spread nearly all over the opposite substrate 81. Here, a unit liquid crystal display element Clc (refer to FIG. 4) is composed of the one pixel electrode 20, the opposite electrode 80, and the liquid crystal layer 75 held therebetween.

Furthermore, a backlight device (not shown) is arranged on a back surface side of the active matrix substrate 10, and can emit light in a direction from the active matrix substrate 10 toward the opposite substrate 81.

As shown in FIG. 1, the signal lines are formed on the active matrix substrate 10 in horizontal and vertical directions. Thus, the pixel circuits 2 are formed, in the shape of a matrix, at intersecting points of m source lines (SL1, SL2, . . . , SLm) extending in the vertical direction (column direction), and n gate lines (GL1, GL2, . . . , GLn) extending in the horizontal direction (row direction). Each of the numbers m and n is two or more natural number. In addition, the source lines are represented by the "source line SL", and the gate lines are represented by the "gate line GL".

Here, the source line SL corresponds to a "data signal line", and the gate line GL corresponds to a "scan signal line". In addition, the source driver 13 corresponds to a "data signal line drive circuit", the gate driver 14 corresponds to a "scan signal line drive circuit", the opposite electrode drive circuit 12 corresponds to an "opposite electrode voltage supply circuit", and the display control circuit 11 partially corresponds to a "control line drive circuit".

In addition, in FIG. 1, each of the display control circuit 11 and the opposite electrode drive circuit 12 is illustrated so as to exist independently from the source driver 13 and the gate driver 14, but the display control circuit 11 and the opposite electrode drive circuit 12 may be included in these drivers.

According to the configuration shown in FIG. 1, a reference line REF, an auxiliary capacitance line CSL, voltage supply line VSL, and a boost line BST are provided as the signal lines to drive the pixel circuit 2, as well as the source line SL and the gate line GL described above. In addition, as another configuration (FIG. 3), a selection line SEL can be further provided.

The voltage supply line VSL may be an independent signal line as shown in FIG. 1, or it may also serve as the source line SL or the auxiliary capacitance line CSL. When the voltage supply line VSL also serves as the other signal line, the number of the signal lines to be arranged on the active matrix substrate 10 can be reduced, and an aperture ratio of each pixel can be improved.

The reference line REF, the boost line BST, and the selection line SEL correspond to a "first control line", a "second control line", and a "third control line", respectively, and are driven by the display control circuit 11. In addition, the auxiliary capacitance line CSL corresponds to a "fourth control line" and is driven by the display control circuit 11, as one example.

Figure 3:
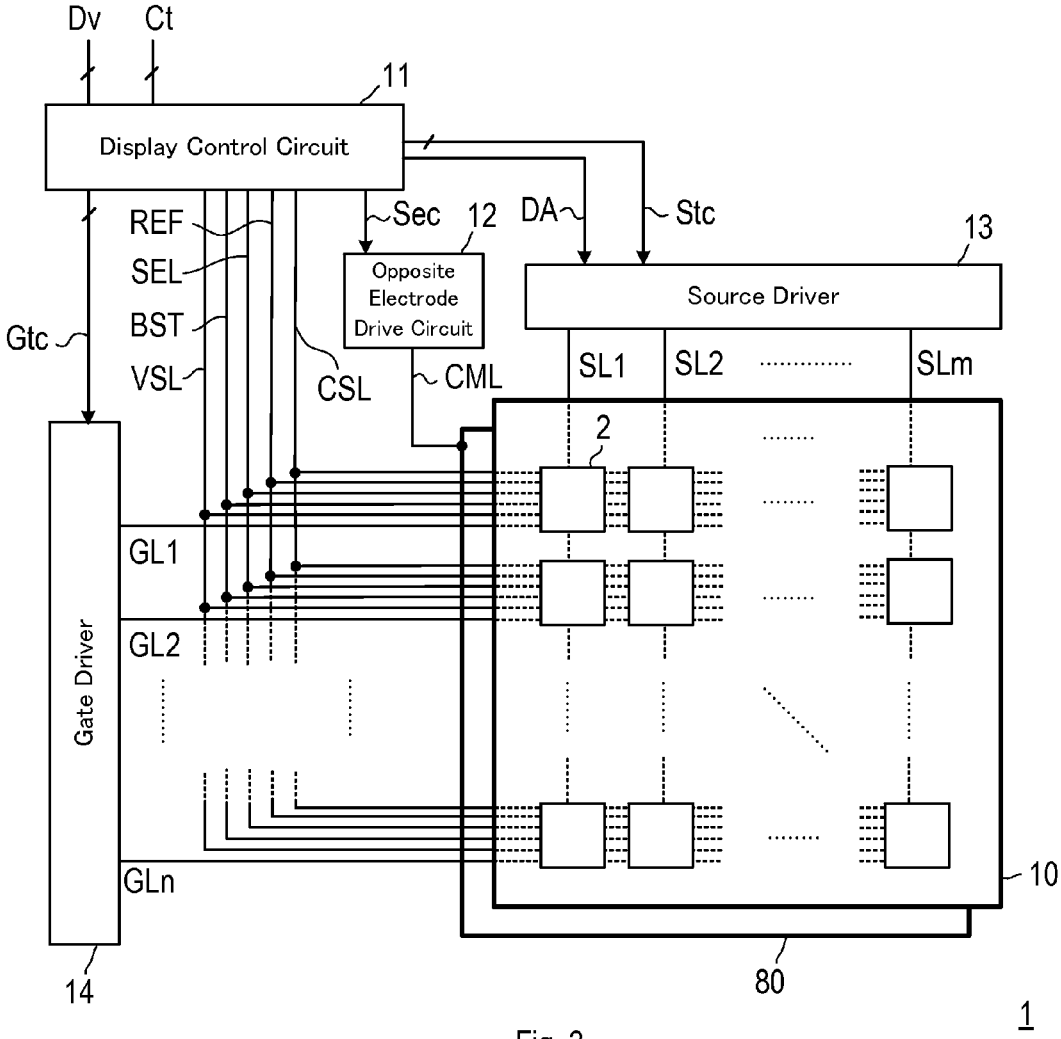
FIG. 3 is a block diagram showing one example of a schematic configuration of the display device according to the present invention.

In FIG. 1, each of the voltage supply line VSL, reference line REF, the boost line BST, and the auxiliary capacitance line CSL, and in addition, the selection line SEL in FIG. 3 is provided in each row so as to extend in the row direction. Although wirings of the respective rows are mutually connected and unified in a periphery part of the pixel circuit array, the wiring in each row may be individually driven and a common voltage may be applied thereto according to an operation mode. In addition, depending on a type of the circuit configuration of the pixel circuit 2 which will be described below, some or all of the reference line REF, the auxiliary capacitance line CSL, and the selection line SEL may be provided in each column so as to extend in the column direction. Basically, each of the reference line REF, the boost line BST, the auxiliary capacitance line CSL is shared by the plurality of pixel circuits 2. In addition, the selection line SEL is also shared by the plurality of pixel circuits 2 when it is provided.

The display control circuit 11 controls writing actions in the normal display mode and the constant display mode, and a self refreshing action in the constant display mode as will be described below.

At the time of the writing action, the display control circuit 11 receives a data signal Dv and a timing signal Ct representing an image to be displayed, from an external signal source, and generates a digital image signal DA and a data side timing control signal Stc to be applied to the source driver 13, a scan side timing control signal Gtc to be applied to the gate driver 14, an opposite voltage control signal Sec to be applied to the opposite electrode drive circuit 12, as signals to display the image on the display element part 21 (refer to FIG. 4) of the pixel circuit array, based on the signals Dv and Ct, and signal voltages to be applied to the reference line REF, the auxiliary capacitance line CSL, the boost line BST, voltage supply line VSL, and the selection line SEL (when it is provided).

The source driver 13 is controlled by the display control circuit 11 so as to apply a source signal having a predetermined voltage amplitude to each source line SL at predetermined timing at the time of the writing action and the self refreshing action.

At the time of the writing action, the source driver 13 generates voltages which respectively correspond to pixel values for one display line represented by the digital signal DA and are appropriate for a voltage level of an opposite voltage Vcom, as a source signal Sc1, Sc2, . . . , or Scm with respect to each horizontal period (also referred to as the "1H period"), based on the digital image signal DA and the data side timing control signal Stc. These voltages are multi-gradation analog voltages in the normal display mode, and they are two-gradation (binary) voltages in the constant display mode. Thus, these source signals are applied to the corresponding source lines SL1, SL2, . . . , SLm, respectively.

In addition, at the time of the self refreshing action, the source driver 13 is controlled by the display control circuit 11 and applies the same voltage to all of the source lines SL connected to the target pixel circuits 2, at the same timing (detail will be described below).

The gate driver 14 is controlled by the display control circuit 11 and applies a gate signal having a predetermined voltage amplitude to each gate line GL at predetermined timing at the time of the writing action and the self refreshing action. In addition, the gate driver 14 may be formed on the active matrix substrate 10 like the pixel circuit 2.

At the time of the writing action, the gate driver 14 sequentially selects the gate lines GL1, GL2, . . . , GLn for roughly one horizontal period in each frame period of the digital image signal DA, in order to write each of the source signals Sc1, Sc2, . . . , Scm in each pixel circuit 2, based on the scan side timing control signal Gtc.

In addition, at the time of the self refreshing action, the gate driver 14 is controlled by the display control circuit 11 and applies the same voltage to all of the gate lines GL connected to the target pixel circuits 2, at the same timing (detail will be described below).

The opposite electrode drive circuit 12 applies the opposite voltage Vcom to the opposite electrode 80 through an opposite electrode wiring CML. According to this embodiment, the opposite electrode drive circuit 12 alternately switch the opposite voltage Vcom between a predetermined high level (5 V) and a predetermined low level (0 V) and outputs it in the normal display mode and the constant display mode. Thus, to drive the opposite electrode 80 while switching the voltage between the high level and the low level is referred to as the "opposite AC driving".

According to the "opposite AC driving" in the normal display mode, the opposite voltage Vcom is switched between the high level and the low level with respect to each horizontal period and each frame period. That is, in a certain frame period, a voltage polarity between the opposite electrode 80 and the pixel electrode 20 is changed between the two adjacent horizontal periods. In addition, in the same horizontal period, the voltage polarity between the opposite electrode 80 and the pixel electrode 20 is changed between the two adjacent frame periods.

Meanwhile, in the constant display mode, the same voltage level is maintained in the one frame period, and the voltage polarity between the opposite electrode 80 and the pixel electrode 20 is changed between the two adjacent writing actions.

When the voltage having the same polarity is continuously applied between the opposite electrode 80 and the pixel electrode 20, burn-in of the display screen (surface burn-in) is caused, so that a polarity reversing action is needed, and when the "opposite AC driving" is employed, a voltage amplitude to be applied to the pixel electrode 20 in the polarity reversing action can be reduced.

<<Pixel Circuit>>

Next, a configuration of the pixel circuit 2 will be described with reference to FIGS. 4 to 23.

Figure 4:
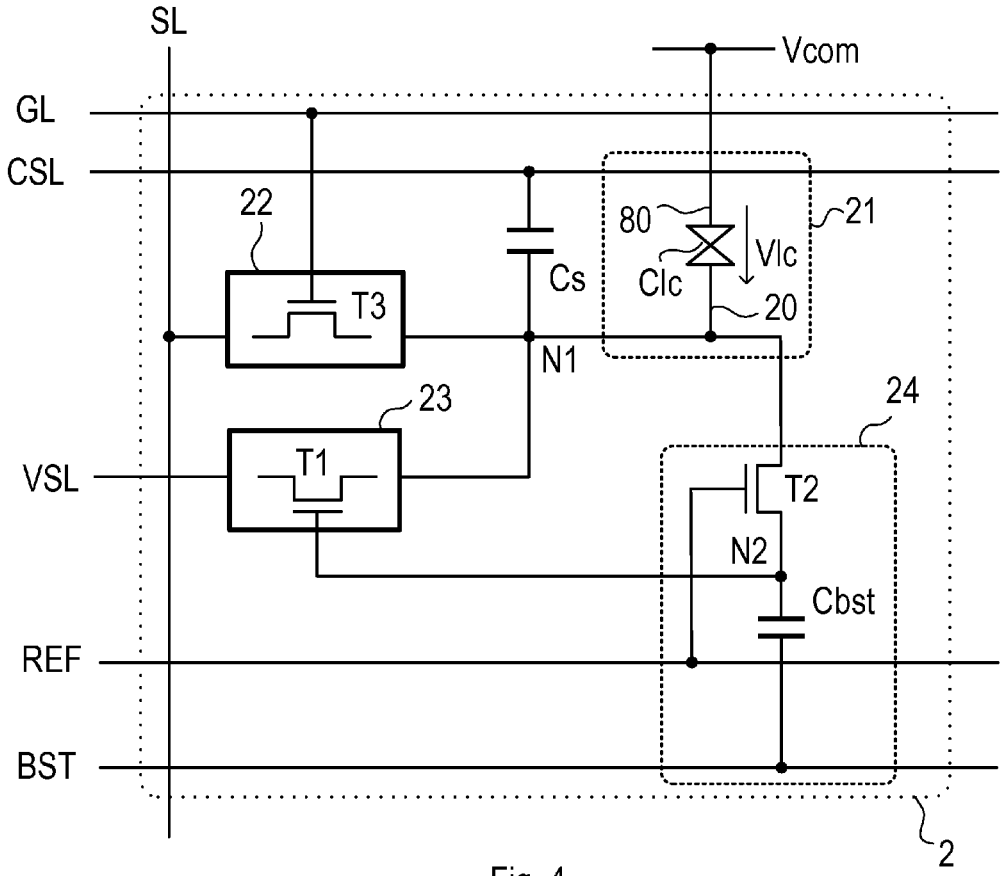
FIG. 4 is a circuit diagram showing a basic circuit configuration of a pixel circuit according to the present invention.
Figure 5:
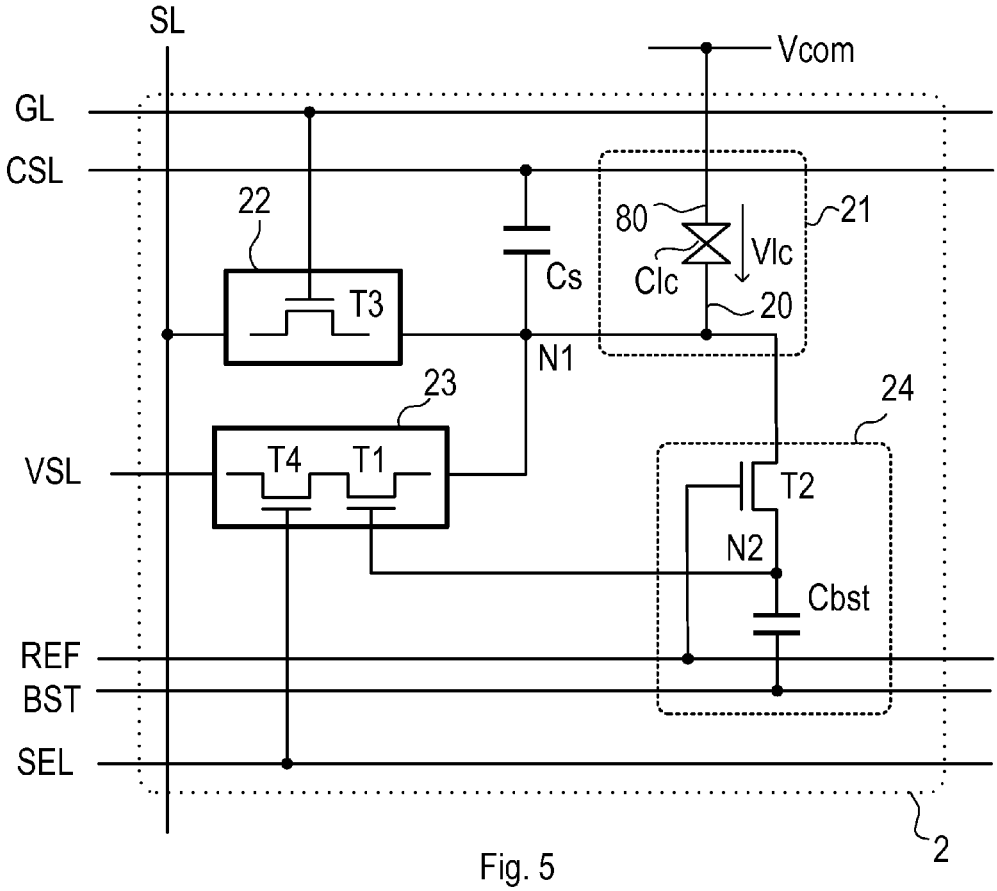
FIG. 5 is a circuit diagram showing another basic configuration of a pixel circuit according to the present invention.
Figure 6:
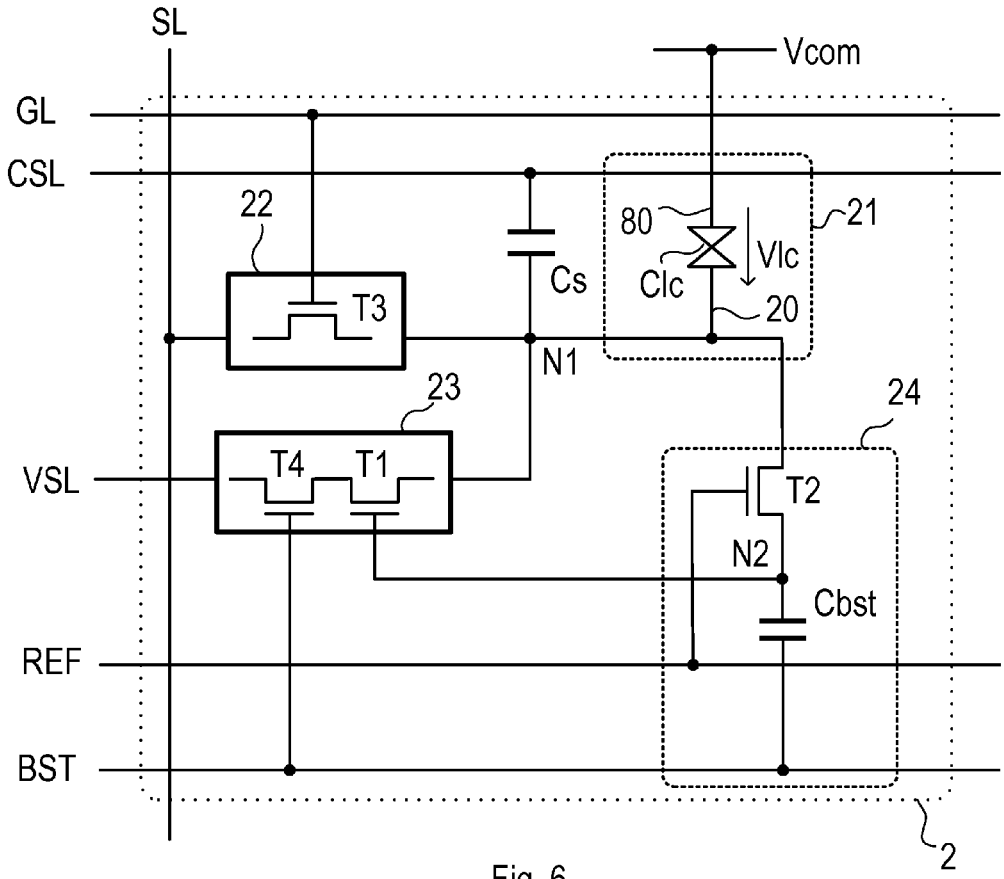
FIG. 6 is a circuit diagram showing another basic configuration of a pixel circuit according to the present invention.

FIGS. 4 to 6 show basic circuit configurations of the pixel circuits 2 of the present invention. The pixel circuit 2 includes the display element part 21 including the unit liquid crystal display element Clc, a first switch circuit 22, a second switch circuit 23, a control circuit 24, and an auxiliary capacitive element Cs, in common with all circuit configurations. The auxiliary capacitive element Cs corresponds to a "second capacitive element".

In addition, FIG. 4 corresponds to a basic configuration of each pixel circuit belonging to a group W which will be described below, FIG. 5 corresponds to a basic configuration of each pixel circuit belonging to a group X which will be described below, and FIG. 6 corresponds to a basic configuration of each pixel circuit belonging to a group Y which will be described below. Since the unit liquid crystal display element Clc has been already described with reference to FIG. 2, its description is omitted.

The pixel electrode 20 is connected to one ends of the first switch circuit 22, the second switch circuit 23, and the control circuit 24, whereby an internal node N1 is formed. The internal node N1 holds a voltage of the pixel data supplied from the source line SL at the time of the writing action.

The auxiliary capacitive element Cs has one end connected to the internal node N1, and the other end connected to the auxiliary capacitance line CSL. This auxiliary capacitive element Cs is additionally provided so that the internal node N1 can stably hold the voltage of the pixel data.

One end which does not compose the internal node N1, of the first switch circuit 22 is connected to the source line SL. The first switch circuit 22 has a transistor T3 functioning as a switch element. The transistor T3 is a transistor whose control terminal is connected to the gate line GL, and corresponds to a "third transistor". When at least the transistor T3 is off, the first switch circuit 22 is in an off state and the conduction between the source line SL and the internal node N1 are blocked.

One end which does not compose the internal node N1, of the second switch circuit 23 is connected to the voltage supply line VSL. In FIG. 4, the second switch circuit 23 is composed of a transistor T1. In addition, in FIGS. 5 and 6, the second switch circuit 23 includes a series circuit composed of the transistor T1 and a transistor T4.

In addition, the transistor T1 is a transistor whose control terminal is connected to an output node N2 of the control circuit 24, and corresponds to a "first transistor element". In addition, the transistor T4 is a transistor whose control terminal is connected to the boost line BST or the selection line SEL, and corresponds to a "fourth transistor element".

According to the configuration in FIG. 4, when the transistor T1 is turned on, the second switch circuit 23 is turned on, and the conduction between the voltage supply line VSL and the internal node N1 are established. According to the configuration in FIGS. 5 and 6, when both of the transistor T1 and the transistor T3 are turned on, the second switch circuit 23 is turned on, and the conduction between the voltage supply line VSL and the internal node N1 are established.

The control circuit 24 is composed of a series circuit of a transistor T2 and a boost capacitive element Cbst. A first terminal of the transistor T2 is connected to the internal node N1, and a control terminal thereof is connected to the reference line REF. In addition, a second terminal of the transistor T2 is connected to a first terminal of the boost capacitive element Cbst and the control terminal of the transistor T1, whereby the output node N2 is formed. A second terminal of the boost capacitive element Cbst is connected to the boost line BST. The transistor T2 corresponds to a "second transistor element".

Meanwhile, one end of the auxiliary capacitive element Cs, and one end of the liquid crystal capacitive element Clc are connected to the internal node N1. In order to prevent the references from becoming complicated, electrostatic capacitance of the auxiliary capacitive element (referred to as the "auxiliary capacitance") is represented by Cs, and electrostatic capacitance of the liquid crystal capacitive element (referred to as the "liquid crystal capacitance) is represented by Clc. At this time, total capacitance which is parasitic in the internal node N1, that is, pixel capacitance Cp in which the pixel data is written and held is roughly expressed by a sum of the liquid crystal capacitance Clc and the auxiliary capacitance Cs ($Cp \cong Clc+Cs$).

At this time, the boost capacitive element Cbst is set such that $Cbst \ll Cp$ is established wherein Cbst represents electrostatic capacitance of this element (referred to as the "boost capacitance").

When the transistor T2 is on, the output node N2 holds the voltage according to the voltage level of the internal node N1, but when the transistor T2 is off, it continuously holds an original voltage even when the voltage level of the internal node N1 changes. The voltage held in the output node N2 controls on/off of the transistor T1 of the second switch circuit 23.

Each of the four kinds of transistors T1 to T4 is a thin film transistor such as a polysilicon TFT or an amorphous silicon TFT which is formed on the active matrix substrate 10, and one of the first and second terminals corresponds to a drain electrode, and the other thereof corresponds to a source electrode, and the control terminal corresponds to a gate electrode. In addition, each of the transistors T1 to T4 may be composed of a single transistor element, but in a case where a leak current is highly required to be suppressed when the transistor is off, it may be configured such that the several transistors are connected in series and the control terminal is shared. In the following description about the operation of the pixel circuit 2, it is assumed that the each of the transistors T1 to T4 is an N-channel type polysilicon TFT, and its threshold voltage is about 2 V.

The pixel circuit 2 includes a variety of circuit configurations as will be described below, and they can be patterned as follows.

1) First, as described above, the configuration of the second switch circuit 23 includes a configuration composed of the transistor T1 only, and a configuration composed of the series circuit of the transistors T1 and T4. The former corresponds to the group W (FIG. 4), and the latter corresponds to the group X (FIG. 5) and group Y (FIG. 6). In addition, as for the latter, a configuration in which the control terminal of the transistor T4 is connected to the boost line BST corresponds to the group Y, and a configuration in which the selection line SEL is provided separately from the boost line BST, and the control terminal of the transistor T4 is connected to this selection line SEL corresponds to the group X.

2) As for the first switch circuit 22, there are two configurations such as a configuration in which it is composed of the transistor T3 only, and a configuration in which it is composed of a series circuit of the transistor T3 and another transistor element which is turned on by a signal line other than the gate line GL. In the latter case, the other transistor element in the series circuit may be the transistor T4 in the second switch circuit 23, or may be another transistor element whose control terminal is connected to the control terminal of the transistor T4 in the second switch circuit 23.

3) As for the voltage supply line VSL, there are three configurations such as a configuration in which it is an independent signal line, a configuration in which it also serves as the source line SL, and a configuration in which it also serves as the auxiliary capacitance line CSL. This will be described in detail below.

In the following description, based on the above 1) to 3), the pixel circuits 2 are classified according to types. As described above, the basic type structure is divided into the three groups (W, X, and Y), and a description will be given of the combination of the configuration of the voltage supply line VSL, and the configuration of the first switch circuit 22 with respect to each group.

<1. Group W>

A description will be given of the group W in which the second switch circuit 23 is composed of the transistor T1 only.

First, as for the group W, in the case where the voltage supply line VSL also serves as the source line SL, the auxiliary capacitance line CSL, or the gate line GL, the pixel circuit cannot be configured. Because, when the pixel circuit has such configuration, a writing action cannot be correctly performed.

A description will be given of the case where the voltage supply line VSL also serves as the source line SL, as one example. As will be described below, a high or low binary voltage (5V, 0V) is written in the constant display mode in the present invention. As will be described in a third embodiment, at the time of the writing action, a high voltage is applied to the reference line REF to turn on the transistor T2. Therefore, a potential VN2 of the node N2 is also at 5 V. Thus, there is a case where 0 V is written in another pixel circuit which shares the source line SL with this pixel circuit, and at this time, 0 V is applied to the source line SL. In this case, the transistor T1 is turned on from the node N1 toward the source line SL, and the potential of the node N1 is reduced. That is, the written potential cannot be correctly held, which means that the writing action cannot be correctly performed.

A description can be made similarly for the case where the voltage supply line VSL also serves as the auxiliary capacitance line CSL or the gate line GL. Because, there is a possibility that 0 V is applied to these lines.

Meanwhile, in the case where the voltage supply line VSL is an independent signal line, the potential of the node N1 in which high level writing has been performed can be prevented from being reduced by applying a high voltage to the voltage supply line VSL. That is, as will be described in the third embodiment, it is necessary to apply the high level voltage to the voltage supply line VSL at the time of the writing action.

In addition, also in the case where the voltage supply line VSL also serves as the reference line REF or the boost line BST, the pixel circuit cannot be configured. The pixel circuit provided in the display device in the present invention is characterized in that the self refreshing action which will be described in a second embodiment can be executed, but when the voltage supply line VSL also serves as the reference line REF or the boost line BST, this self refreshing action cannot be executed. The same is true for the groups X and Y.

Figure 7:
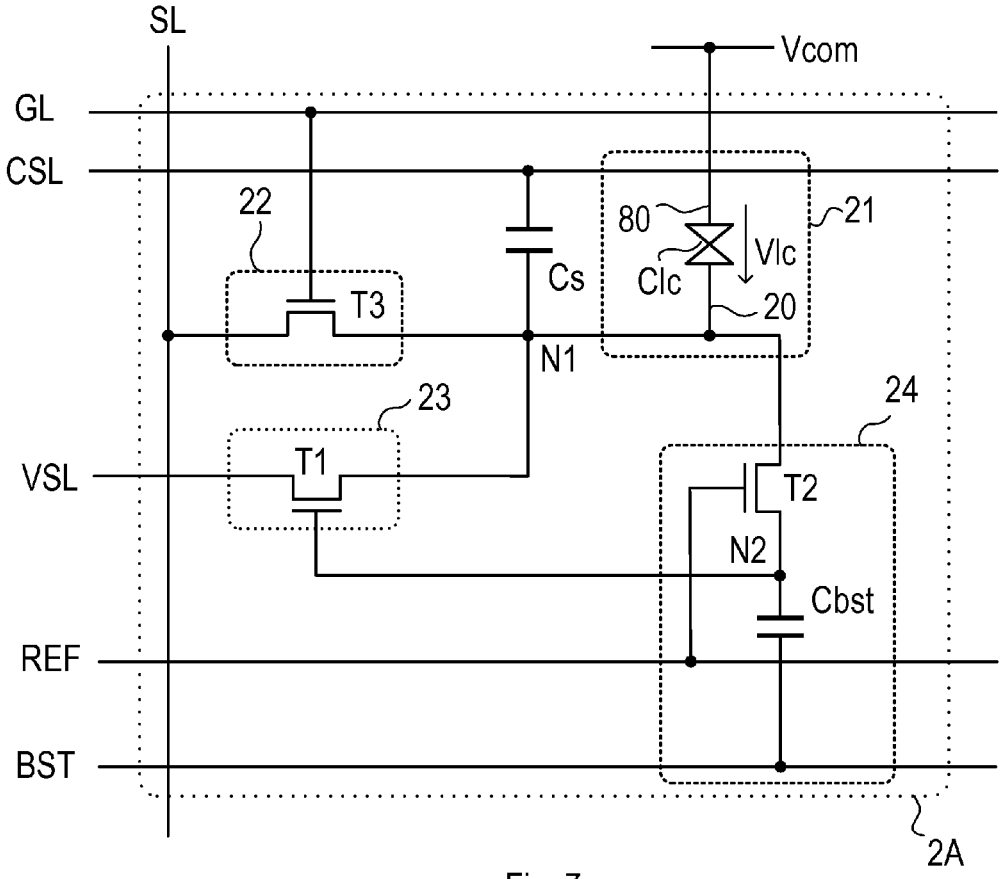
FIG. 7 shows a pixel circuit of a group W.

According to a pixel circuit 2A shown in FIG. 7, the voltage supply line VSL is an independent signal line. The reference line REF and the voltage supply line VSL extend parallel to the gate line GL in the lateral direction (row direction) as one example, but they may extend parallel to the source line SL in the vertical direction (column direction).

<2. Group X>

A description will be given of the group X in which the second switch circuit 23 is composed of the series circuit of the transistors T1 and T4, and the control terminal of the transistor T4 is connected to the selection line SEL. That is, the selection line SEL is added compared with the configuration of the group W.

In the case of the group X, unlike the group W, the second switch circuit 23 includes the transistor T4 in addition to the transistor T1, and the second switch circuit 23 is turned off by turning off the transistor T4 of the pixel circuit which is not a writing target, at the time of the writing action. Therefore, unlike the group W, the writing action can be correctly performed even when the voltage supply line VSL also serves as the source line SL or the auxiliary capacitance line CSL. Meanwhile, the voltage supply line cannot also serve as the gate line GL, the reference line REF, or the boost line BST, for the same reason as that of the group W.

A description will be given of the case where the first switch circuit 22 is composed of the transistor T3 only as first to third types. Among them, the first type corresponds to the case where the voltage supply line VSL is an independent signal line, the second type corresponds to the case where the voltage supply line VSL also serves as the source line SL, and the third type corresponds to the case where the voltage supply line VSL also serves as the auxiliary capacitance line CSL.

In addition, a description will be given of the case where the first switch circuit 22 is composed of a series circuit of the transistor T3, and the other transistor element which is turned on by the signal line other than the gate line GL as fourth and fifth types. Among them, the fourth type corresponds to the case where the voltage supply line VSL is an independent signal line, and the fifth type corresponds to the case where the voltage supply line VSL also serves as the source line SL. In addition, a description for the case where the first switch circuit 22 is composed of the series circuit of the transistor T3 and the other transistor element which is turned on by the signal line other than the gate line GL, and the voltage supply line VSL also serves as the auxiliary capacitance line CSL will be given in another example.

(First to Third Types)

First, a description will be given of the first to third types in which the first switch circuit 22 is composed of the transistor T3 only.

Figure 8:
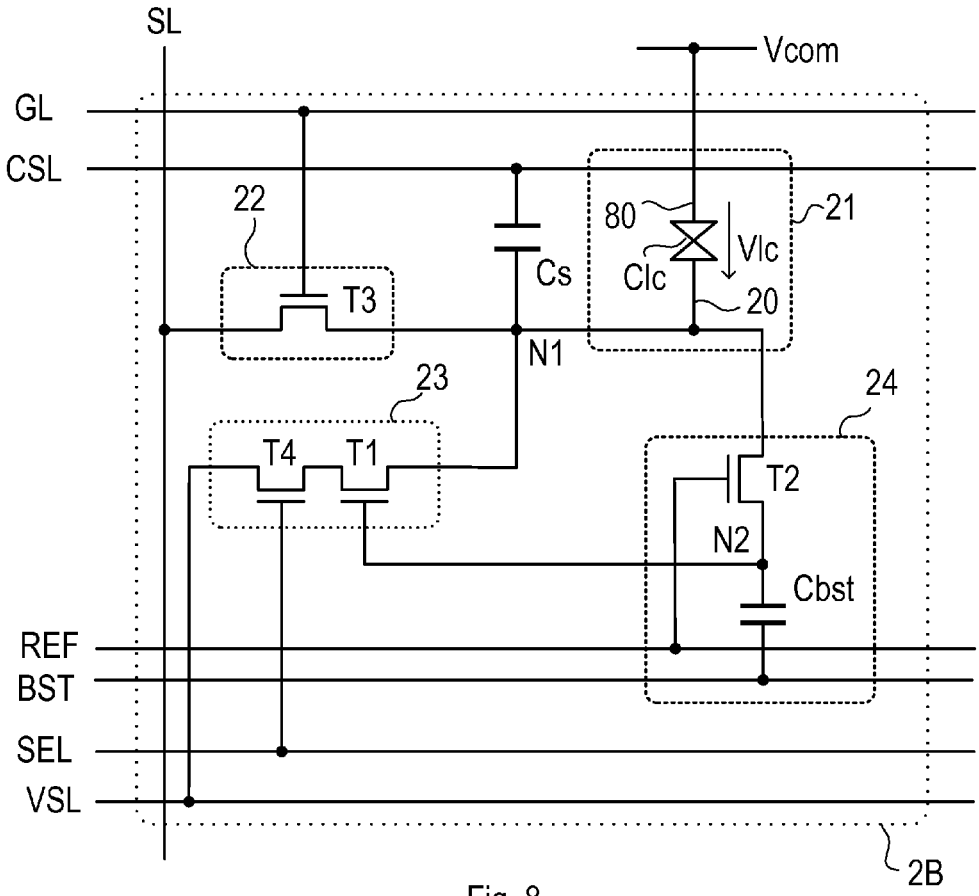
FIG. 8 shows a first type pixel circuit of a group X.

According to a first type pixel circuit 2B shown in FIG. 8, the first switch circuit 22 is composed of the transistor T3 only, and the voltage supply line VSL is an independent signal line. The reference line REF and the voltage supply line VSL extend parallel to the gate line GL in the lateral direction (row direction) as one example, but they may extend parallel to the source line SL in the vertical direction (column direction).

Here, FIG. 8 shows a configuration example in which the second switch circuit 23 is composed of the series circuit of the transistor T1 and the transistor T4, and as one example, a first terminal of the transistor T1 is connected to the internal node N1, a second terminal of the transistor T1 is connected to a first terminal of the transistor T4, and the second terminal of the transistor T4 is connected to the voltage supply line VSL. However, as another circuit configuration, the positions of the transistor T1 and the transistor T4 in the series circuit may be exchanged, or the transistor T1 may be sandwiched between the two transistors T4. These two variation circuit configuration examples are shown in FIGS. 9 and 10.

Figure 11:
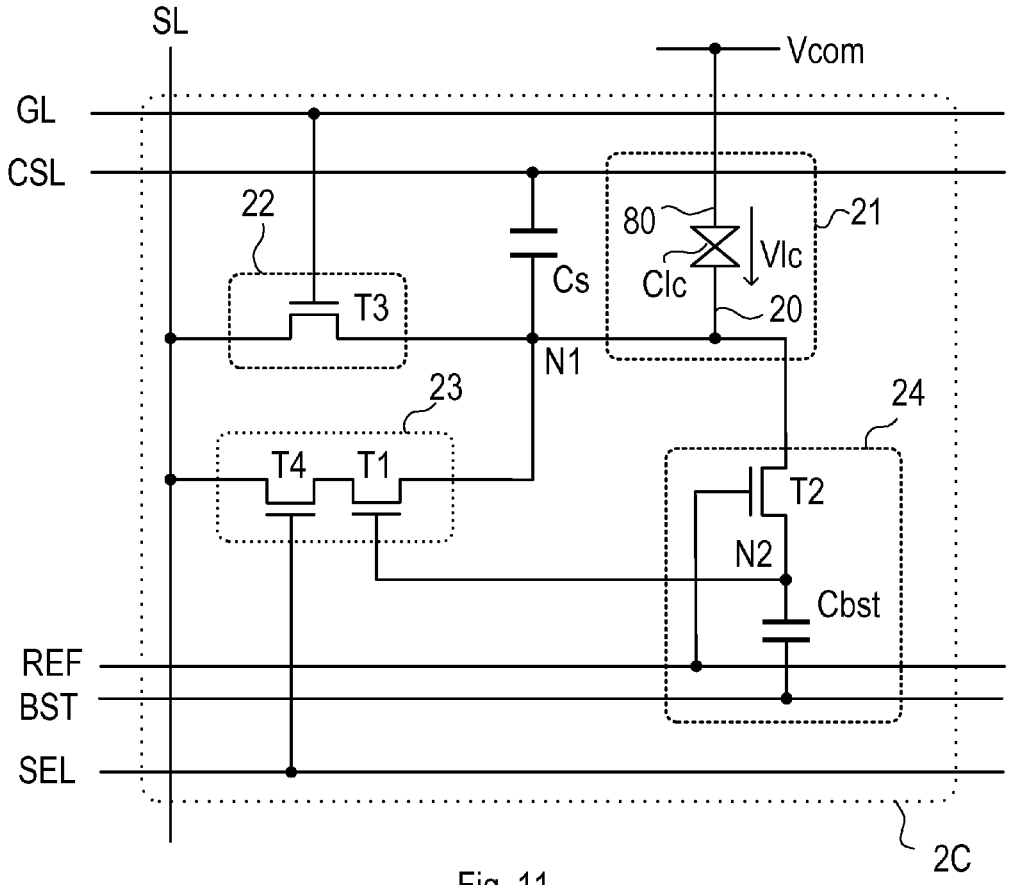
FIG. 11 shows a second type pixel circuit of the group X.

According to a second type pixel circuit 2C shown in FIG. 11, the first switch circuit 22 is composed of the transistor T3 only, and the voltage supply line VSL also serves as the source line SL.

Figure 12:
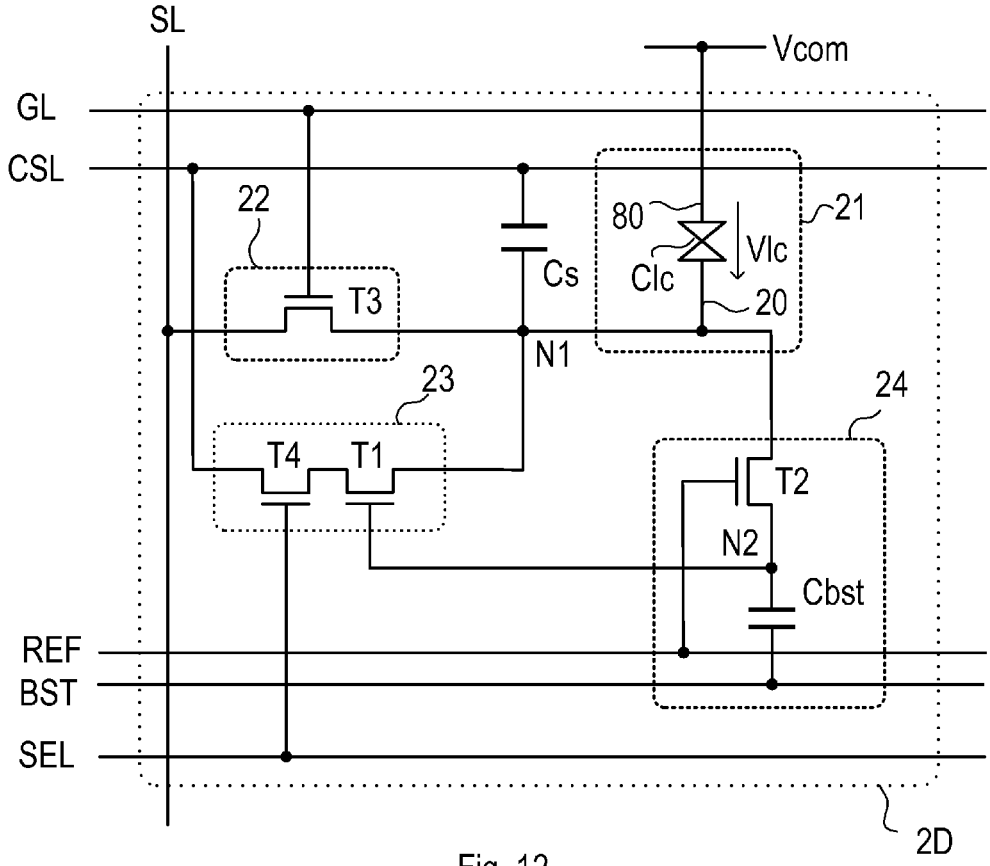
FIG. 12 shows a third type pixel circuit of the group X.

According to a third type pixel circuit 2D shown in FIG. 12, the first switch circuit 22 is composed of the transistor T3 only, and the voltage supply line VSL also serves as the auxiliary capacitance line CSL. The auxiliary capacitance line CSL extends parallel to the gate line GL in the lateral direction (row direction) as one example, but it may extend parallel to the source line SL in the vertical direction (column direction).

Figure 9:
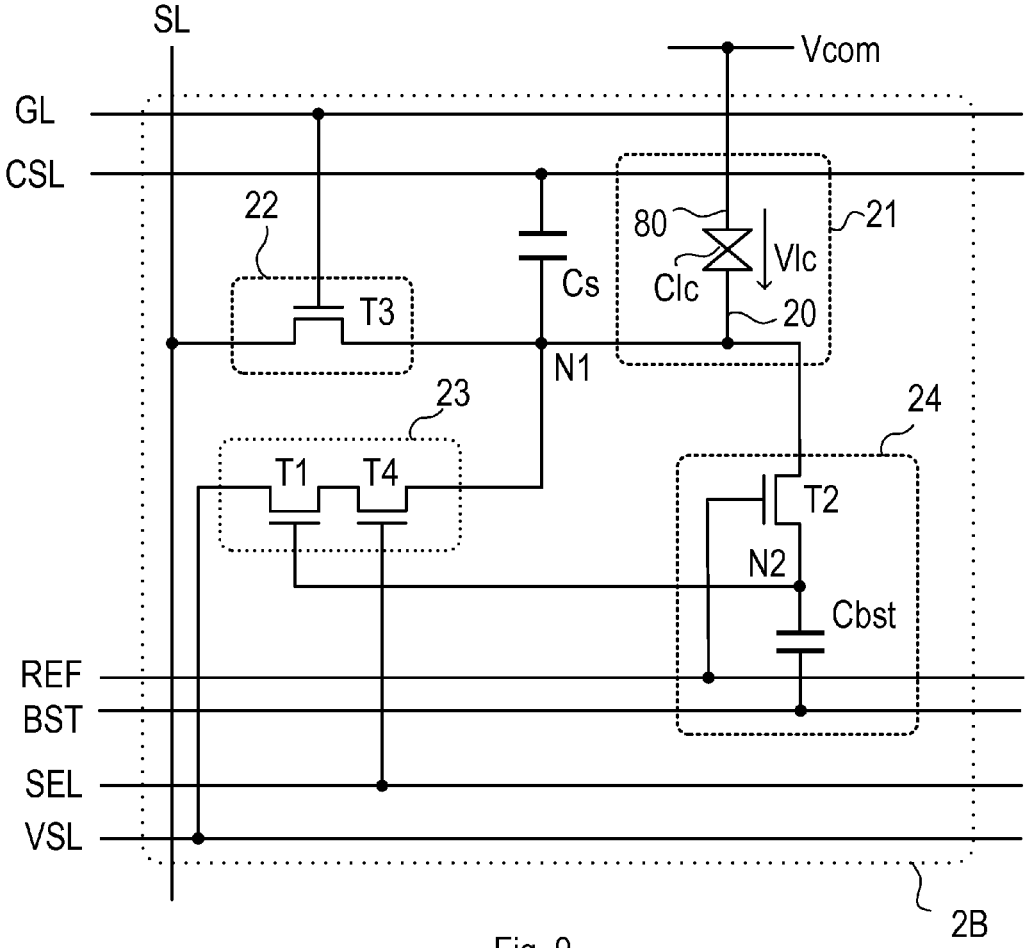
FIG. 9 shows another first type pixel circuit of the group X.
Figure 10:
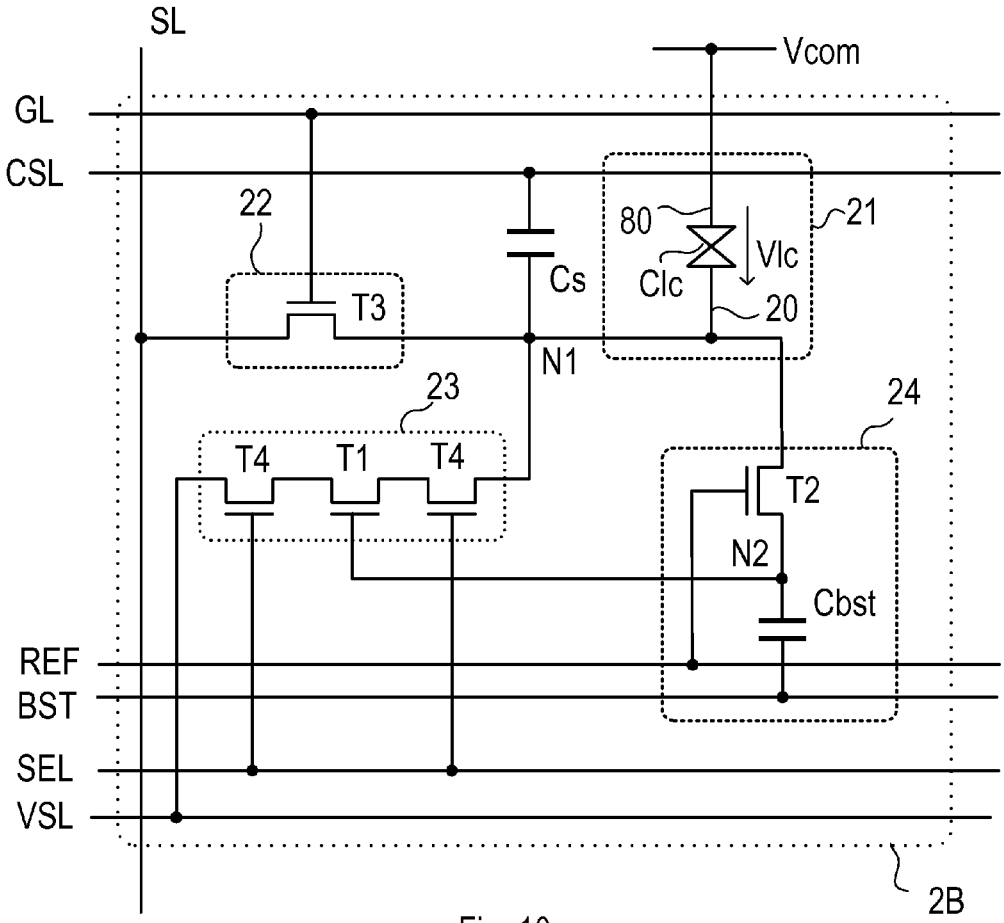
FIG. 10 shows another first type pixel circuit of the group X.

Similar to the first type, as for the second and third types, variation circuit can be implemented according to the configuration of the second switch circuit 23 as shown in FIGS. 9 and 10.

(Fourth and Fifth Type)

Next, a description will be given of each type of the pixel circuit in which the first switch circuit 22 is composed of the series circuit of the transistor T3 and the other transistor element.

Figure 13:
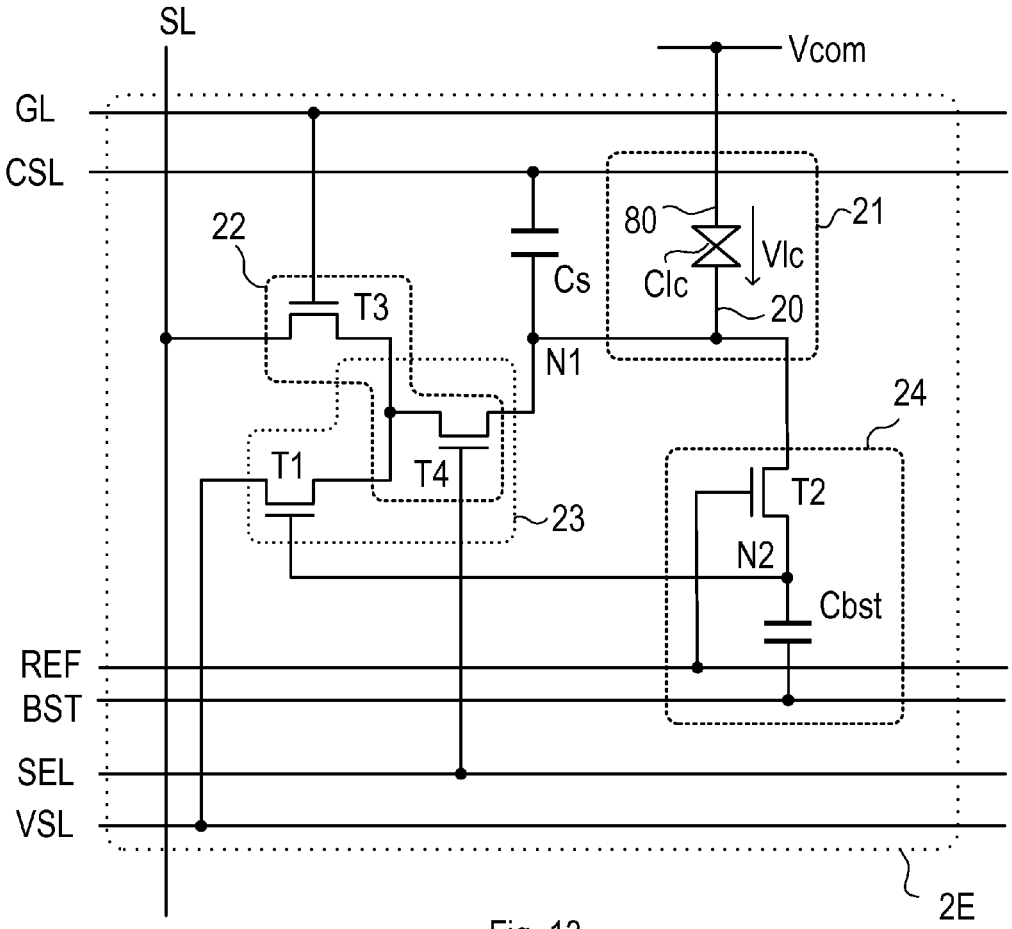
FIG. 13 shows a fourth type pixel circuit of the group X.

According to a forth type pixel circuit 2E shown in FIG. 13, it is the same as the first type pixel circuit 2B shown in FIG. 8 except that the first switch circuit 22 is composed of the series circuit of the transistor T3 and the other transistor element.

Here, FIG. 13 shows a configuration in which the transistor in the second switch circuit 23 also serves as the transistor element other than the transistor T3 in the first switch circuit 22. That is, the first switch circuit 22 is composed of a series circuit of the transistor T3 and the transistor T4, and the second switch circuit 23 is composed of a series circuit of the transistor T1 and the transistor T4. Thus, the first terminal of the transistor T4 is connected to the internal node N1, the second terminal of the transistor T4 is connected to the first terminal of the transistor T1 and a first terminal of the transistor T3, a second terminal of the transistor T3 is connected to the source line SL, and a second terminal of the transistor T1 is connected to the voltage supply line VSL.

That is, according to the fourth type pixel circuit 2E, the first switch circuit 22 is turned on by the selection line SEL in addition to the gate line GL.

Figure 14:
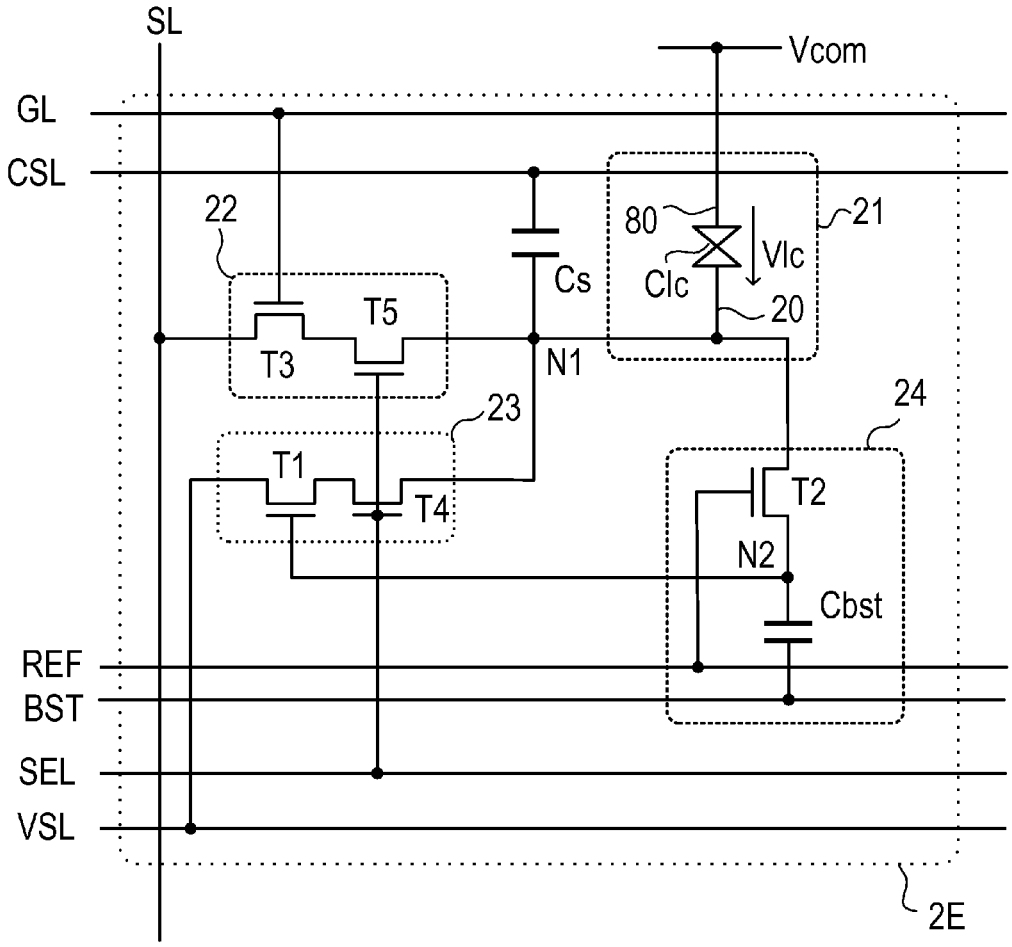
FIG. 14 shows another fourth type pixel circuit of the group X.

As a variation example of this fourth type, as shown in FIG. 14, the transistor element other than the transistor T3 in the first switch circuit 22 may be a transistor T5 having a control terminal connected to the control terminal of the transistor T4 in the second switch circuit 23. This transistor T5 corresponds to a "fifth transistor element".

According to the pixel circuit 2E shown in FIG. 14, since the control terminals of the transistor T5 and the transistor T4 are connected to each other, the transistor T5 is turned on/off by the selection line SEL similar to the transistor T4. This circuit shares similarity with the configuration in FIG. 13 in that the transistor element other than the transistor T3 in the first switch circuit 22 is turned on/off by the selection line SEL.

Figure 15:
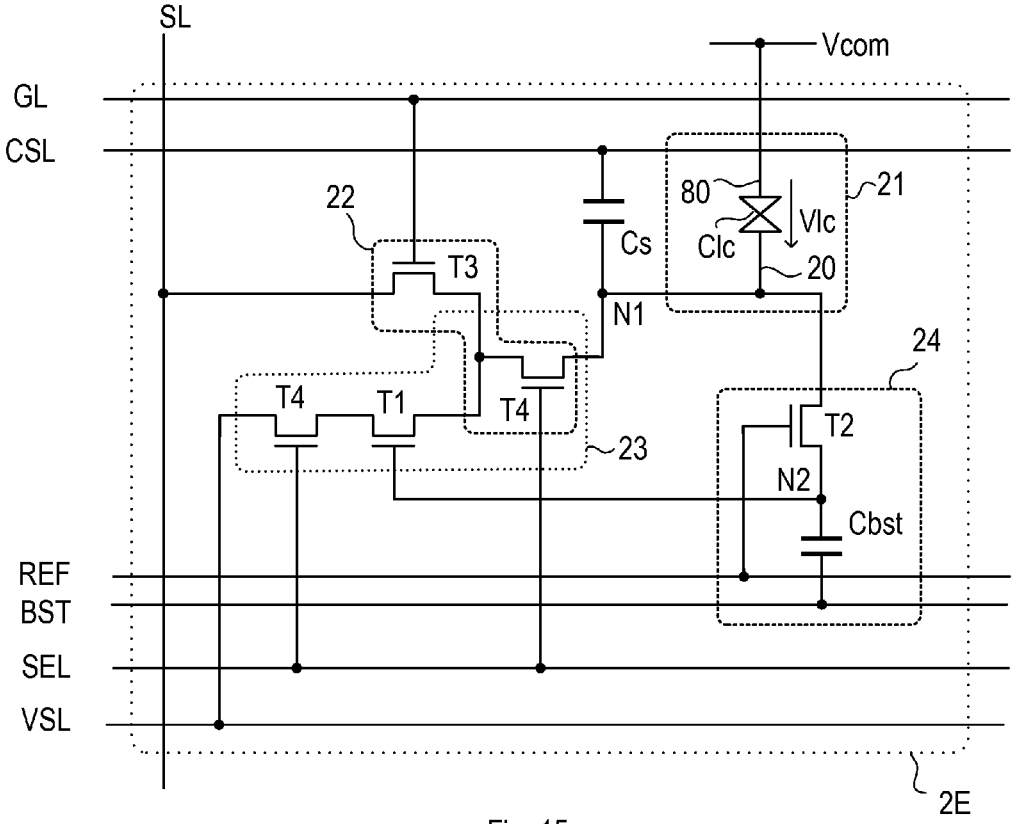
FIG. 15 shows another fourth type pixel circuit of the group X.

In addition, according to the pixel circuit 2E shown in FIG. 13, the transistor T4 is shared by the first switch circuit 22 and the second switch circuit 23. In this circuit configuration, it is necessary to position the transistor T4 on the side of the internal node N1 and position the transistor T1 on the side of the voltage supply line VSL in the second switch circuit 23, and the positional relationship between the transistors T1 and T4 cannot be reversed as shown in FIG. 8. Meanwhile, the transistor T1 may be sandwiched between the transistors T4 as shown in FIG. 10. A variation example in this case is shown in FIG. 15.

Figure 16:
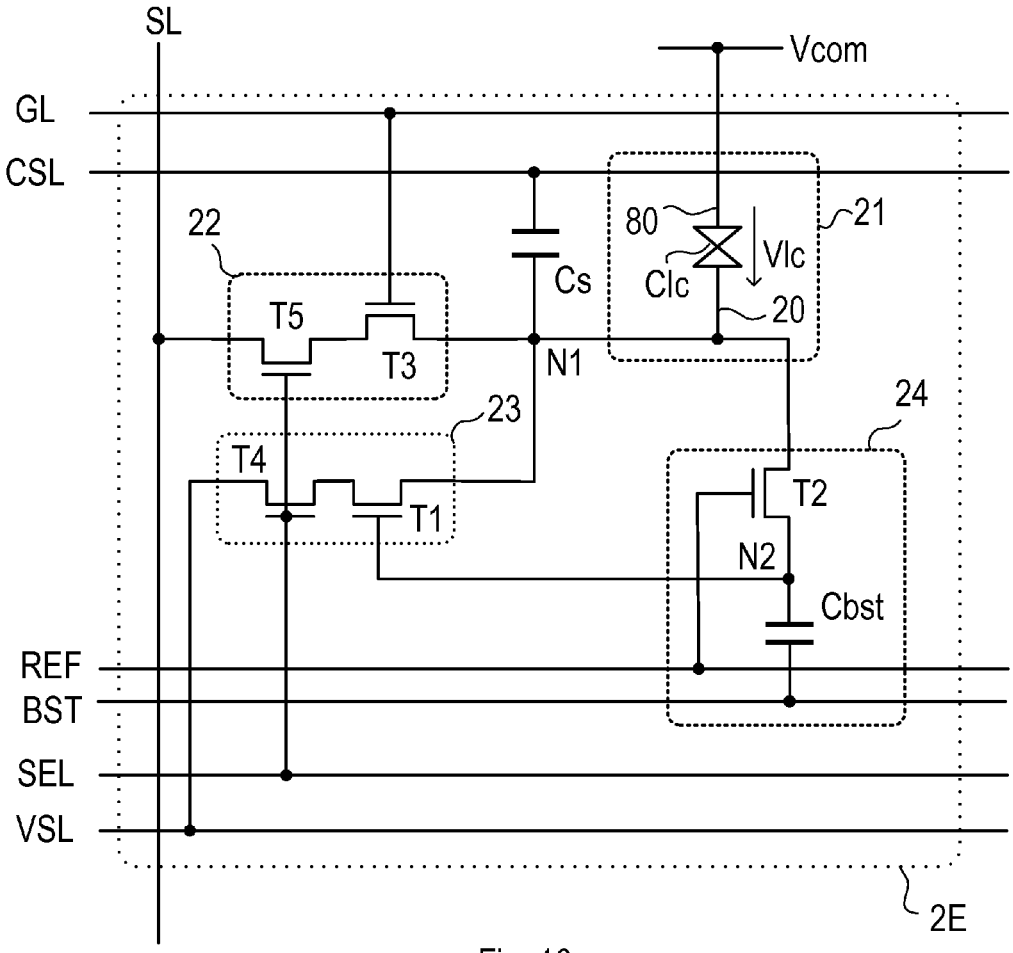
FIG. 16 shows another fourth type pixel circuit of the group X.

Meanwhile, in the case of the configuration shown in FIG. 14, a variation shown in FIG. 16 can be provided by exchanging the positions of the transistors T3 and T5 in the first switch circuit 22, and exchanging the positions of the transistors T1 and T4 in the second switch circuit 23.

Figure 17:
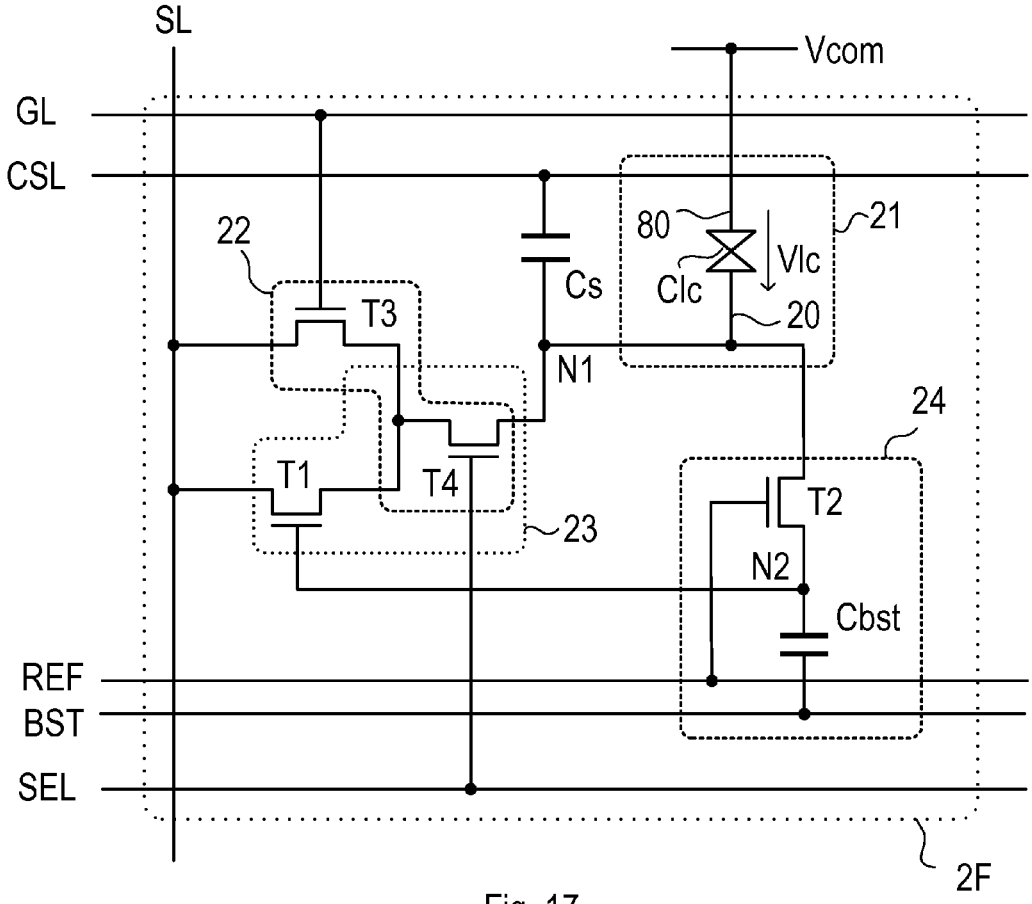
FIG. 17 shows a fifth type pixel circuit of the group X.
Figure 18:
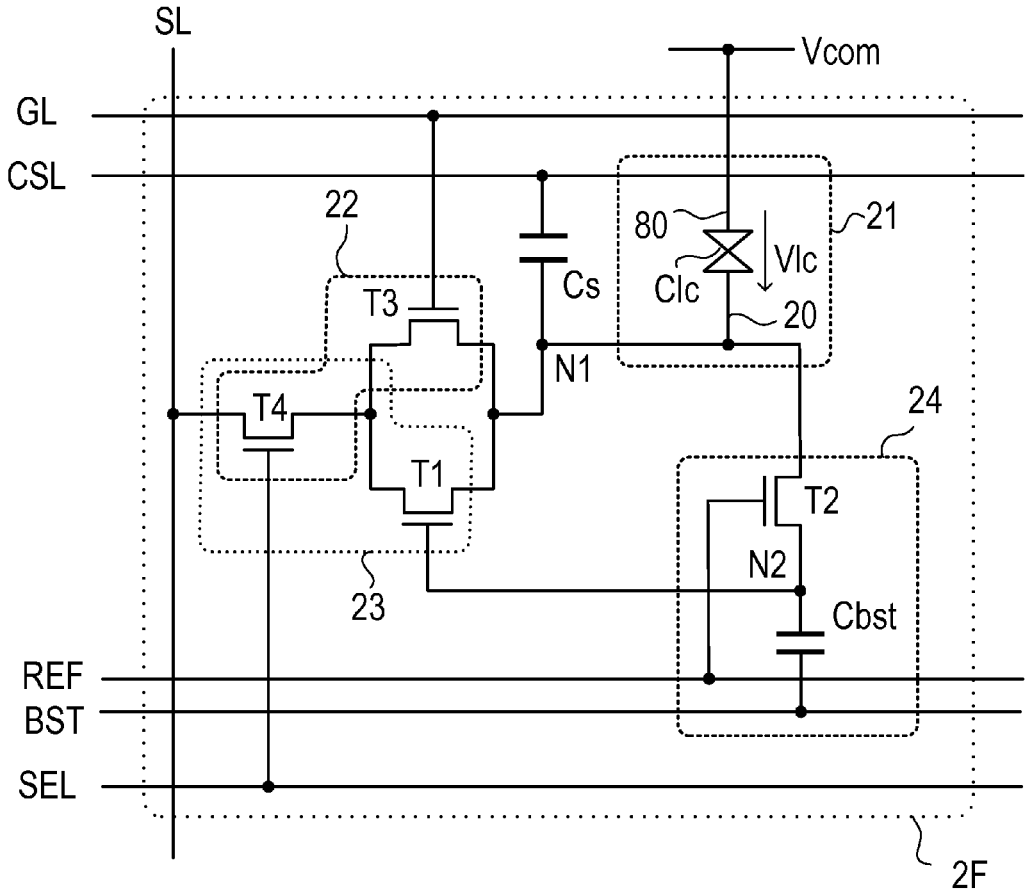
FIG. 18 shows another fifth type pixel circuit of the group X.
Figure 19:
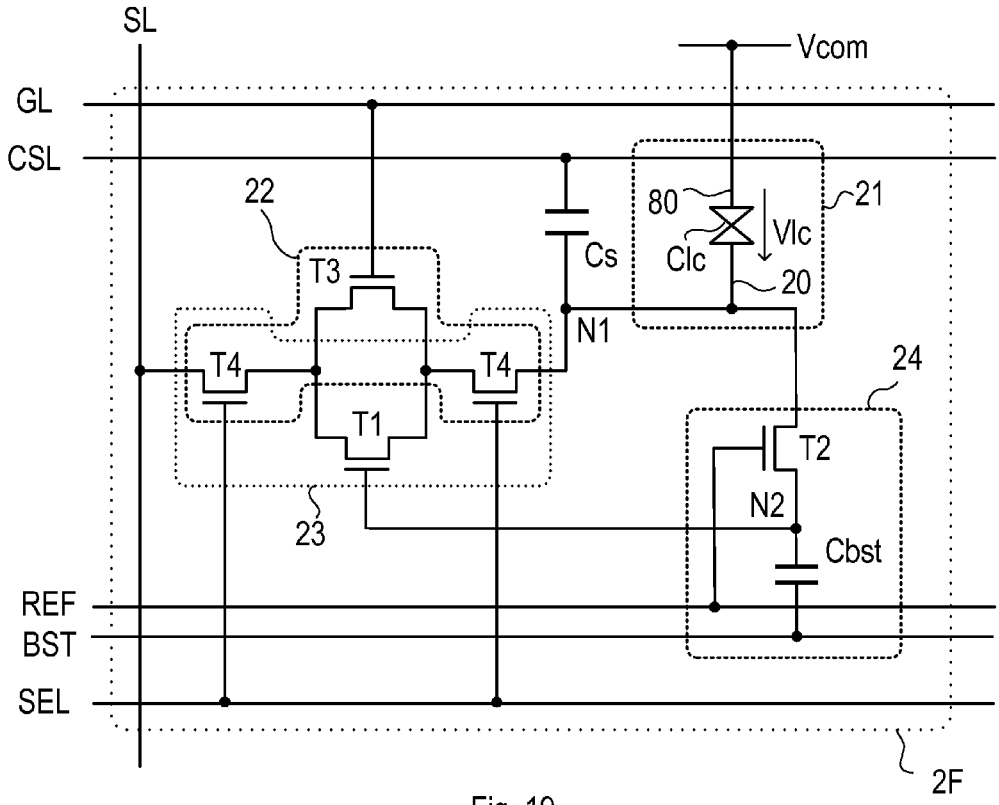
FIG. 19 shows another fifth type pixel circuit of the group X.

According to a fifth type pixel circuit 2F shown in FIG. 17, the first switch circuit 22 is composed of the series circuit of the transistors T4 and T3, compared with the second type pixel circuit 2C shown in FIG. 11. In the case of the fifth type, as for each of the first switch circuit 22 and the second switch circuit 23, one end is connected to the internal node N1 and the other is connected to the source line SL, so that as shown in FIG. 18, the positions of the transistor elements T1 and T4 can be exchanged in the second switch circuit 23. Furthermore, a variation circuit may be provided as shown in FIG. 19. The variation circuits of the fourth type can be implemented as shown in FIGS. 14 to 16, as a matter of course. In addition, according to the fifth type pixel circuit, the selection line SEL is configured so as to be parallel to the gate line GL.

<3. Group Y>

A description will be given of the group Y in which the second switch circuit 23 is composed of the series circuit of the transistors T1 and T4, and the control terminal of the transistor T4 is connected to the boost line BST. That is, according to this group Y, the selection line SEL is eliminated compared with the group X, and the boost line BST serves as the selection line SEL.

According to the group Y also, since the transistor T4 is provided similar to the group X, the writing action is not hindered even when the voltage supply line VSL also serves as the source line SL or the auxiliary capacitance line CSL. However, the voltage supply line cannot also serve as the gate line GL, the reference line REF, or the boost line BST for the same reason as the groups W and X.

According to the group Y, similar to the group X, in the case where the first switch circuit 22 is composed of the transistor T3 only, the configuration in which the voltage supply line VSL is an independent source line is set as the first type, and the configuration in which the voltage supply line VSL also serves as the source line SL is set as the second type. In addition, in the case where the first switch circuit 22 is composed of the series circuit of the transistor T3 and the other transistor element which is turned on by the signal line other than the gate line GL, similar to the group X, the configuration in which the voltage supply line VSL is an independent signal line is set as the fourth type, and the configuration in which it also serves as the selection line SL is set as the fifth type. In addition, the configuration in which the voltage supply line VSL also serves as the auxiliary capacitance line CSL will be described in another example.

Figure 20:
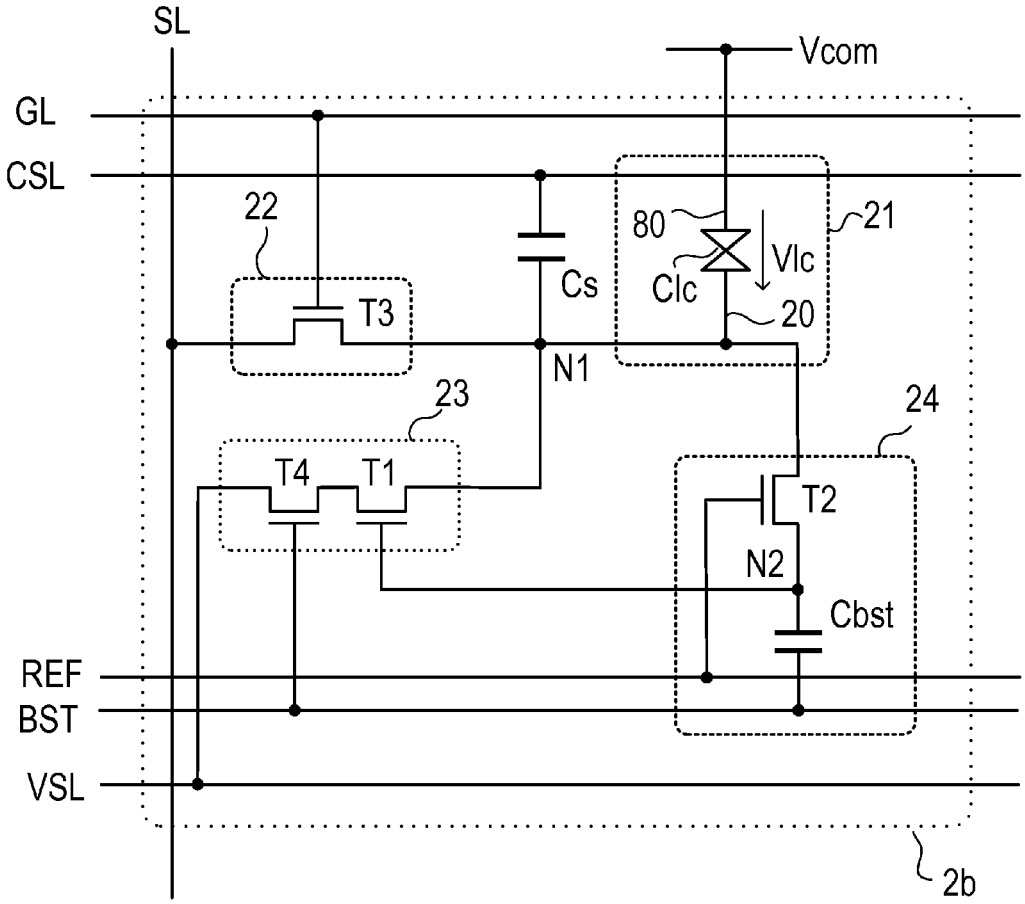
FIG. 20 shows a first type pixel circuit of a group Y.

That is, the first type pixel circuit of the group Y corresponds to the configuration in which the control terminal of the transistor T4 is connected to the boost line BST, and the selection line SEL is eliminated, compared with the first type pixel circuit of the group X (FIGS. 8 to 10). The configuration corresponding to FIG. 8 is shown in FIG. 20. In addition, in each drawing of the pixel circuit of the group Y, alphabetical characters of the corresponding group X are decapitalized to make the corresponding relationship clear. A pixel circuit 2*b* is shown in FIG. 20.

Figure 21:
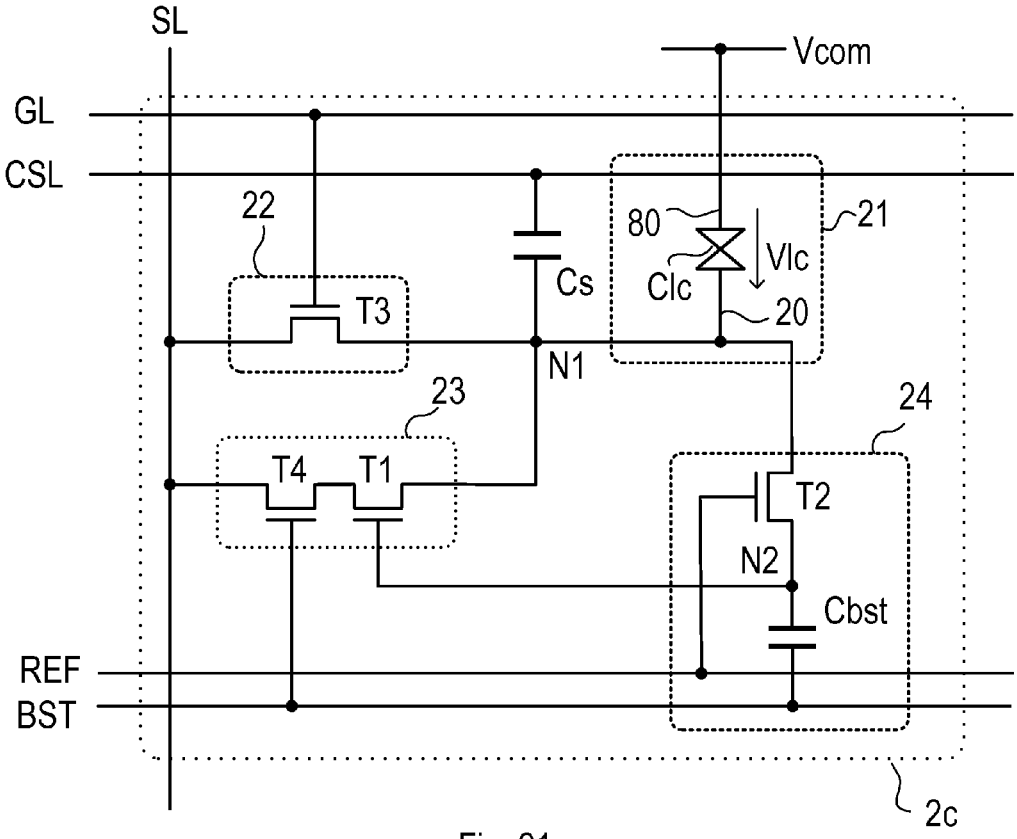
FIG. 21 shows a second type pixel circuit of the group Y.
Figure 22:
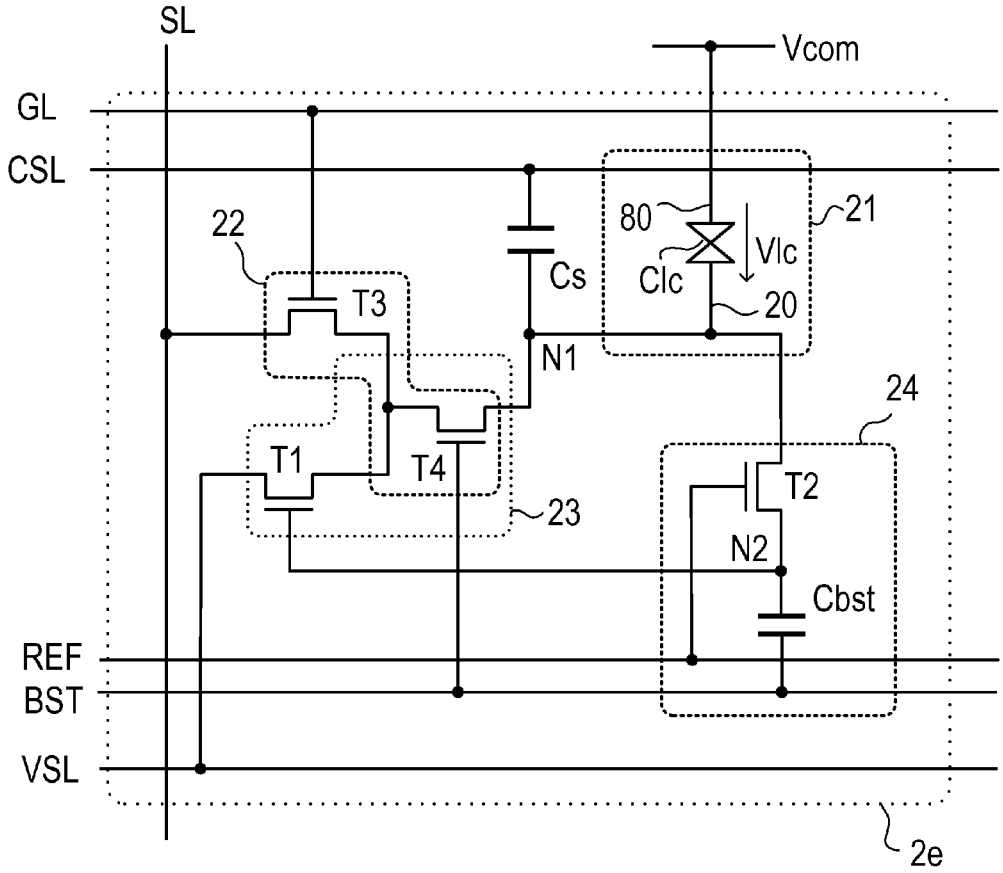
FIG. 22 shows a fourth type pixel circuit of the group Y.
Figure 23:
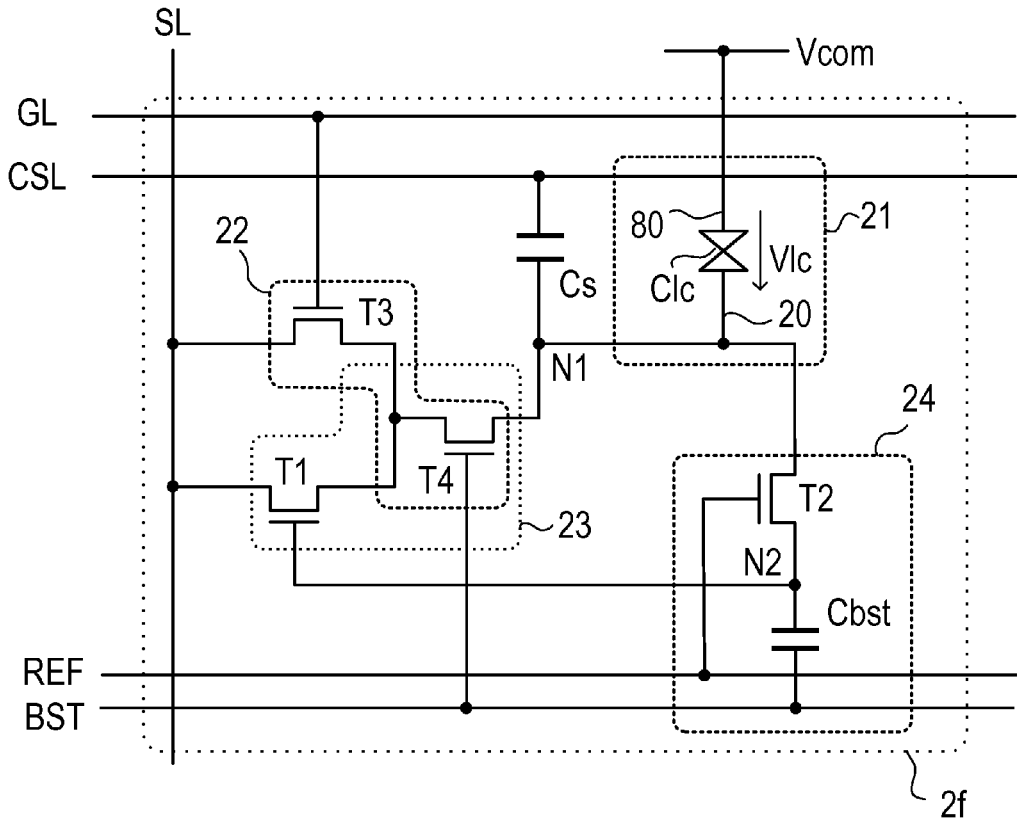
FIG. 23 shows a fifth type pixel circuit of the group Y.

A second type pixel circuit 2*c* can be configured so as to correspond to the second type pixel circuit 2C of the group X, and its one example is shown in FIG. 21. A forth type pixel circuit 2*e* can be configured so as to correspond to the fourth type pixel circuit 2E of the group X, and its one example is shown in FIG. 22. A fifth type pixel circuit 2*f* can be configured so as to correspond to the fifth type pixel circuit 2F of the group X, and its one example is shown in FIG. 23.

In addition, as for the pixel circuit belonging to the group Y, variation circuits can be implemented similarly to the same type pixel circuit as described above in the group X.

[Second Embodiment]

In a second embodiment, a description will be given of the self refreshing actions in the pixel circuits belonging to the above groups W, X, and Y, with reference to the drawings.

The self refreshing action means an action performed in the constant display mode for the plurality of the pixel circuits 2 such that the first switch circuits 22, the second switch circuits 23, and the control circuits 24 are activated in a predetermined sequence, and the potentials of the pixel electrodes 20 (the potentials of the internal nodes N1) are restored to the potential written in the last writing action collectively at the same time. The self refreshing action is a specific action for the above pixel circuits in the present invention, and power consumption can be considerably reduced, compared with a conventional "external refreshing action" in which the potential of the pixel electrode 20 is restored by performing the normal writing action. In addition, the above term "at the same time" in "collectively at the same time" means "the same time" having a time width of the self refreshing action.

Meanwhile, in the conventional case, only the polarity of a liquid crystal voltage Vcl applied between the pixel electrode 20 and the opposite electrode 80 is reversed while its absolute value is maintained (external polarity reversing action) by performing the writing action. When this external polarity reversing action is performed, the polarity is reversed and the absolute value of the liquid crystal voltage Vcl is updated to a state at the time of the last writing. That is, the polarity reversing and the refreshing actions are performed at the same time. Therefore, it is not normally performed to execute the refreshing action with a view to only updating the absolute value of the liquid crystal voltage Vcl without reversing the polarity, but hereinafter, such refreshing action is referred to as the "external refreshing action" with a view to comparing it with the self refreshing action, for convenience in description.

In addition, in the case where the refreshing action is executed by the external polarity reversing action, the writing action is still performed. That is, also when compared with this conventional method, the power consumption is considerably reduced by the self refreshing action in this embodiment.

The voltages are applied at the same timing to all of the gate line GL, the source line SL, the reference line REF, the auxiliary capacitance line CSL, and the boost line BST which are connected to the pixel circuit 2 serving as the target of the self refreshing action, and the opposite electrode 80. In the case where the selection line SEL is provided, and in the case where the voltage supply line VSL is provided as an independent signal line, the voltage is applied to each of these signal lines at the same timing. Thus, under the same timing, the same voltage is applied to all of the gate lines GL, the same voltage is applied to all of the reference lines REF, the same voltage is applied to all of the auxiliary capacitance lines CSL, and the same voltage is applied to all of the boost lines BST. In the case where the selection line SEL and the voltage supply line VSL are provided as independent signal lines, the same voltage is applied to all of the selection lines SEL, and the same voltage is applied to all of the voltage supply lines VSL. The timing control of the voltage application is performed by the display control circuit 11, and individual voltage application is performed by the display control circuit 11, the opposite electrode drive circuit 12, the source driver 13, and the gate driver 14.

In the constant display mode in this embodiment, since the two-gradation (binary) pixel data is held for each pixel circuit, the potential VN1 (voltage VN1) held in the pixel electrode 20 (internal node N1) shows two voltage states such as a first voltage state and a second voltage state. According to this embodiment, similar to the above opposite voltage Vcom, a description will be given assuming that the first voltage state is the high level (5 V), and the second voltage state is the low level (0 V).

In the state just before the execution of the self refreshing action, it is supposed that there exist the pixel in which the pixel electrode 20 is written at the high level voltage, and the pixel in which it is written at the low level voltage. However, according to the self refreshing action in this embodiment, the refreshing action can be executed for all of the pixel circuits by applying the voltage based on the same sequence, regardless of whether the pixel electrode 20 is written at the low voltage or high voltage. These contents will be described with reference to a timing chart and a circuit diagram.

In addition, hereinafter, a case where the voltage in the first voltage state (high level voltage) is written in the last writing action, and the high level voltage is to be restored is referred to as a "case H", and a case where the voltage is written in the second voltage state (low level voltage) in the last writing action, and the low level voltage is to be restored is referred to as a "case L".

<1. Group W>

First, a description will be given of the self refreshing action for the pixel circuit belonging to the group W with respect to each type.

Figure 24:
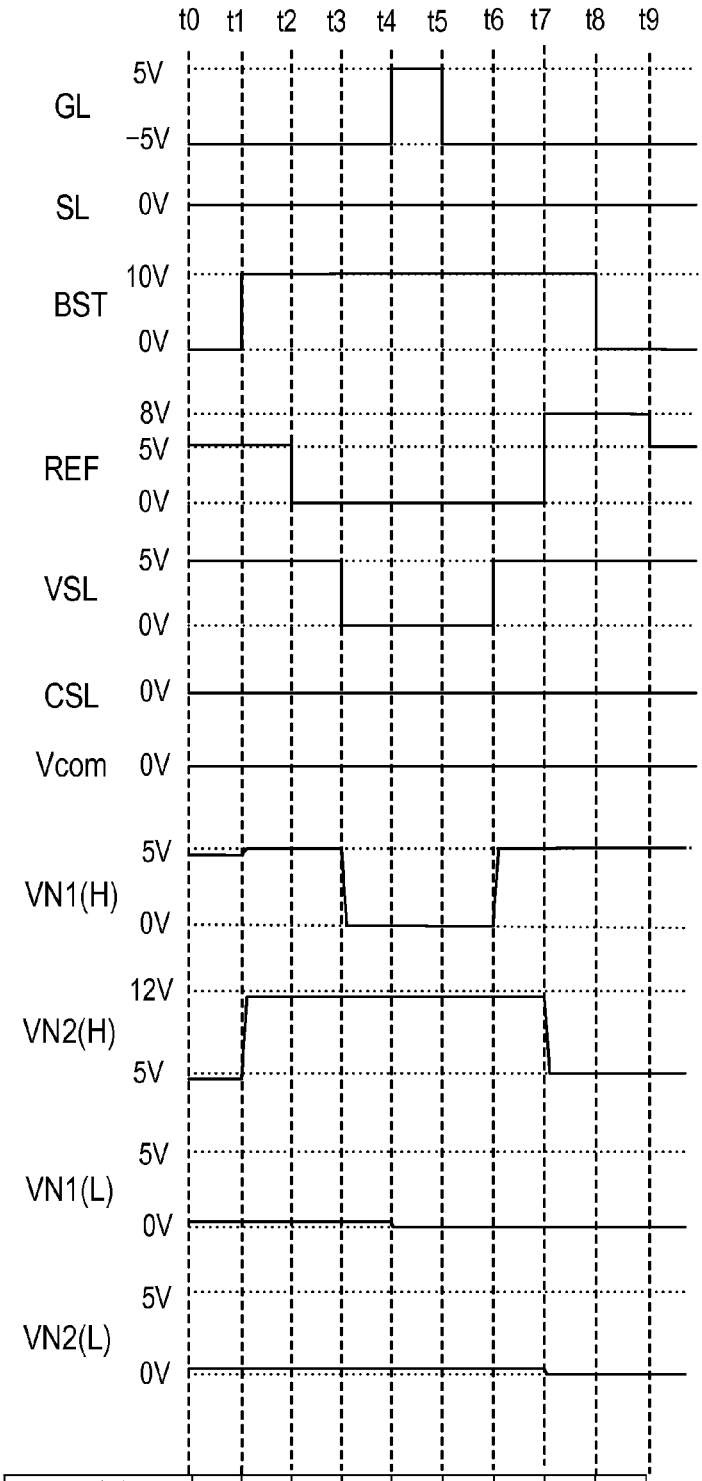
FIG. 24 shows one example of a timing chart of a self refreshing action in the pixel circuit of the group W.

FIG. 24 shows one example of a timing chart of the self refreshing action for the pixel circuit 2A (FIG. 7). FIG. 24 illustrates voltage waveforms of all of the gate line GL, the source line SL, the reference line REF, the auxiliary capacitance line CSL, the voltage supply line VSL, and the boost line BST which are connected to the pixel circuits 2A serving as the target of the self refreshing action, and a voltage waveform of the opposite voltage Vcom. In addition, according to this embodiment, it is assumed that all of the pixel circuits of the pixel circuit array are the target of the self refreshing action.

In addition, FIG. 24 shows waveforms showing changes of the potential (pixel voltage) VN1 of the internal node N1, and the potential VN2 of the output node N2 in each case of H and L, and on/off states of the transistors T1 to T3. Furthermore, in FIG. 24, the case to which it belongs is shown in the parentheses. For example, VN1 (H) is a waveform showing the change of the potential VN1 in the case H.

In addition, it is assumed that the high level has been written in the case H, and the low level has been written in the case L at a point before a time (t0) to start the self refreshing action.

In addition, in each of the following timing chart, the times t0 to t9 are shown at regular intervals for descriptive purposes, but the time intervals are not necessarily regular.

After the writing action has been executed and the time has elapsed without executing the self refreshing action, the potential VN1 of the internal node N1 changes due to generation of a leak current of each transistor in the pixel circuit. In the case H, the VN1 is 5 V just after the writing action, but this value is reduced from the original value after the time has elapsed. This is mainly because the leak current flows toward a low potential (such as ground line) through the off-state transistor.

In addition, in the case L, the potential VN1 is 0 V just after the writing action, but it could rise a little with time. This is because a leak current flows from the source line SL to the internal node N1 through the off-state transistor even in the unselected pixel circuit because the writing voltage is applied to the source line SL at the time of the writing action for another pixel circuit.

FIG. 24 shows that the VN1(H) is a little lower than 5 V, and the VN1(L) is a little higher than 0 V, at the time t0. These are due to the above potential fluctuation.

At the time t0, 5 V is applied to the reference line REF. This voltage has a voltage value which turns off the transistor T2 when the voltage state (potential state) of the internal node N1 is the high level (case H), and turns on the transistor T2 when it is the low level (case L). This applied voltage corresponds to a "first control voltage".

A voltage which completely turns off the transistor T3 is applied to the gate line GL. Here, it is set at −5 V. This applied voltage corresponds to a "first scan voltage".

A voltage (0 V) corresponding to the second voltage state is applied to the source line SL. In addition, as for the pixel circuit 2A, the voltage applied to the source line SL can be always 0 V during the self refreshing action.

The opposite voltage Vcom applied to the opposite electrode 80, and a voltage applied to the auxiliary capacitance line CSL are set to 0 V. However, the voltage is not limited to 0 V, and a voltage value at a time before the time t0 may be maintained as it is.

A voltage of 0 V is applied to the boost line BST as an initial voltage at the time t0. In addition, the voltage (5 V) of the first voltage state is applied to the voltage supply line VSL. In addition, the voltage applied to the voltage supply line VSL for the times t0 to t3 is not always 5 V as will be described as another example.

At a time t1, the voltage applied to the boost line BST is increased. The voltage is set at 10 V in this embodiment. With this voltage value, the transistor T1 is turned on when the voltage state of the node N1 is at the high level (case H), while the transistor T1 is turned off when it is at the low level (case L), and this value corresponds to a "first boost voltage".

The boost line BST is connected to the one end of the boost capacitive element Cbst. Therefore, when the high level voltage is applied to the boost line BST, the potential of the other end of the boost capacitive element Cbst, that is, the potential VN2 of the output node N2 is thrust upward. Thus, hereinafter, to thrust the potential of the output node N2 upward by increasing the voltage to be applied to the boost line BST is referred to as the "boost upthrust".

As described above, in the case H, the transistor T2 is off at the time t1. Therefore, a potential fluctuation amount of the node N2 due to the boost upthrust is determined by a ratio of the boost capacitance Cbst to the total capacitance which is parasitic in the node N2. For example, in a case where the ratio is 0.7, when one electrode of the boost capacitive element is increased by ΔVbst, the other electrode, that is, the node N2 is increased by roughly 0.7 ΔVbst.

At the time t1, 5 V is applied to the reference line REF. Therefore, similar to the point at the time t0, in the case H, the transistor T2 is off at the time t1. Therefore, the potential fluctuation amount of the node N2 due to the boost upthrust is determined by the ratio between the boost capacitance Cbst and the total capacitance which is parasitic in the node N2. For example, in the case where the ratio is 0.7, when one electrode of the boost capacitive element is increased by ΔVbst, the other electrode, that is, the node N2 is increased by roughly 0.7 ΔVbst.

The potential VN1 (H) of the internal node N1 shows roughly 5 V at the time t1, so that when a potential higher than the VN1 (H) by the threshold voltage of 2 V or more is applied to the gate of the transistor T1, that is, to the output node N2, the transistor T1 is turned on. According to this embodiment, the voltage applied to the boost line BST at the time t1 is set to 10 V. In this case, the potential of the output node N2 is increased by 7V. At the point just before the time t1, the potential VN2 (H) of the output node N2 shows almost the same potential (5 V) as that of the VN1 (H), so that the node N2 shows about 12 V by the boost upthrust. Therefore, the potential difference more than the threshold voltage is generated between the gate of the transistor T1 and the node N1, so that the transistor T1 is turned on. To describe this, "ON" is shown in the T1 (H) during the times t1 to t2 in FIG. 24.

On the other hand, in the case L, the transistor T2 is on at the time t1. That is, unlike the case H, the output node N2 and the internal node N1 are electrically connected. In this case, the fluctuation amount of the potential VN2 (L) of the output node N2 due to the boost upthrust is affected by the total parasitic capacitance of the internal node N1, in addition to the boost capacitance Cbst and the total parasitic capacitance of the node N2.

Since the internal node N1 is connected to the one end of the auxiliary capacitive element Cs, and the one end of the liquid crystal capacitive element Clc, the total capacitance Cp which is parasitic in the internal node N1 is expressed by the sum of the liquid crystal capacitance Clc and the auxiliary capacitance Cs as described above. Thus, the boost capacitance Cbst is considerably smaller than the liquid crystal capacitance Cp. Therefore, a ratio of the boost capacitance to the total capacitance is extremely small such as about 0.01 or less. In this case, when one electrode of the boost capacitive element is increased by ΔVbst, the other electrode, that is, the output node N2 is only increased by up to 0.01 ΔVbst. That is, even when ΔVbst=10 V, the potential VN2 (L) of the output nodes N2 is hardly increased. Thus, the transistor T1 is still off during the times t1 to t2. To describe this, "OFF" is shown in the T1 (L) during the times t1 to t2 in FIG. 24.

As described above, due to the boost upthrust at the time t1, the transistor T1 in the case H is turned on. According to this example, 5 V is applied to the voltage supply line VSL at the time t1, so that in the case H, this 5 V is supplied to the node N1 through the transistor T1. That is, the node N1 (H) is refreshed to 5 V (refer to a waveform of the VN1 (H) during the times t1 to t2). However, as will be described below, the potential VN1 of the node N1 is forcibly refreshed to 0 V after that, there is little point in this refreshing action in this time zone, and it is only temporarily refreshed to 5 V in the course of the whole refreshing action. In addition, the transistor T2 (H) is off in this period, so that the potential VN2 (H) of the node N2 is kept at the last potential.

At a time t2, the voltage applied to the reference line REF is reduced to 0 V. This value only has to turn off the transistor T2 in each case of H and L, and corresponds to a "second control voltage". The voltage of the reference line REF is kept at this value until a time t7, and the transistor T2 shows an off state until the above time in each case of H and L. When the transistor T2 is turned off, the potential VN2 of the output node N2 is held without being affected by the fluctuation of the potential VN1 of the internal node N1.

At a time t3, the voltage state of the voltage supply line VSL is reduced to the second voltage state (0 V). In addition, at this time also, the transistor T1 of the case H is still on, so that a current path is formed from the internal node N1 to the voltage supply line VSL through the transistor T1, and the state of the VN1 (H) is reduced to the second voltage state (0 V). In addition, since the transistor T2 (H) is off, the potential VN2 (H) of the output node N2 still holds the last potential.

At a time t4, the voltage applied to the gate line GL is increased to turn on the transistor T3 in each case of H and L. Here, 5 V is applied. This applied voltage corresponds to a "second scan voltage". Thus, the conduction between the source line SL to which the voltage (0V) of the second voltage state is applied and the internal node N1 is established, so that the potential VN1 of the internal node N1 is refreshed to the second voltage state (0 V) in each case of H and L. In addition, at this time, the transistor T2 is off in each case, so that the potential VN2 of the output node N2 still holds the last potential without being refreshed.

At a time t5, the voltage applied to the gate line GL is reduced (to −5 V) again to turn off the transistor T3. The potential VN1 of the internal node N1 holds the previously refreshed state (0 V) in each case of H and L.

At a time t6, the voltage of the first voltage state (5 V) is applied to the voltage supply line VSL. In the case H, the potential of the output node N2 is still maintained at the high level at this point, so that the transistor T1 is still on. Thus, in the case H, a current path is formed from the voltage supply line VSL to the internal node N1 through the transistor T1, and the internal node N1 (H) is refreshed to the first voltage state (5 V). Meanwhile in the case L, the output node VN2 is in the low level state, and the transistor T1 is off, so that 5 V applied to the voltage supply line VSL is not applied to the internal node N1.

That is, during the times t4 to t5, the internal node N1 is refreshed to the second voltage state in each case, and during the times t6 to t7, the internal node N1 is refreshed to the first voltage state only in the case H. Thus, the refreshing action is performed in each case.

After the time t7, a subsequent process is performed after the refreshing action. At the time t7, 8 V is applied to the reference line REF. This is performed in order to turn on the transistor T2 in each case of H and L, and in order to copy the refreshed potential of the internal node N1 to the output node N2. As described above, since the parasitic capacitance of the internal node N1 is considerably larger than the parasitic capacitance of the output node N2, the potential VN1 of the internal node N1 is not affected by the potential VN2 of the output node N2 even when the internal node N1 and the output node N2 are connected, but the VN2 is moved to the VN1, on the contrary. Thus, the refreshed potential is held at the output node N2 in each case. That is, the VN2 (H) is at 5 V, and the VN2 (L) is at 0 V.

At a time t8, the voltage applied to the boost line BST is reduced to 0 V. In addition, at this point, the transistor T2 is on in each case, and the output node N2 and the internal node N1 are connected. As described above, the parasitic capacitance of the internal node N1 is considerably larger than the capacitance of the boost capacitive element, so that the VN1 and the VN2 are hardly affected by the fluctuation of the voltage applied to the boost line BST, and the previous potential is maintained as it is.

Then, at a time t9, the voltage applied to the reference line REF is returned to 5 V. Thus, the voltage applied to each line is the same as that at the time t0. After a standby period for a while in this state, the actions during the times t1 to t9 are repeated again, whereby the self refreshing actions are repeated.

Like the conventional case, in the case where the refreshing action is performed by the writing action by applying the voltage through the source line SL, it is necessary to scan the gate lines GL one by one in the vertical direction. Therefore, it is necessary to apply a high-level voltage to the gate lines GL as often as the number (n) of the gate lines. In addition, it is necessary to apply the same potential level as the potential level written in the last writing action to each source line SL, so that up to n times of charge/discharge actions are needed for each source line SL.

Meanwhile, according to this embodiment, the voltage application control as shown in FIG. 24 is executed for each of the gate line GL, the boost line BSL, the reference line REF, and the voltage supply line VSL during the times t1 to t9, and after that, the potential of each line is constantly held, whereby the internal node potential VN1 (potential of the pixel electrode 20) in each of all pixels can be returned to the potential state at the time of the writing action. Especially, according to the method of the present invention, the self refreshing action can be directly executed for each of the first voltage state and the second voltage state.

Thus, according to the self refreshing action of this embodiment, compared with the normal external refreshing action, the number of times the voltage is applied to the gate line GL, and the voltage is applied to the source line SL can be considerably reduced, and control contents can be simplified. Therefore, a power consumption amount of the gate driver 14 and the source driver 13 can be largely reduced.

The self refreshing action of this example is summarized as follows. In addition, #1 to #6 refer to the step number.

(#1) The voltage applied to the reference line REF is changed to turn off the transistor T2 in the case H, and turn on the transistor T2 in the case L. In addition, the transistor T3 is turned off.

(#2) The voltage applied to the boost line BST is changed to execute the boost upthrust to turn on the transistor T1 in the case H. As for the case L, since the transistor T2 is on, the potential of the output node N2 is hardly changed, the transistor T1 still holds the off state.

(#3) The voltage applied to the reference line REF is changed to turn off the transistor T2 in each case of H and L.

(#4) The voltage (0 V) of the second voltage state is applied to the source line SL and the voltage applied to the gate line GL is changed to turn on the transistor T3 and refresh the internal node N1 to the second voltage state in each case.

(#5) The voltage applied to the gate line GL is changed to turn off the transistor T3 and then, 5 V is applied to the voltage supply line VSL to refresh the internal node N1 to the first voltage state only in the case H in which the transistor T1 is on. As for the case L, since the transistor T1 is off, the voltage (5 V) applied to the voltage supply line VSL is not supplied to the internal node N1.

(#6) The voltage applied to the boost line BST is returned to the original voltage. In addition, the voltage applied to the reference line REF is changed to turn on the transistor T2 in each case of H and L, and the potential of the internal node N1 is copied to the output node N2.

In addition, following other examples (variation examples) can be provided.

1) In the above example, the voltage (0 V) corresponding to the second voltage state is constantly applied to the source line SL, but the voltage of the second voltage state only has to be applied at least while the transistor T3 is on (times t4 to t5: step #4). However, in the sense that an unnecessary voltage fluctuation can be avoided, 0 V is preferably held over the period of the self refreshing action like the above example.

2) According to the above example, after the completion of the refreshing action for the case H, the transistor T2 of each case (H, L) is turned on at the time t7, and then the voltage applied to the boost line BST is reduced at the time t8. However, the voltage applied to the boost line BST may be reduced at the time t7, and then the transistor T2 of each case (H, L) may be turned on at the time t8 (refer to FIG. 25).

In this case, the transistor T2 is off in each case when the voltage applied to the boost line BST is reduced, so that the potential of the node N2 is largely reduced during the times t7 to t8 (each case of H and L) due to the reduction of the voltage applied to the boost line BST, but after that, since the transistor T2 is turned on at the time t8, the refreshed potential VN1 of the internal node N1 is applied to the output node N2, and the VN2 and the VN1 have the same value. Since the parasitic capacitance of the internal node N1 is considerably larger than the parasitic capacitance of the output node N2, the reduction of the potential of the output node N2 hardly affects the potential VN1 of the internal node N1 as described above.

In the case H, at the time t7, the potential VN2 of the output node N2 is reduced to the potential before the execution of the self refreshing action (the time t0), and this is different from the case in FIG. 24, but after that, 8 V is applied to the reference line REF at the time t8 to turn on the transistor T2, so that the potential VN1 (H) of the internal node N1 which has been refreshed to the first voltage state is applied, and as a result, the VN2 (H) is also put into the refreshed first voltage state (5 V).

In addition, in the case L, at the time t7, the potential VN2 of the output node N2 is largely reduced from the potential before the execution of the self refreshing action (at the time t0), and this is different from the case in FIG. 24, but similar to the case H, the transistor T2 is turned on at the time t8, so that the potential VN1 (L) of the internal node N1 which has been refreshed to the second voltage state can be applied thereto, and as a result, the VN2 (L) is also put into the refreshed second voltage state (0 V).

3) After the time t8, the standby period is provided after the completion of the refreshing action until the refreshing action is executed again. According to the above example, the voltage applied to the reference line REF is 5 V at the time t9, and this means that 5 V is kept applied to the reference line REF in the standby period. However, the condition that 5 V is applied to the reference line REF is not necessarily provided in the standby period. For example, after reducing the voltage applied to the reference line REF to 0 V at the time t9, this state may be continued until the next self refreshing action is executed. In this case, when the next self refreshing action is executed, 5 V is applied to the reference line REF at the time t0.

4) In FIG. 24, 0 V is applied to the voltage supply line VSL during the times t4 to t5, but instead, a method in which 5 V is applied to the voltage supply line VSL during that period can be theoretically implemented. This method will be described in another example.

<2. Group X>

Next, a description will be given of the self refreshing action for the pixel circuit belonging to the group X with respect to each type.

(First Type)

The first type pixel circuit 2B (FIGS. 8 to 10) is only different from the pixel circuit 2A of the group W in that the transistor T4 is provided. Thus, as long as the transistor T4 is constantly on during at least the period of the self refreshing action, totally the same voltage state as that of the above-described first type pixel circuit 2A of the group W can be provided. In this case, its timing chart is as shown in FIG. 26. FIG. 26 also shows the on state of the transistor T4. In addition, in order to turn on the transistor T4, 10 V is applied to the selection line SEL. A description for the action is omitted. In addition, FIG. 26 shows the case to provide totally the same voltage state as that of the timing chart shown in FIG. 24, but the same voltage state as that in FIG. 25 may be provided as a matter of course.

Figure 26:
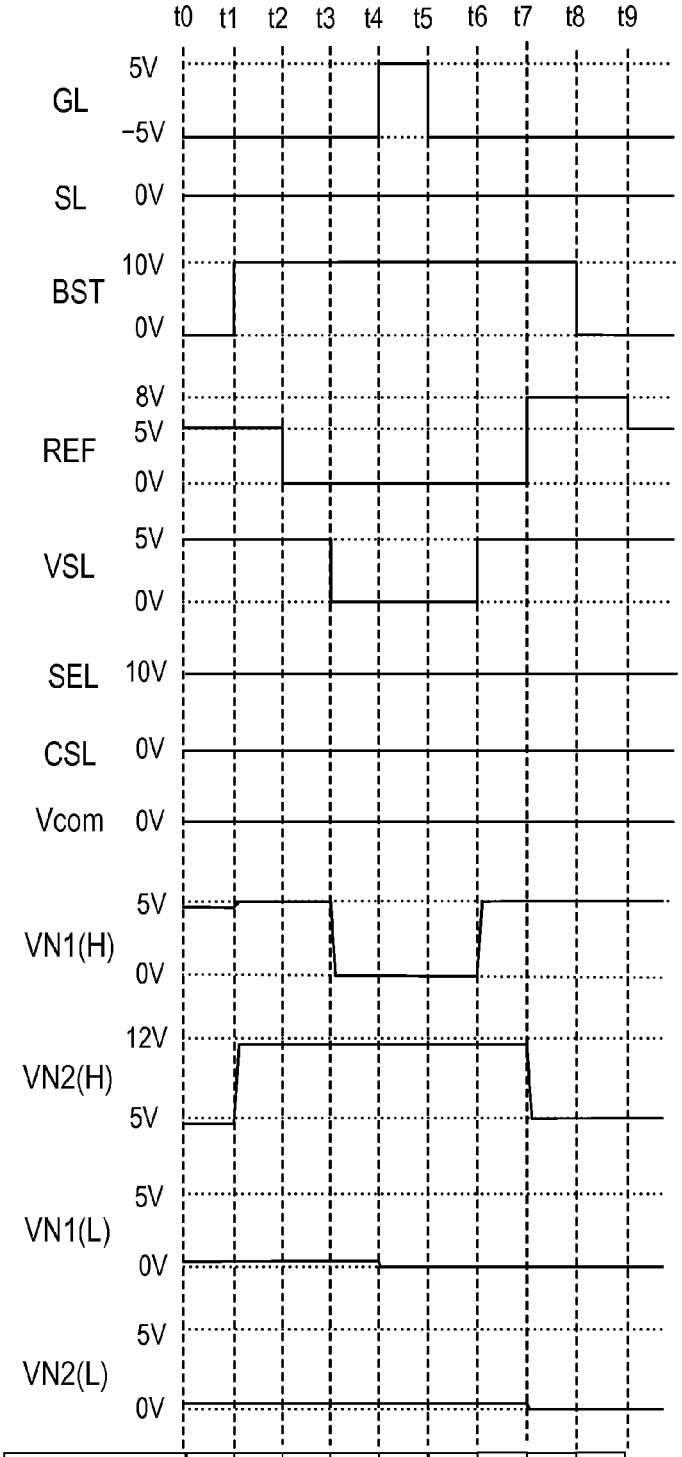
FIG. 26 shows one example of a timing chart of a self refreshing action in the first type pixel circuit of the group X.
Figure 27:
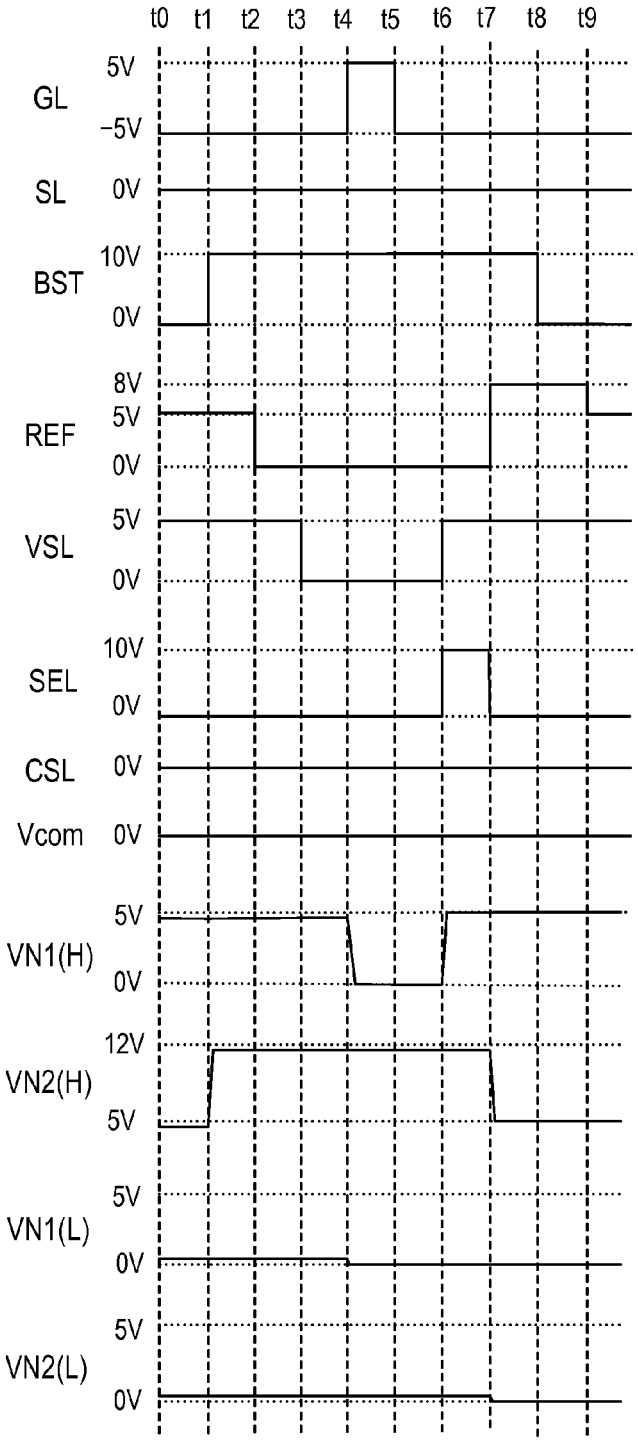
FIG. 27 shows another example of a timing chart of a self refreshing action in the first type pixel circuit of the group X.

Another voltage application method can be used. As described in the group W, under the condition that the first switch circuit 22 is turned off, and the second switch circuit 23 is turned on only in the case H in the step #5, the voltage (5 V) of the first voltage state is supplied from the voltage supply line VSL to the internal node N1, so that only the case H is refreshed to the first voltage state. Therefore, the transistor T4 only has to be turned on during at least this step #5, and it is not necessarily in an always-on state. Compared with the timing chart in FIG. 26, FIG. 27 shows a timing chart when the transistor T4 is on only in the step #5 (times t6 to t7).

Figure 28:
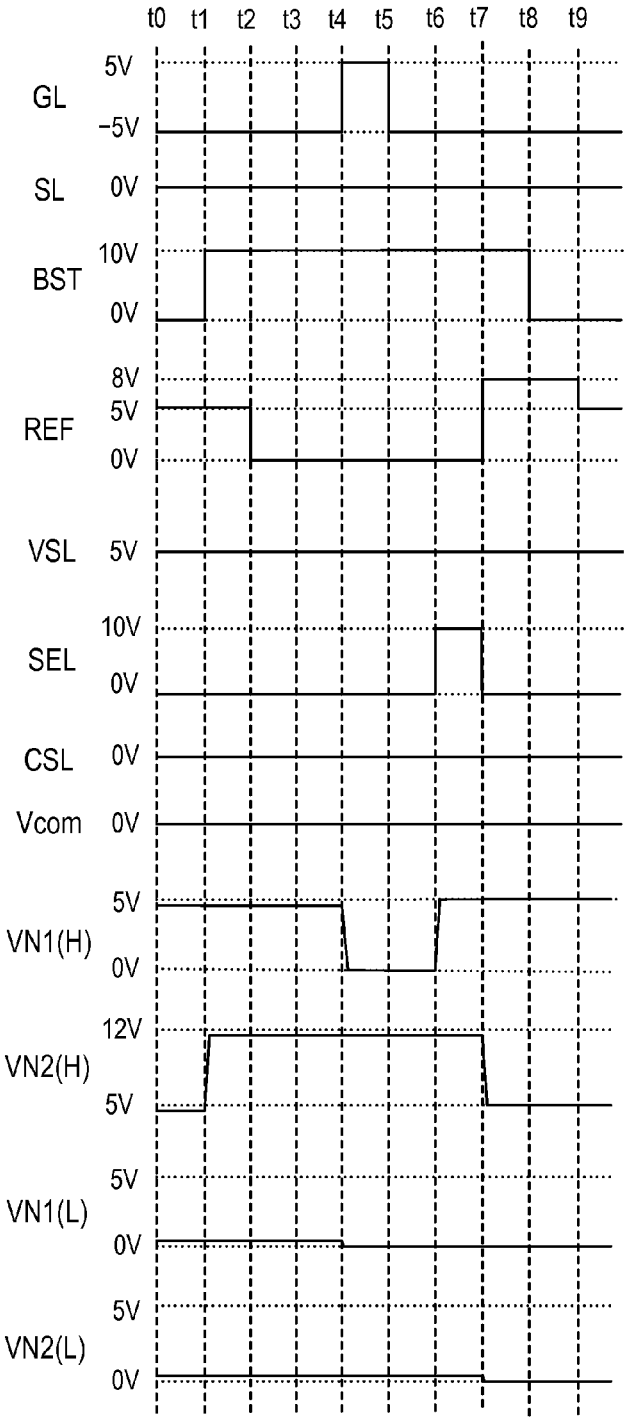
FIG. 28 shows another example of a timing chart of a self refreshing action in the first type pixel circuit of the group X.

Thus, as for this group X, the on/off of the second switch circuit 23 can be also controlled by the transistor T4. Therefore, even when 5 V is applied to the voltage supply line VSL while the refreshing action to 0 V is executed from the source line SL to the internal node N1 in the step #4 (times t4 to t5), the internal node N1 and the voltage supply line VSL can be electrically disconnected as long as the transistor T4 is kept off. Therefore, according to the first type pixel circuit 2B of the group X, the voltage applied to the voltage supply line VSL can be kept at 5 V during the period of the self refreshing action. FIG. 28 shows a timing chart in this case.

(Second Type)

Figure 29:
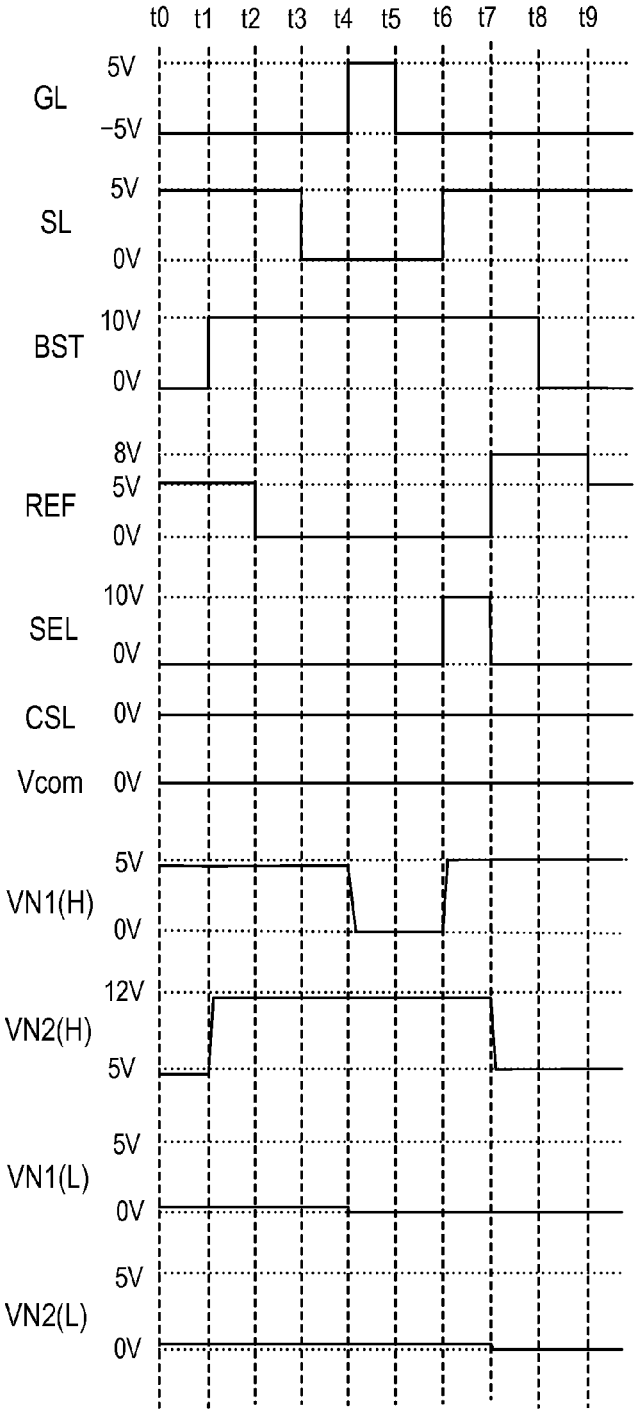
FIG. 29 shows one example of a timing chart of a self refreshing action in the second type pixel circuit of the group X.

The second type pixel circuit 2C (FIG. 11) is different from the pixel circuit 2B in that the voltage supply line VSL also serves as the source line SL. Thus, the high level voltage is applied to the selection line SEL only during at least the step #5 (times t6 to t7) to turn on the transistor T4, and the voltage to be applied to the source line SL is set similarly to the voltage applied to the voltage supply line VSL shown in the timing chart (FIGS. 26 and 27) for the first type pixel circuit 2B. FIG. 29 shows one example of it.

Figure 30:
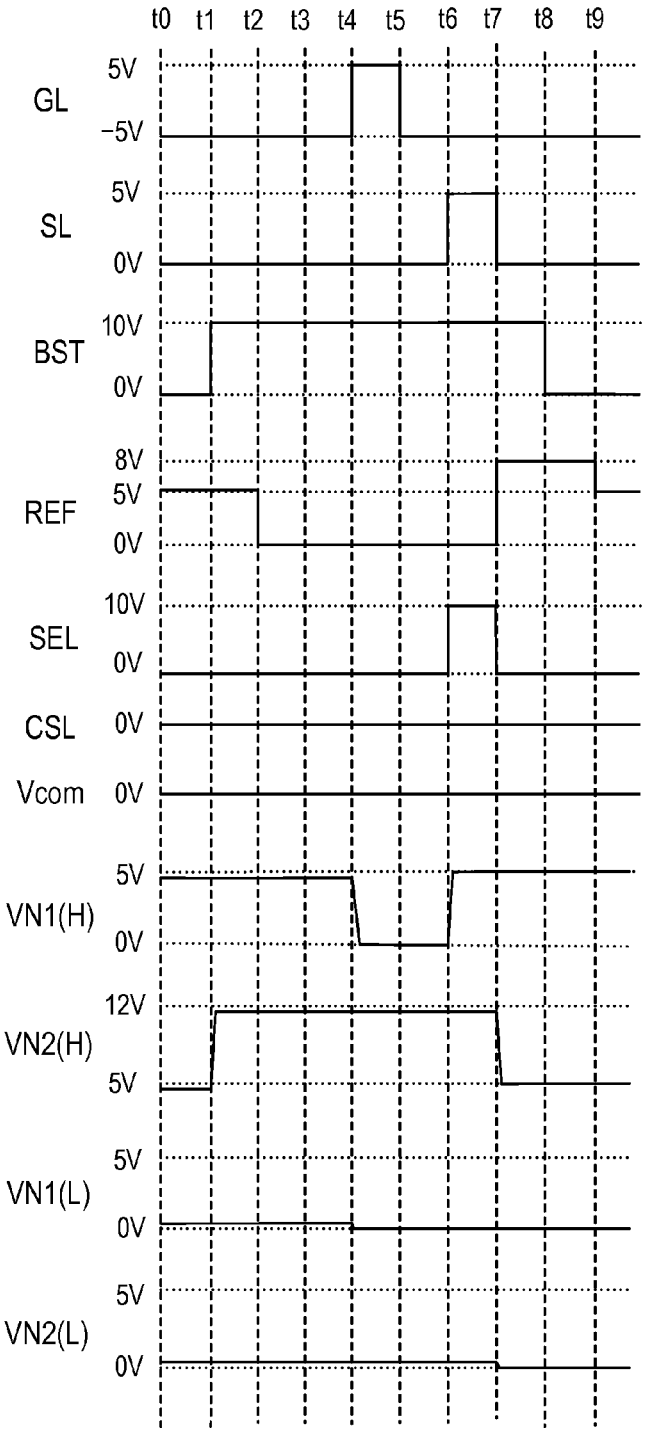
FIG. 30 shows another example of a timing chart of a self refreshing action in the second type pixel circuit of the group X.

In addition, the voltage applied to the source line SL may be 5 V only during the step #5 (times t6 to t7) to refresh the internal node N1 to the first voltage state, and may be 0 V during the other time zone. FIG. 30 shows a timing chart in this case.

(Third Type)

According to the third type pixel circuit 2D, the auxiliary capacitance line CSL also serves as the voltage supply line VSL. The auxiliary capacitance line CSL is connected to the one end of the auxiliary capacitive element CS, and this capacitance accounts for a great proportion of the parasitic capacitance of the internal node N1. Therefore, when the voltage applied to the auxiliary capacitance line CSL fluctuates during the period of the self refreshing action, the potential VN1 of the internal node N1 accordingly fluctuates, which is not preferable. Thus, a constant voltage is applied to the auxiliary capacitance line CSL during the period of the self refreshing action. In this type, since the auxiliary capacitance line CSL also serves as the voltage supply line VSL, it is fixed to the first voltage state (5 V) during the period of the self refreshing action.

Figure 31:
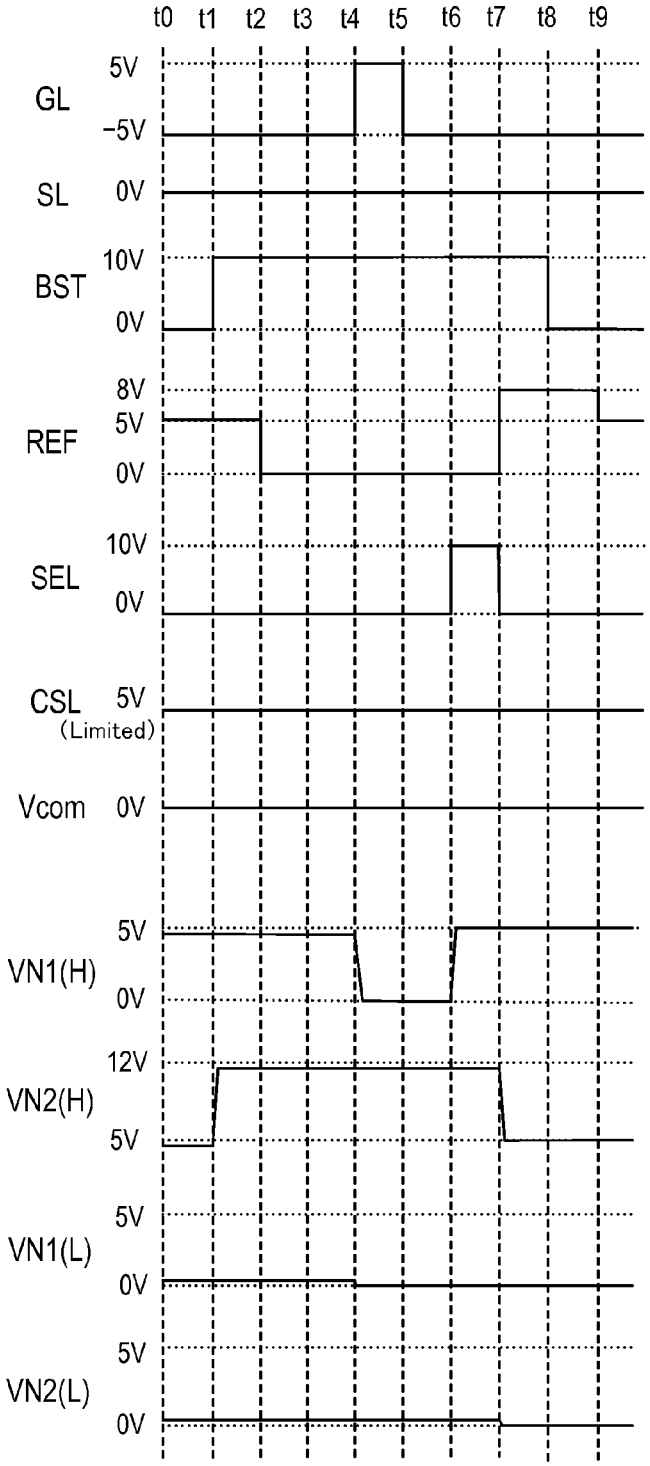
FIG. 31 shows one example of a timing chart of a self refreshing action in the third type pixel circuit of the group X.

In the case of the circuit configuration of this group X, the fact that the refreshing action can be correctly performed even when the voltage applied to the voltage supply line VSL is fixed to 5 V is just as described above with reference to FIG. 28. For the same reason, in the third type pixel circuit 2D, the self refreshing action can be executed by fixing the voltage applied to the auxiliary capacitance line CSL to 5 V. FIG. 31 shows a timing chart in this case. In addition, in FIG. 31, "5 V (limited)" is shown in a space of the voltage applied to the auxiliary capacitance line CSL to show the fact that 0 V cannot be employed as the voltage applied to the auxiliary capacitance line CSL.

(Fourth Type)

The fourth type pixel circuit 2E (FIGS. 13 to 16) is similar to the first type pixel circuit 2B in that the voltage supply line VSL is an independent signal line, while it is different in that the transistor T4 is shared by the first switch circuit 22 and the second switch circuit 23.

Referring to the timing chart of the first type shown in FIG. 27, it is seen that the first switch circuit 22 is on during the times t4 to t5, and the second switch circuit 23 is on during the times t6 to t7. That is, it is necessary to turn on the first switch circuit 22 in order to refresh the internal node N1 to the second voltage state by applying the voltage (0 V) of the second voltage state thereto from the source line SL in the step #4, and it is necessary to turn on the second switch circuit 23 in order to refresh the internal node N1 of the case H to the first voltage state by applying the voltage (5 V) of the first voltage state thereto from the voltage supply line VSL in the step #5. Therefore, in the case of the fourth type pixel circuit 2E, the transistor T4 is to be kept on during at least the times t4 to t5, and times t6 to t7 compared with the timing chart in FIG. 27.

Figure 32:
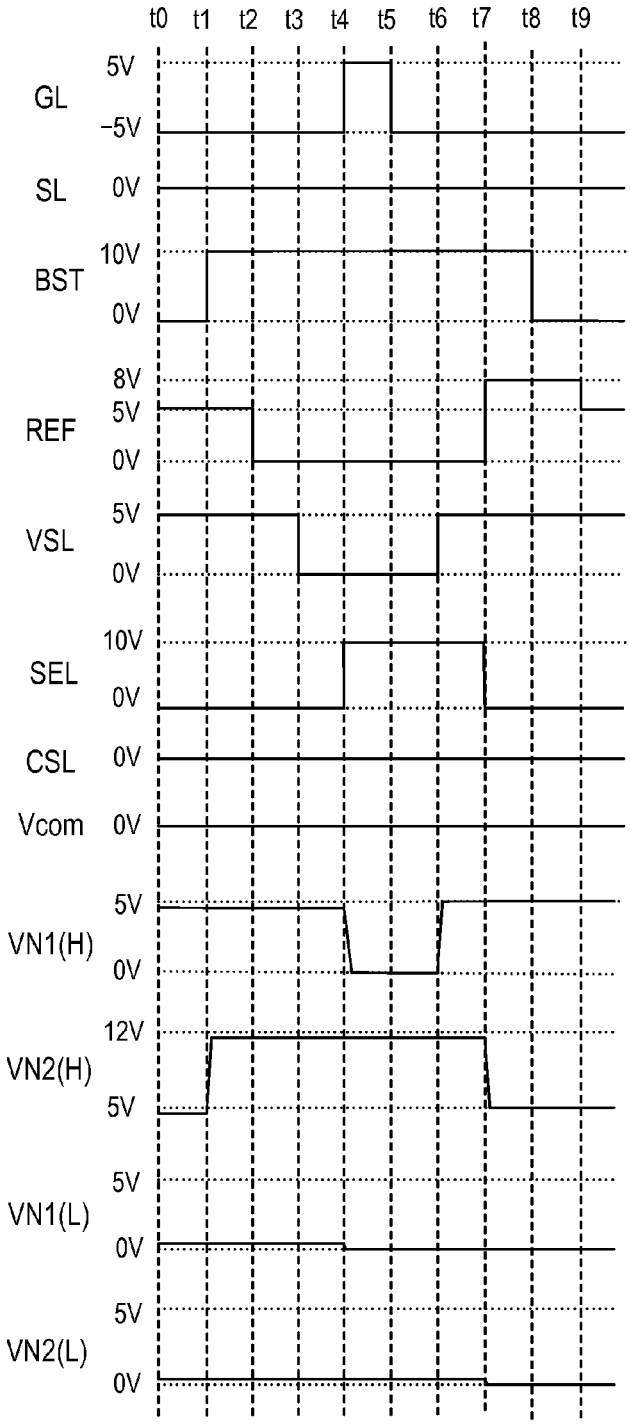
FIG. 32 shows one example of a timing chart of a self refreshing action in the fourth type pixel circuit of the group X.

Based on this, FIG. 32 shows a timing chart of the fourth type pixel circuit 2E. In FIG. 32, the transistor T4 is on during the times t4 to t7 by applying the high level voltage to the selection line SEL.

In addition, in the case where the voltage is applied to the voltage supply line VSL similarly to that in FIG. 32, the high level voltage may be applied to the selection line SEL during the period of the self refreshing action as shown in FIG. 26.

(Fifth Type)

The fifth type pixel circuit 2F (FIGS. 17 to 19) is similar to the second type pixel circuit 2C in that the voltage supply line VSL also serves as the source line SL, while it is different in that the transistor T4 is shared by the first switch circuit 22 and the second switch circuit 23.

Figure 33:
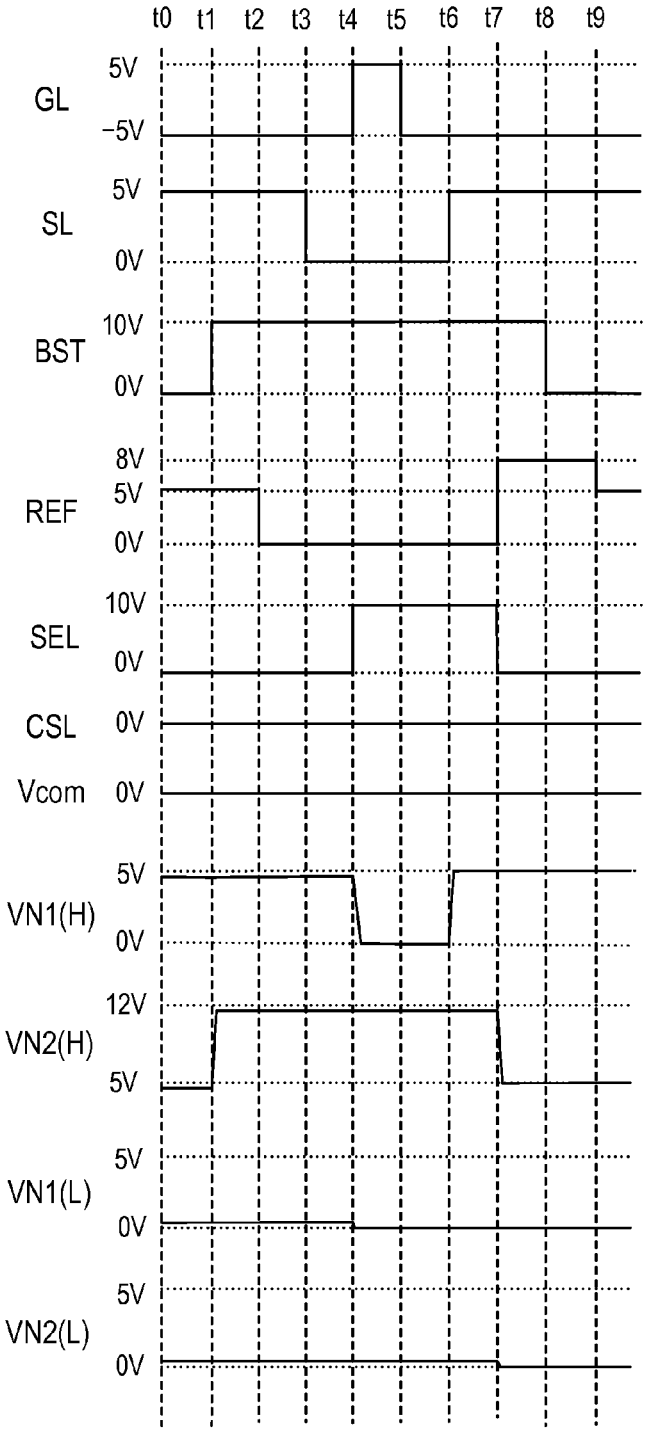
FIG. 33 shows one example of a timing chart of a self refreshing action in the fifth type pixel circuit of the group X.

Referring to the second type timing chart shown in FIG. 29, similar to the first type, it is seen that the first switch circuit 22 is on during the times t4 to t5, and the second switch circuit 23 is on during the times t6 to t7. Therefore, for the same reason as that of the fourth type, the transistor T4 is to be on during at least the times t4 to t5 and the times t6 to t7. FIG. 33 shows one example of a timing chart of the fifth type.

<3. Group Y>

Next, a description will be given of the self refreshing action for the pixel circuit belonging to the group Y with respect to each type.

According to each type pixel circuit of the group Y, the control terminal of the transistor T4 is connected to the boost line BST, and the selection line SEL is eliminated, compared with the same type pixel circuit of the group X. Here, referring to the timing chart of the each type pixel circuit of the group X, it can be seen that the high level voltage is applied to the boost line BST during at least the times t1 to t7. Therefore, based on this, the transistor T4 is forcibly kept on during this period in each configuration of the group Y.

(First Type)

Figure 34:
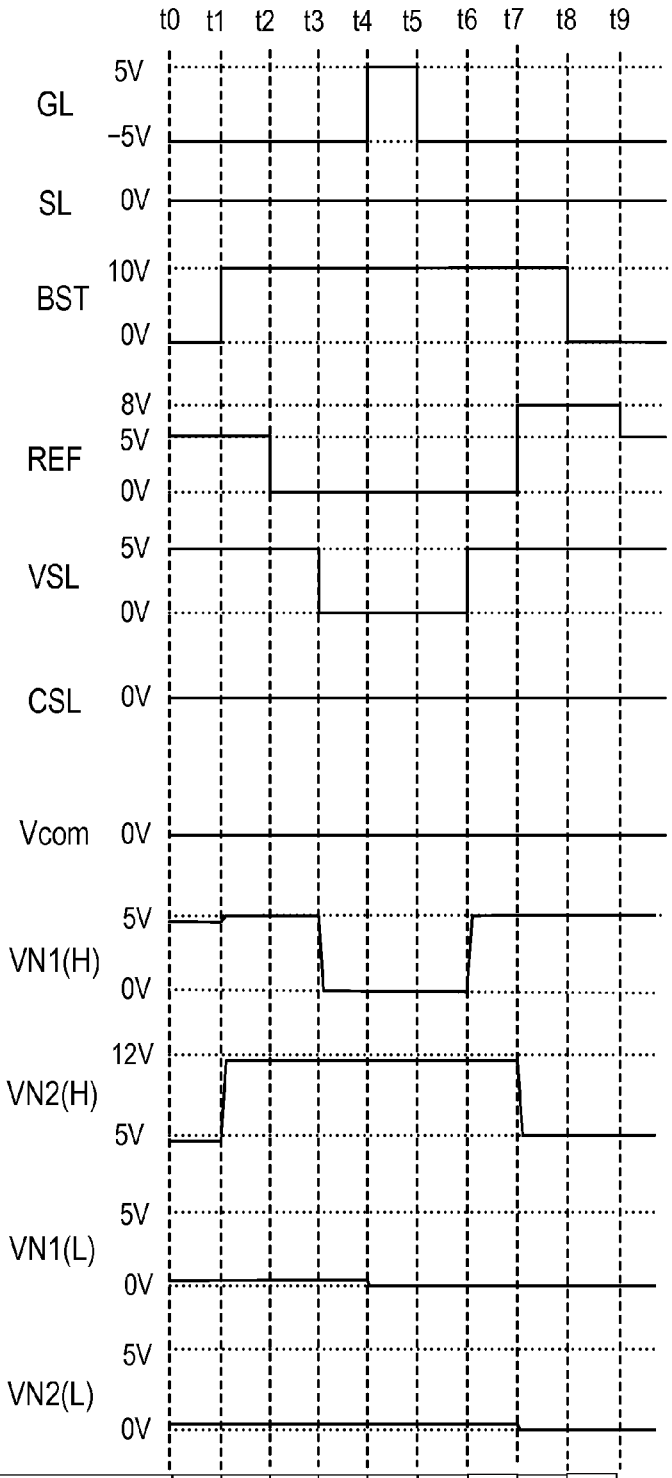
FIG. 34 shows a timing chart of a self refreshing action in the first type and the fourth type pixel circuits of the group Y.

As shown in FIG. 26, according to the first type pixel circuit 2B of the group X, the self refreshing action is executed even when the high level voltage is applied to the selection line SEL during the period of the self refreshing action. Therefore, it is seen that the self refreshing action can be executed in the first type pixel circuit 2*b* (FIG. 20) of the group Y by applying the voltages to the lines except for the selection line SEL similarly to that in FIG. 26. FIG. 34 shows a timing chart in this case.

(Second Type)

Figure 35:
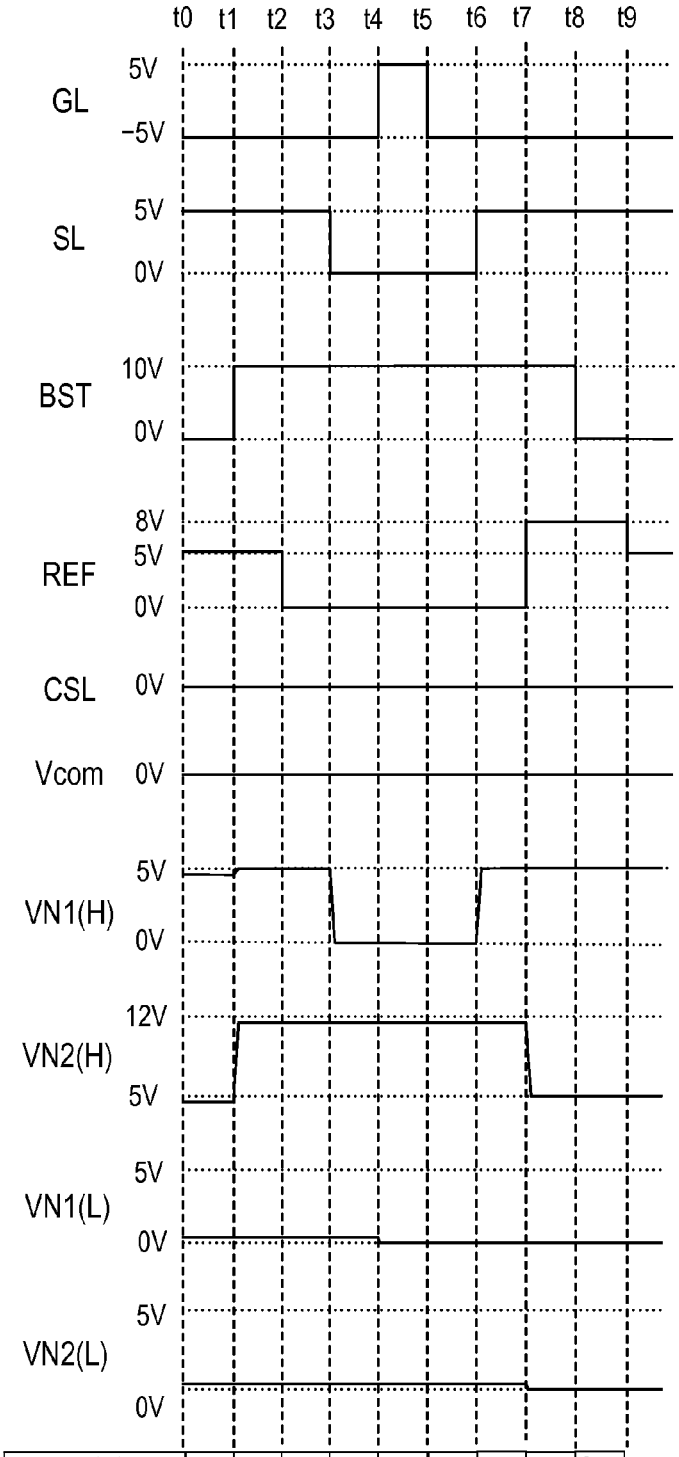
FIG. 35 shows a timing chart of a self refreshing action in the second type and the fifth type pixel circuits of the group Y.

According to the pixel circuit 2*c* in FIG. 21, the same voltage application state as that in FIG. 34 can be provided by setting the voltage applied to the source line SL similarly to that applied to the voltage supply line VSL shown in FIG. 34. FIG. 35 shows a timing chart in this case.

(Fourth Type)

According to the fourth type pixel circuit (FIG. 22) of the group Y, it is seen that the same voltage state as that of the first type pixel circuit (FIG. 20) can be provided by applying the voltages similarly to the timing chart shown in FIG. 34. That is, the self refreshing action can be executed by the same voltage application way as that shown in FIG. 34.

(Fifth Type)

According to the fifth type pixel circuit (FIG. 23) of the group Y, it is seen that the same voltage state as that of the second type pixel circuit (FIG. 21) can be provided by applying the voltages similarly to the timing chart shown in FIG. 35. That is, the self refreshing action can be executed by the same voltage application way as that shown in FIG. 35.

<4. Other Examples>

Hereinafter, other examples related to the self refreshing action are collectively described.

Figure 25:
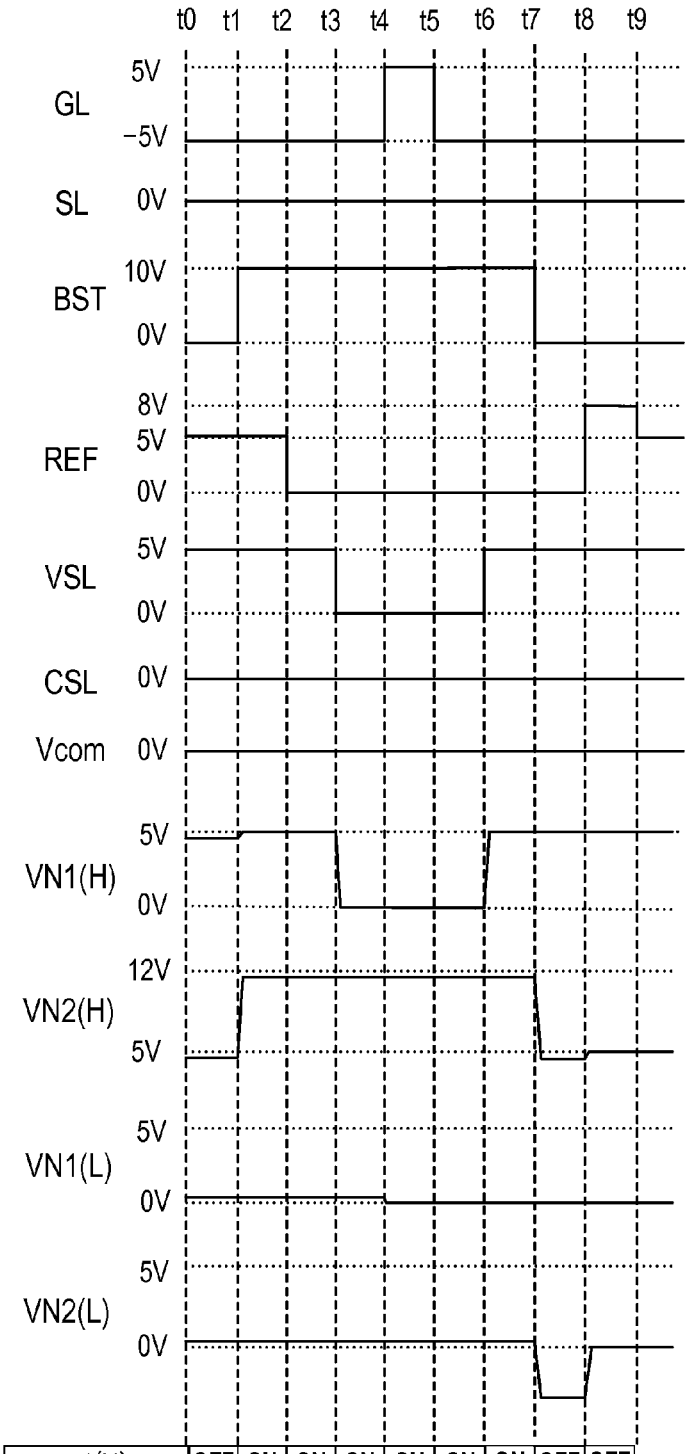
FIG. 25 shows another example of a timing chart of the self refreshing action in the pixel circuit of the group W.

<1> When the self refreshing action is executed for the pixel circuit 2A of the group W, 0 V is also applied to the voltage supply line VSL similarly to the source line SL, in the step #4 in which the voltage of 0 V is supplied from the source line SL to the internal node N1 (times t4 to t5) in FIGS. 24 and 25.

Figure 36:
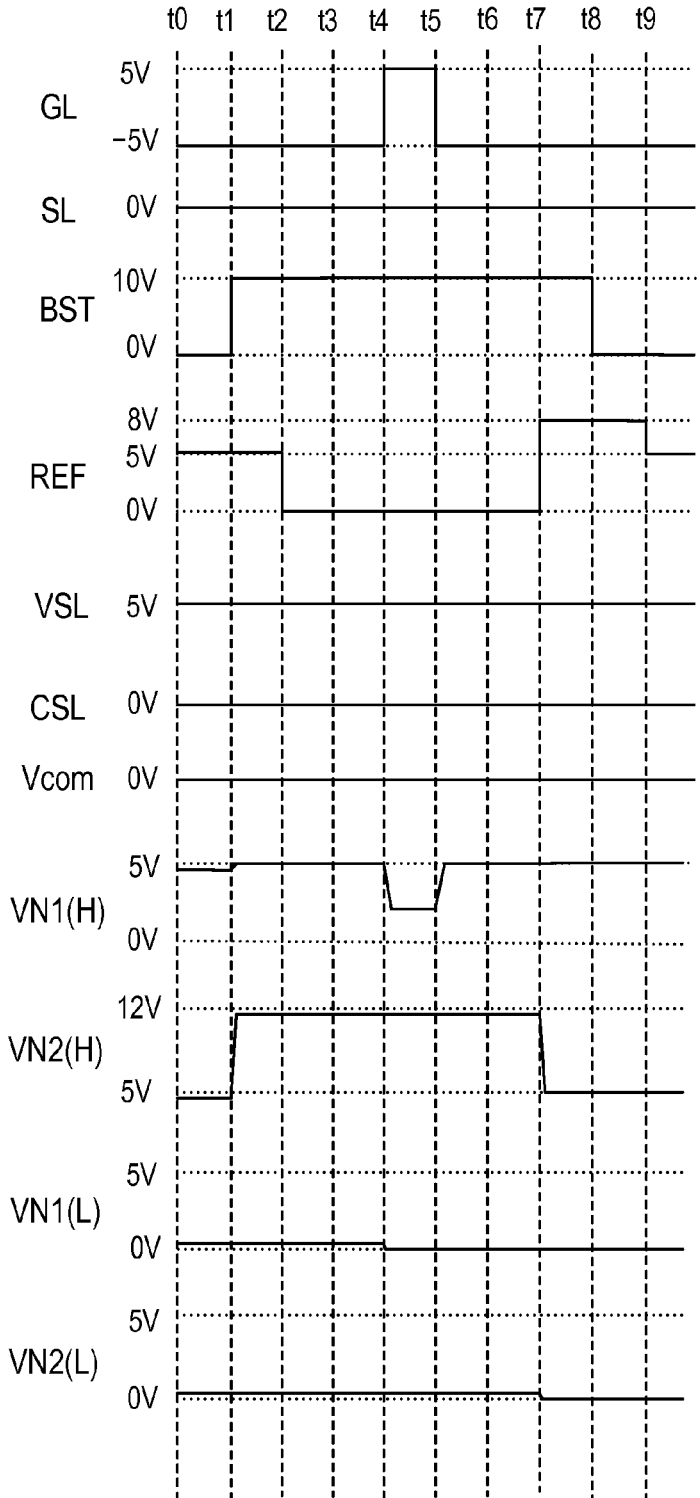
FIG. 36 shows another example of timing chart of a self refreshing action in the pixel circuit of the group W.

Meanwhile, as shown in FIG. 36, a method in which the first voltage state (5 V) is applied to the voltage supply line VSL in the step #4 can be theoretically assumed. In this method, the transistor T1 is off in the case L, so that even when 5 V is applied to the voltage supply line VSL, this voltage is not applied to the internal node N1 through the second switch circuit 23.

Meanwhile, in the case H, the transistor T1 is on, so that a current path is formed from the voltage supply line VSL to which 5 V is applied, to the source line SL to which 0 V is applied, through the internal node N1 during the times t4 to t5. Thus, the potential of the internal node N1 shows a middle value between 0 V and 5 V (refer to VN1 (H) during the times t4 to t5 in FIG. 36).

However, after that, when the voltage applied to the gate line GL is reduced and the transistor T3 is turned off at the time t5, 5 V is applied from the voltage supply line VSL to the internal node N1 through the second switch circuit 23 in the case H, so that it is refreshed to the first voltage state.

That is, by this method also, the refreshing action can be executed in each case of H and L. However, as described above, during the times t4 to t5, the current path is formed from the voltage supply line VSL to the source line SL in the pixel circuit in the case H, so that a power consumption amount is increased compared with the voltage application method shown in FIGS. 24 and 25. With a view to suppressing the power consumption amount, the voltage application method shown in FIGS. 24 and 25 is more preferable. Thus, this means that 0 V only has to be applied to the voltage supply line VSL during at least the times t4 to t5. That is, the voltage applied to the voltage supply line VSL may be reduced to 0 V at the same time as the rising timing of the voltage applied to the gate line GL, and the voltage applied to the voltage supply line VSL may be increased to 5 V at the same time as the reducing timing of the voltage applied to the gate line GL.

As shown in FIGS. 24 and 25, while 0 V is applied to the voltage supply line VSL, the potential of the node N1 (H) is also reduced to 0 V, and then refreshed to 5 V. The node N1 (H) is the node in the circuit which is written at the high level (first voltage state) originally, so that as a period while the node is 0 V becomes long, a flicker could be generated. Therefore, it is preferable to shorten the period while the node N1 (H) is 0 V. In this viewpoint also, it is preferable that the period in which the node N1 (H) is 0 V is limited to the times t4 to t5 by setting the times t3 to t4 and the times t5 to t6 as short as possible, or bringing them to nearly zero. Thus, the self refreshing action can be performed while the flicker is prevented from being generated.

<2> As shown in the timing chart of another example shown in FIG. 36, the voltage applied to the voltage supply line VSL is fixed to 5 V throughout the period of the self refreshing action. Therefore, even when the voltage supply line VSL also serves as the auxiliary capacitance line CSL, and the voltage applied to the auxiliary capacitance line CSL is fixed to 5 V, the same voltage application state as that shown in FIG. 36 can be provided. That is, in the group W also, the pixel circuit of the type (third type) in which the voltage supply line VSL also serves as the auxiliary capacitance line CSL can be theoretically realized. However, as described in the other example <1>, with a view to suppressing the power consumption amount, the first or second type pixel circuit is preferable in the group W.

<3> In the other examples <1> and <2> described above, the description has been given of the case where the current path is formed from the voltage supply line VSL to the source line SL in the case H in refreshing the internal node N1 to the second voltage state. The other pixel type may also employ the voltage application method in which such current path is formed.

Figure 37:
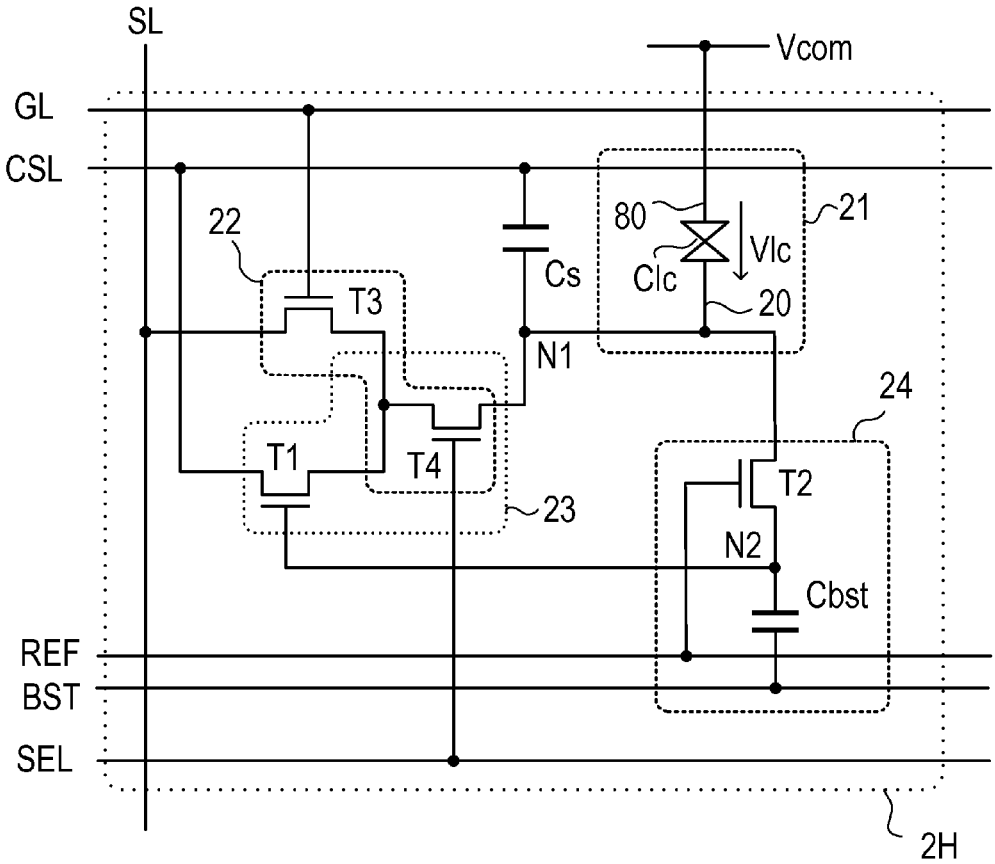
FIG. 37 shows a pixel circuit in another example of the group X.
Figure 38:
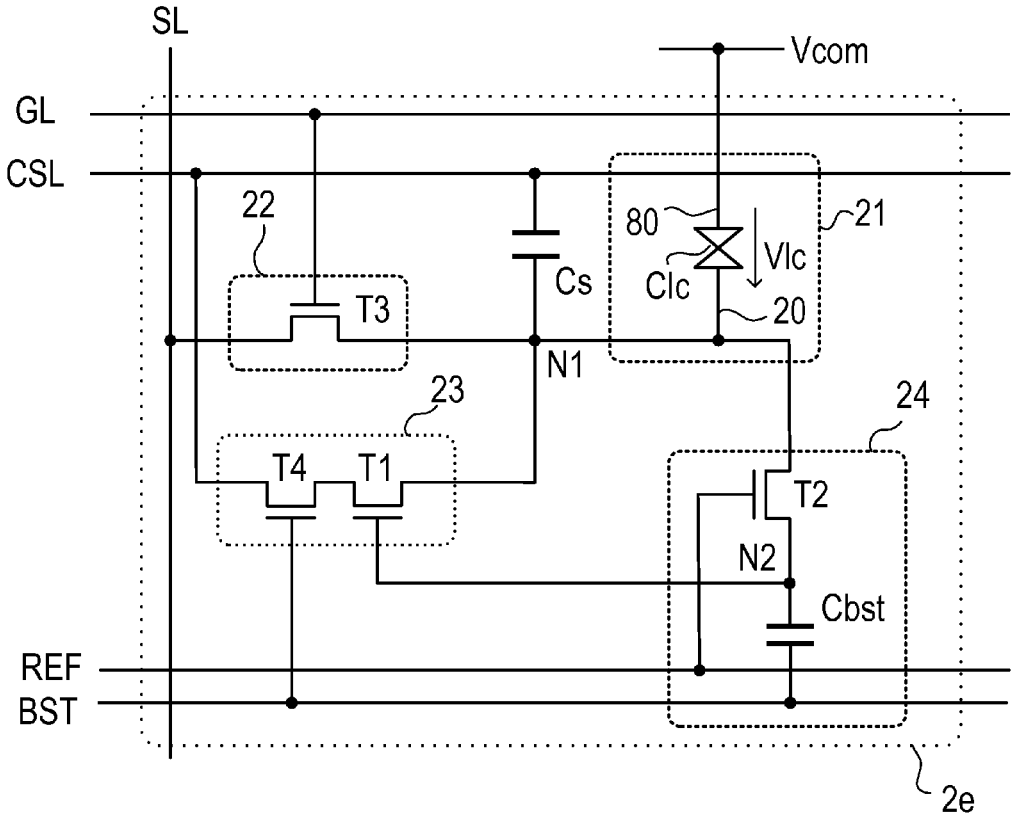
FIG. 38 shows a pixel circuit in another example of the group Y.
Figure 39:
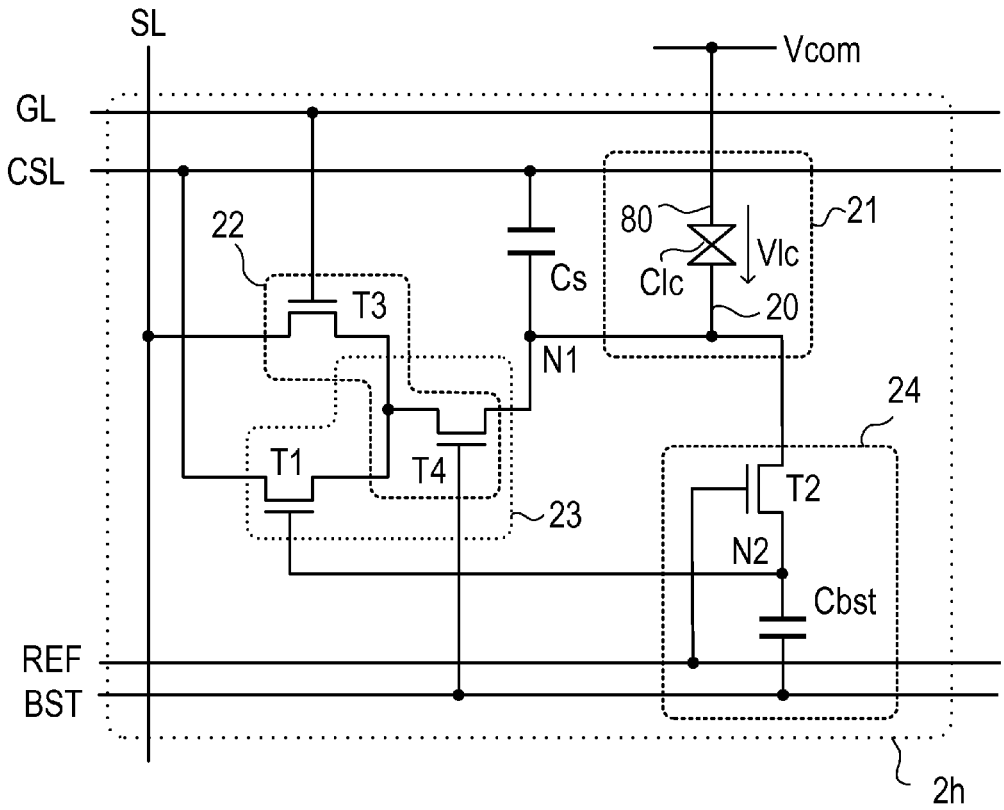
FIG. 39 shows a pixel circuit in another example of the group Y.

For example, the fourth type pixel circuit 2E (FIG. 13) of the group X may employ the method in which the voltage (5 V) of the first voltage state is applied to the voltage supply line VSL during the period of the self refreshing action. In addition, when a pixel circuit 2H in which the transistor T4 is shared by the first switch circuit 22 and the second switch circuit 23 is applied to the third type pixel circuit 2D of the group X shown in FIG. 12 (refer to FIG. 37), the same voltage state is also provided. In addition, when the configuration in which the voltage supply line VSL also serves as the auxiliary capacitance line CSL is applied to the group Y (the pixel circuit 2*e* in FIG. 38, and a pixel circuit 2*h* in FIG. 39), the same voltage state is also provided.

[Third Embodiment]

According to a third embodiment, a description will be given of the writing action in the constant display mode with respect to each type with reference to the drawings.

According to the writing action in the constant display mode, the pixel data for one frame is divided with respect to each display line of the horizontal direction (row direction), and a binary voltage corresponding to each of the pixel data for the one display line, that is, the high level voltage (5 V) or the low level voltage (0 V) is applied to the source line SL in each column with respect to each horizontal period. Thus, a selected row voltage 8 V is applied to the gate line GL of the selected display line (selected row) to turn on the first switch circuits 22 of all the pixel circuits 2 belonging to the selected row, and the voltage of the source line SL in each column is transferred to the internal node N1 of each pixel circuit 2 in the selected row.

In addition, an unselected row voltage of −5 V is applied to the gate line GL (unselected row) except for the selected display line to turn off the first switch circuits 22 of all the pixel circuits 2 in the unselected row. In addition, the timing control of the voltage applied to each signal line in the writing action as will be described below is performed by the display control circuit 11, and individual voltage application is performed by the display control circuit 11, the opposite electrode drive circuit 12, the source driver 13, and the gate driver 14.

<1. Group W>

First, a description will be given of the writing action in the constant display mode for the pixel circuit of the group W (FIG. 7), in which the second switch circuit 23 is composed of the transistor T1 only.

Figure 40:
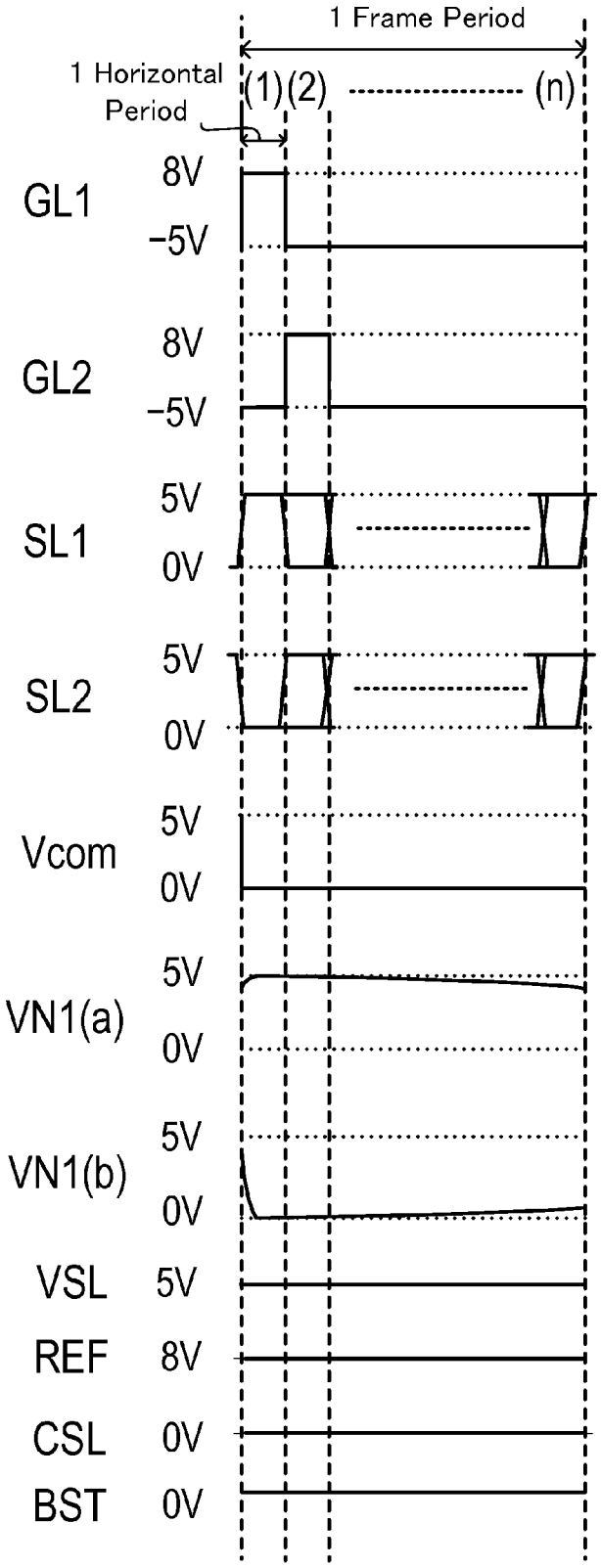
FIG. 40 shows a timing chart of a writing action in a constant display mode in the pixel circuit of the group W.

FIG. 40 shows a timing chart of the writing action using the first type pixel circuit 2A (FIG. 7). FIG. 40 illustrates voltage waveforms of the two gate lines GL1 and GL2, the two source lines SL1 and SL2, the voltage supply line VSL, the reference line REF, the auxiliary capacitance line CSL, and the boost line BST, and a voltage waveform of the opposite voltage Vcom for the one frame period. In addition, FIG. 40 also illustrates fluctuation waveforms of the potentials VN1 of the internal nodes N1 of the two pixel circuits 2A. One of the two pixel circuits 2A is a pixel circuit 2A (a) selected by the gate line GL1 and the source line SL1, and the other is a pixel circuit 2A (b) selected by the gate line GL1 and the source line SL2. In the drawing, (a) and (b) are added behind the internal node potentials VN1 to be discriminated.

The one frame period is divided into the horizontal periods whose number corresponds to the number of the gate lines GL, and the gate lines GL1 to GLn each of which are to be selected in each of the horizontal periods are sequentially allocated to them. FIG. 40 illustrates voltage changes of the two gate lines GL1 and GL2 in the first two horizontal periods. In the first horizontal period, the selected row voltage of 8 V is applied to the gate line GL1, and unselected row voltage of −5 V is applied to the gate line GL2, and in the second horizontal period, the selected row voltage of 8 V is applied to the gate line GL2, and the unselected row voltage of −5 V is applied to the gate line GL1. In the following horizontal periods, the unselected row voltage of −5 V is applied to each of the gate lines GL1 and GL2.

The voltage (5 V or 0 V) which corresponds to each of the pixel data of the display line corresponding to each horizontal period is applied to the source line SL in each column. FIG. 40 illustrates the two source lines SL1 and SL2 as representatives of the source lines SL. In addition, according to the example shown in FIG. 40, the voltages of the two source lines SL1 and SL2 for the first horizontal period are set to 5 V and 0 V in order to describe the change of the internal node potential VN1.

According to the pixel circuit 2A, since the first switch circuit 22 is composed of the transistor T3 only, the on/off of the first switch circuit 22 is only controlled by the on/off of the transistor T3. In addition, as for the pixel circuit 2A, the fact that it is necessary to apply the high level voltage to the voltage supply line VSL at the time of the writing action is just as described in the description of the first embodiment.

The voltage applied to the boost line BST is 0 V. In addition, 8 V which is higher than the high level voltage (5 V) by the threshold voltage (about 2 V) is applied to the reference line REF during the one frame period in order to always turn on the transistor T2 regardless of the voltage state of the internal node N1. Thus, the output node N2 and the internal node N1 are electrically connected, and the auxiliary capacitive element Cs connected to the internal node N1 can be used for holding the potential VN1 of the internal node, and contributes to stabilization thereof. In addition, the auxiliary capacitance line CSL is fixed to a predetermined voltage (such as 0 V). While being subjected to the above described opposite AC driving, the opposite voltage Vcom is fixed to 0 V or 5 V during the one frame period. In FIG. 40, the opposite voltage Vcom is fixed to 0 V.

<2. Group X>

A description will be given of the writing action for the pixel circuit of the group X in which the second switch circuit 23 is composed of the series circuit of the transistors T1 and T4, and the control terminal of the transistor T4 is connected to the selection line SEL.

(First Type)

Figure 41:
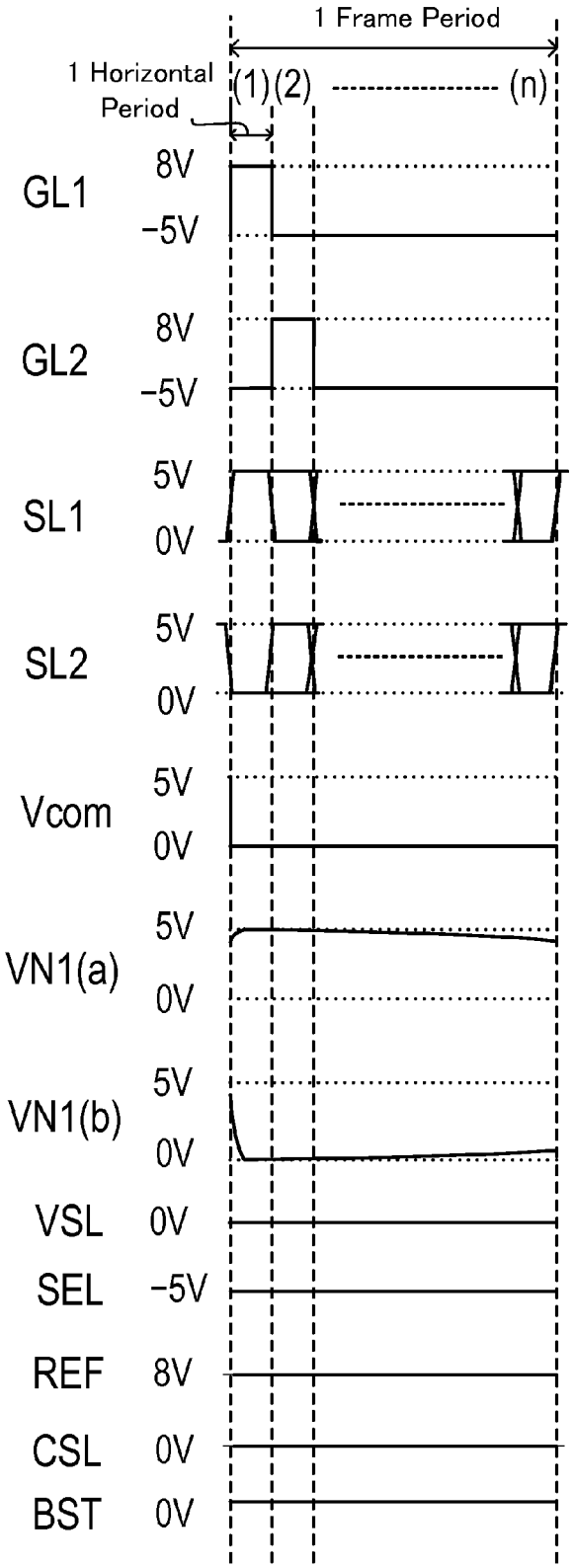
FIG. 41 shows a timing chart of a writing action in the constant display mode in the first type pixel circuit of the group X.

FIG. 41 shows a timing chart of the writing action using the first type pixel circuit 2B (FIGS. 8 to 10). Unlike the group W, the pixel circuit of the group X includes the transistor T4 in the second switch circuit 23. Since it is not necessary to turn on the second switch circuit 23 at the time of the writing action, the transistor T4 is turned off by applying the low level voltage to the selection line SEL. Here, −5 V is applied.

In this case, since the second switch circuit 23 is turned off at the time of the writing action, the voltage applied to the voltage supply line VSL can be set to 0 V unlike the group W. A description for the rest of it is the same as the description for the group W, so that it is omitted.

(Second and Third Types)

According to the timing chart of the writing action in the first type pixel circuit 2B shown in FIG. 41, the low level voltage is always applied to the selection line SEL throughout the one frame period. That is, the second switch circuit 23 is always off.

Therefore, as for the second type pixel circuit 2C in which the one end of the second switch circuits 23 are connected to the source line SL, and the third type pixel circuit 2D in which the one end of the second switch circuits 23 are connected to the auxiliary capacitance line CSL, the writing action can be also performed by applying the voltages to the lines except for the voltage supply line VSL similarly to the timing chart for the first type.

(Fourth Type)

According to the fourth type pixel circuit 2E shown in FIGS. 13 to 16, since the first switch circuit 22 is composed of the series circuit of the transistor T3 and the transistor T4, it is necessary to turn on not only the transistor T3 but also the transistor T4 at the time of the writing action. In this respect, its sequence is different from those of the first to third types.

Figure 42:
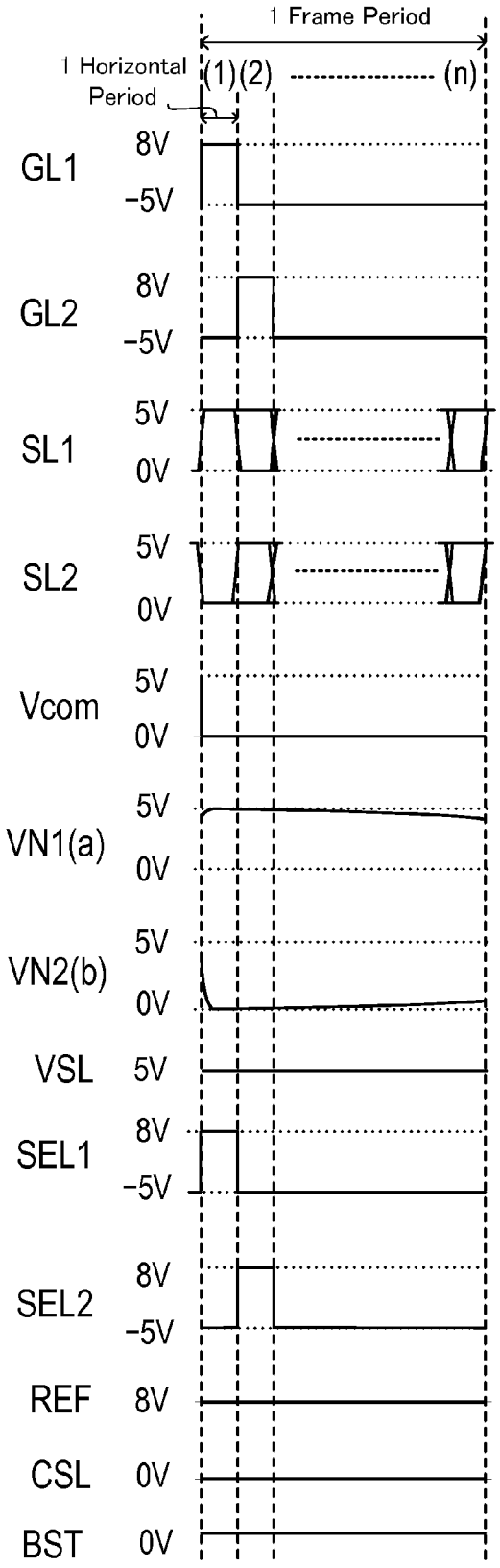
FIG. 42 shows a timing chart of a writing action in the constant display mode in the fourth type pixel circuit of the group X.

FIG. 42 shows a timing chart of the writing action when the fifth type pixel circuit 2D is used. FIG. 42 shows the same items as those shown in FIG. 41 except that the two selection lines SEL1 and SEL2 are shown.

Voltage application timing and voltage amplitudes of the gate line GL (GL1 and GL2), and the source line SL (SL1 and SL2) are totally the same as those in FIG. 41.

Since the first switch circuit 22 is composed of the series circuit of the transistor T3 and the transistor T4 in the pixel circuit 2E, the on/off of the first switch circuit 22 has to be controlled by the on/off of the transistor T4 in addition to the on/off of the transistor T3. Therefore, according to this type, all the selection lines SEL are not collectively controlled but need to be controlled separately with respect to each row, similar to the gate lines GL. That is, the selection line SEL is provided with respect to each row, and its number is the same as the number of the gate lines GL1 to GLn, so that they are sequentially selected similar to the gate lines GL1 to GLn.

FIG. 42 shows voltage changes of the two selection lines SEL1 and SEL2 in the first two horizontal periods. In the first horizontal period, a selecting voltage of 8 V is applied to the selection line SEL1, and a non-selecting voltage of −5 V is applied to the selection line SEL2, and in the second horizontal period, the selecting voltage of 8 V is applied to the selection line SEL2, and the non-selecting voltage of −5 V is applied to the selection line SEL1. Then, in the following horizontal periods, the non-selecting voltage of −5 V is applied to each of the selection lines SEL1 and SEL2.

The voltages applied to the reference line REF, the auxiliary capacitance line CSL, and the boost line BST, and the opposite voltage Vcom are the same as those of the first type shown in FIG. 41. In addition, in the unselected row, when the first switch circuit 22 is put into the off state, the non-selecting voltage applied to the selection line SEL to turn off the transistor T4 may be 0 V instead of −5 V because the transistor T3 is completely in the off state.

In addition, in the case of this type pixel circuit, similar to the case of the group W shown in FIG. 40, it is preferably to apply 5 V to the voltage supply line VSL. This is because of the following reason.

When the low level voltage is applied to the voltage supply line VSL under the condition that the node is written at the high level, the transistor T1 is turned on. In this case, when there is a difference in the applied voltage between the source line SL connected to the one end of the first switch circuit 22 and the voltage supply line VSL connected to the one end of the second switch circuit 23 which are turned on at the same time, during the writing action, a current path is formed between the source line SL and the voltage supply line VSL, and the voltage of the node positioned therebetween fluctuates, and as a result, the voltage corresponding to the written data could not be correctly written in the internal node N1.

Meanwhile, by applying 5 V (first voltage state) to the voltage supply line VSL, the diode-connected transistor T1 is put into a reversely-biased state (off state), so that the second switch circuit 23 in the selected row can be put into the off state. Thus, the voltage applied to the voltage supply line VSL does not affect the voltage to be written.

(Fifth Type)

According to the fifth type pixel circuit 2F shown in FIGS. 17 to 19, similar to the fourth type, the selection lines SEL have to be controlled separately with respect to each row without being collectively controlled, similarly to the gate lines GL. That is, the selection line SEL is provided in each row, and its number is the same as the number of the gate lines GL1 to GLn, so that they are sequentially selected similar to the gate lines GL1 to GLn.

In addition, in this configuration of this type, since the second switch circuit 23 and the first switch circuit 22 are connected to the source line SL, the potential VN1 of the internal node does not fluctuate even when the transistor T4 is turned on at the time of the writing action, so that a treatment for that is not needed in particular. Thus, the writing action can be executed by applying the voltages to the lines except for the voltage supply line VSL similarly to that shown in FIG. 42.

<3. Group Y>

A description will be given of the writing action for the pixel circuit of the group Y in which the second switch circuit 23 is composed of the series circuit of the transistors T1 and T4, and the control terminal of the transistor T4 is connected to the boost line BST.

(First and Second Types)

As shown in the timing chart of the writing action for the first type pixel circuit 2B of the group X shown in FIG. 41, the low level voltage is always applied to the selection line SEL for the one frame period. That is, the second switch circuit 23 is always off, and the voltage applied to the one end of the boost capacitive element Cbst is not changed. In this respect, the same is true in the second type.

Therefore, as for the first and second type pixel circuits 2*b* and 2*c* of the group Y, the writing action can be executed by applying the voltages to the signal lines except for the selection line SEL, similarly to the group X of the same type.

(Fourth and Fifth Types)

As shown in the timing chart of the writing action for the fourth type pixel circuit 2E of the group X shown in FIG. 42, the high level voltage is applied to the selection line SEL to turn on the transistor T4 in the selected row, and the low level voltage is applied thereto to turn off the transistor T4 in the unselected row. Based on this, as for the pixel circuit 2*e* of the group Y (FIG. 22), it is seen that the high level voltage is applied to the boost line BST in the selected row, and the low level voltage is applied to the boost line BST in the unselected row.

Meanwhile, as for the fourth type pixel circuit 2*e* of the group Y (FIG. 22), when the high level voltage is applied to the boost line BST, the voltage applied to the one end of the boost capacitive element Cbst is accordingly increased. However, at the writing action, the high level voltage (8 V) is applied to the reference line REF, so that the transistor T2 is in the on state. Since the node N1 having large parasitic capacitance is electrically connected to the node N2, the potential of the output node N2 is hardly increased. That is, even when the high level voltage is applied to the boost line BST, it is not necessary to consider an effect on the output node N2.

Based on the above, when the writing action is performed for the fourth and fifth type pixel circuits 2*e* and 2*f* of the group Y, the voltages may be applied similarly to that of the same type pixel circuit of the group X except that the voltage is applied to the boost line BST similarly to the selection line SEL.

[Fourth Embodiment]

In a fourth embodiment, a description will be given of a relationship between the self refreshing action and the writing action in the constant display mode.

In the constant display mode, after the writing action has been executed for the image data for the one frame, the writing action is not performed for a certain period and the display contents provided by the last writing action are maintained.

In the writing action, the voltage is applied to the pixel electrode 20 in the pixel through the source line SL. Then, the gate line GL reaches the low level, and the transistor T3 is turned off. However, the potential of the pixel electrode 20 is maintained due to the presence of the electric charges accumulated in the pixel electrode 20 by the last writing action. That is, the voltage Vlc is maintained between the pixel electrode 20 and the opposite electrode 80. Thus, after the completion of the writing action, the voltage to display the image data is kept applied between both ends of the liquid crystal capacitance Clc.

In the case where the potential of the opposite electrode 80 is fixed, the liquid crystal voltage Vlc depends on the potential of the pixel electrode 20. This potential fluctuates with time due to the generation of the leak current of the transistor in the pixel circuit 2. For example, in the case where the potential of the source line SL is lower than the potential of the internal node N1, the leak current generates from the internal node N1 to the source line SL, and the potential VN1 of the internal node N1 is gradually decreased with time. On the other hand, in the case where the potential of the source line SL is higher than the potential of the internal node N1, the leak current is generated from the source line SL to the internal node N1, and the potential of the pixel electrode 20 is increased with time. That is, after the time has elapsed without externally executing the writing action, the liquid crystal voltage Vlc is gradually changed, and as a result, a display image is also changed.

In the normal display mode, the writing action is executed for all the pixel circuits 2 with respect to each frame even when the image is the still image. Therefore, the electric charge amount accumulated in the pixel electrode 20 only needs to be held for the one frame period. Since the potential fluctuation amount of the pixel electrode 20 for the one frame period is very small, the potential fluctuation in this period does not affect the displayed image data to such a degree that it can be visually recognized. Therefore, in the normal display mode, the potential fluctuation of the pixel electrode 20 can be ignored.

Meanwhile, in the constant display mode, the writing action is not executed with respect to each frame. Therefore, while the potential of the opposite electrode 80 is fixed, it is necessary to hold the potential of the pixel electrode 20 (internal node potential VN1) over the several frames in some cases. However, when left over the several frames without execution of the writing action, the potential of the pixel electrode 20 fluctuates intermittently due to the above-described generation of the leak current. As a result, the displayed image data could be changed to a degree that it can be visually recognized.

Figure 43:
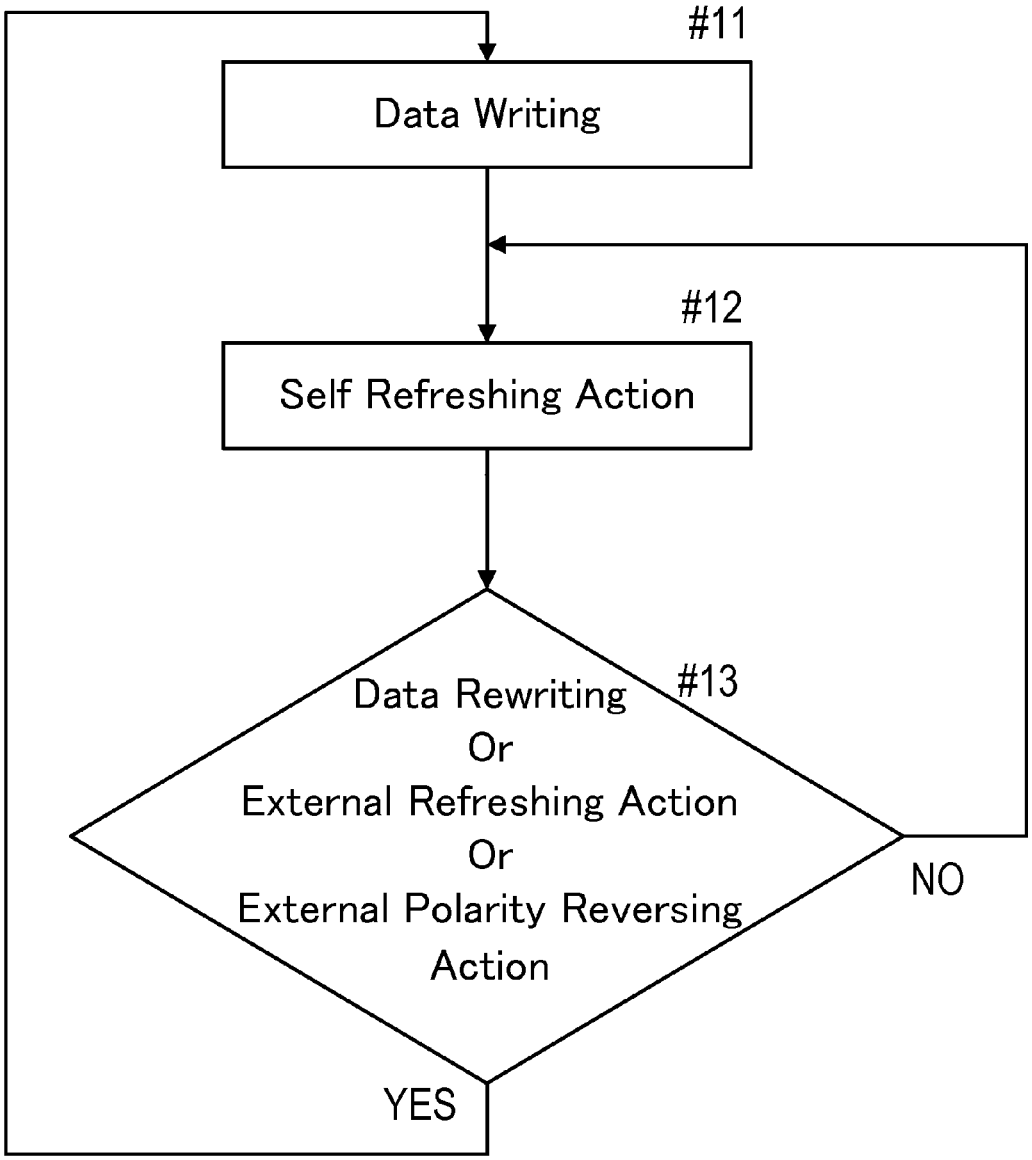
FIG. 43 shows a flowchart showing an execution procedure of the writing action and the self refreshing action in the constant display mode.

In order to prevent this phenomenon from being generated, the self refreshing action and the writing action are combined and executed in a manner shown in a flowchart in FIG. 43 in the constant display mode, so that power consumption is considerably cut, while the potential of the pixel electrode is prevented from fluctuating.

First, the writing action of the pixel data for the one frame in the constant display mode is executed in the manner described in the third embodiment (step #11).

After the writing action in the step #11, the self refreshing action is executed in the manner described in the second embodiment (step #12).

After the self refreshing action, when a request for the writing action of new pixel data (data rewriting), the external refreshing action, or the external polarity reversing action is received during the standby period before the self refreshing action is executed again (YES in a step #13), the process returns to the step #11, and the writing action of the new pixel data or the previous pixel data is executed. When the above request is not received (NO in step #13), the process returns to the step #12, and the self refreshing action is executed again. Thus, the display image can be prevented from being changed due to the effect of the leak current.

When the refreshing action is performed by the writing action without execution of the self refreshing action, the power consumption is as expressed by the relational expression shown in the above formula 1, but in a case where the self refreshing action is repeated at the same refreshing rate, the number of times the voltage is applied to all of the source lines is only one, and a variable number m in the formula 1 is 1, so that when VGA is assumed as display resolution (pixel number), the number is such that m=1920, and n=480, and as a result, power consumption can be expected to be cut to about one 1920th.

The reason why the self refreshing action and the external refreshing action or the external polarity reversing action are combined in this embodiment is to deal with a case where a defect is generated in the second switch circuit 23 or the control circuit 24 due to a deterioration with age even when the pixel circuit 2 normally operates at first, and a state in which the writing action can be performed without any problem but the self refreshing action cannot be normally executed is generated in some pixel circuits 2. That is, when only the self refreshing action is used, a display deterioration is caused in the some pixel circuits 2, and it is fixed, but by combining the self refreshing action with the external polarity reversing action, the display deterioration can be prevented from being fixed.

[Fifth Embodiment]

In a fifth embodiment, a description will be given of the writing action in the normal display mode, with reference to the drawing with respect to each type.

According to the writing action in the normal display mode, the pixel data for the one frame is divided with respect to each display line in the horizontal direction (row direction), a multi-gradation analog voltage corresponding to each of the pixel data for the one display line is applied to the source line SL of each column with respect to each horizontal period, and the selected row voltage of 8 V is applied to the gate line GL of the selected display line (selected row) to turn on the first switch circuits 22 of all the pixel circuits 2 in the selected row and transfer the voltage of the source line SL of each column to the internal node N1 of each pixel circuit 2 in the selected row. The unselected row voltage of −5 V is applied to the gate line GL (unselected row) except for the selected display line to turn off the first switch circuits 22 of all the pixel circuits 2 in the unselected row.

Timing control of the voltage applied to each signal line in the writing action as will be described below is performed by the display control circuit 11, and individual voltage application is performed by the display control circuit 11, the opposite electrode drive circuit 12, the source driver 13, and the gate driver 14.

Figure 44:
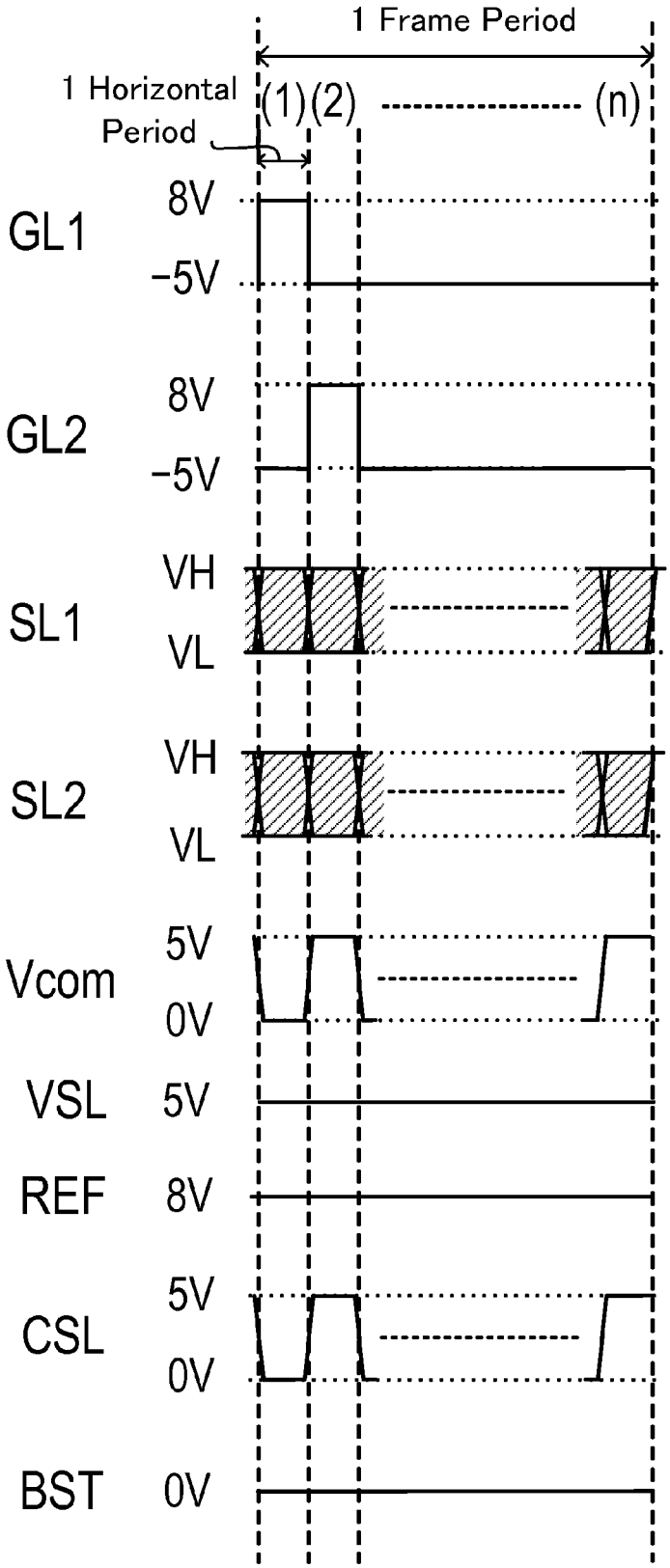
FIG. 44 shows a timing chart of a writing action in a normal display mode in the pixel circuit of the group W.

FIG. 44 shows a timing chart of the writing action using the pixel circuit 2A of the group W. FIG. 44 illustrates voltage waveforms of the two gate lines GL1 and GL2, the two source lines SL1 and SL2, the selection line SEL, the reference line REF, the auxiliary capacitance line CSL, and the boost line BST, and a voltage waveform of the opposite voltage Vcom for one frame period.

The one frame period is divided into the horizontal periods whose number corresponds to the number of the gate lines GL, and the gate lines GL1 to GLn each of which are to be selected in each of the horizontal periods are sequentially allocated to them. FIG. 44 illustrates voltage changes of the two gate lines GL1 and GL2 in the first two horizontal periods. In the first horizontal period, the selected row voltage of 8 V is applied to the gate line GL1, and unselected row voltage of −5 V is applied to the gate line GL2, and in the second horizontal period, the selected row voltage of 8 V is applied to the gate line GL2, and the unselected row voltage of −5 V is applied to the gate line GL1. In the following horizontal periods, the unselected row voltage of −5 V is applied to each of the gate lines GL1 and GL2.

The multi-gradation analog voltage corresponding to each of the pixel data of the display line corresponding to each horizontal period is applied to the source line SL in each column. In addition, the multi-gradation analog voltage corresponding to each of the pixel data of the analog display line is applied in the normal display mode, and the applied voltage cannot be specified unambiguously, so that slant lines are filled to express the above in FIG. 44. In addition, in FIG. 44, the two source lines SL1 and SL2 are shown as representatives of the source lines SL1, SL2, . . . SLm.

The opposite voltage Vcom is changed with respect to each horizontal period (opposite AC driving), so that the analog voltage shows a voltage value corresponding to the opposite voltage Vcom in the same horizontal period. That is, the analog voltage to be applied to the source line SL is set such that the absolute value of the liquid crystal voltage Vlc given in the formula 2 is not changed but only the polarity is changed, depending on whether the opposite voltage Vcom is 5 V or 0 V.

In addition, during the one frame period, the reference line REF receives the voltage that always turns on the transistor T2 regardless of the voltage state of the internal node N1. This voltage value is to be higher than a maximum value among the voltage values given from the source lines SL as the multi-gradation analog voltages by the threshold voltage of the transistor T2 or more. In FIG. 44, the maximum value is 5 V, and the threshold voltage is 2 V, so that 8 V which is higher than the sum of those is applied.

Since the opposite AC driving is performed for the opposite voltage Vcom with respect to each horizontal period, the auxiliary capacitance line CSL is driven so as to reach the same voltage as the opposite voltage Vcom. The pixel circuit 20 is capacitively coupled with the opposite electrode 80 through the liquid crystal layer, and also capacitively coupled with the auxiliary capacitance line CSL through the auxiliary capacitive element Cs. Therefore, when the voltage of the auxiliary capacitive element C2 is fixed on the side of the auxiliary capacitance line CSL, the change of the opposite voltage Vcom is divided between the auxiliary capacitance line CSL and the auxiliary capacitive element C2, and appears in the pixel circuit 20, so that the liquid crystal voltage Vlc fluctuates in the pixel circuit 2 in the unselected row. Therefore, when all of the auxiliary capacitance lines CSL are driven so as to reach the same voltage as the opposite voltage Vcom, the voltages of the opposite electrode 80 and the pixel electrode 20 are changed in the same voltage direction, so that the liquid crystal voltage Vlc can be prevented from fluctuating in the pixel circuit 2 in the unselected row.

In addition, the voltage applied to the voltage supply line VSL is set at 5 V for the same reason as that of the writing action in the constant display mode, as described in the third embodiment.

The writing action in the normal display mode is only different from that in the constant display mode in that the voltage value written through the source line SL is the analog value. Thus, as for the writing action for the each type pixel circuit of the group X, and the each type pixel circuit of the group Y, the writing action can be executed by the same method as that described in the third embodiment except that the analog voltage corresponding to the data is applied to the source line SL. A detailed description is omitted.

In addition, as a method for reversing the polarity of the display line with respect to each horizontal period, in the writing action in the normal display mode, other than the above "opposite AC driving", there is a method in which a predetermined fixed voltage is applied to the opposite electrode 80 as the opposite voltage Vcom. According to this method, the voltage applied to the pixel electrode 20 alternately becomes a positive voltage and a negative voltage based on the opposite voltage Vcom with respect to each horizontal period.

In this case, there is a method in which the pixel voltage is directly written through the source line SL, and a method in which after the voltage having a voltage range in which the opposite voltage Vcom is center has been written, the voltage is adjusted by the capacitive coupling of the auxiliary capacitive element Cs so as to reach the positive voltage or the negative voltage, based on the opposite voltage Vcom. In this case, the auxiliary capacitance line CSL is not driven so as to reach the same voltage as the opposite voltage Vcom, but driven by pulses separately with respect to each row.

In addition, according to this embodiment, the method to reverse the polarity of each display line with respect to each horizontal period is used in the writing action in the normal display mode because the following inconvenience generated when the polarity is reversed with respect to each frame is to be solved. In addition, the method to solve such inconvenience includes a method to reverse the polarity with respect to each column, and a method to reverse the polarity with respect to each pixel in the row and column directions at the same time.

A case is to be assumed such that a positive liquid crystal voltage Vlc is applied to all pixels in a certain frame F1 and a negative liquid crystal voltage Vlc is applied to all pixels in the next frame F2. Even when the voltage having the same absolute value is applied to the liquid crystal layer 75, a slight difference is generated in some cases in optical transmittance depending on whether it is positive or negative. In a case where a high-quality still image is displayed, this slight difference could generate a fine change in a display manner between the frame F1 and the frame F2. In addition, in a case where a moving image is displayed also, a fine change could be generated in its display manner, in a display region where the same contents should be displayed between the frames. In displaying the high-quality still or moving image, it is considered that even such fine change could be visually recognized.

Thus, since such high-quality still or moving image is displayed in the normal display mode, the above fine change could be visually recognized. In order to avoid this phenomenon, the polarity is reversed with respect to each display line in the same frame in this embodiment. Thus, since the liquid crystal voltages Vlc having different polarities are applied between the display lines in the same frame, the display image data is prevented from being affected by the polarity of the liquid crystal voltage Vlc.

[Other Embodiments]

Hereinafter, other embodiments will be described.

<1> As for the pixel circuit belonging to the group X, the low level voltage may be applied to the reference line REF to turn off the transistor T2 at the time of the writing action in the normal display mode and the constant display mode. In this case, the internal node N1 and the output node N2 are electrically separated, and as a result, the potential of the pixel electrode 20 is not affected by the voltage of the output node N2 before the writing action. Thus, the voltage of the pixel electrode 20 reflects the voltage applied to the source line SL correctly, so that the image data can be displayed without any error.

However, as described above, the total parasitic capacitance of the node N1 is considerably larger than that of the node N2, the potential of the node N2 in an initial state hardly affects the potential of the pixel electrode 20, so that it is also preferable that the transistor T2 is always in the on state.

<2> According to the above embodiment, the second switch circuit 23 and the control circuit 24 are provided in each of all the pixel circuits 2 formed on the active matrix substrate 10. Meanwhile, in a case where there are two kinds of pixel parts such as a transmissive pixel part for a transmissive liquid crystal display, and a reflective pixel part for a reflective liquid crystal display on the active matrix substrate 10, the second switch circuit 23 and the control circuit 24 may be provided only for the pixel circuit of the reflective pixel part, and the second switch circuit 23 and the control circuit 24 may not be provided for the pixel circuit of the transmissive display part.

In this case, the image is displayed in the normal display mode by the transmissive pixel part, and the image is displayed in the constant display mode by the reflective pixel part. In this configuration, the number of elements formed all over the active matrix substrate 10 can be reduced.

<3> According to the above embodiment, the pixel circuit 2 has the auxiliary capacitive element Cs, but the auxiliary capacitive element Cs may not be provided. However, it is preferable to provide the auxiliary capacitive element Cs in order to further stabilize the potential of the internal node N1, and surely stabilize the display image.

Figure 45:
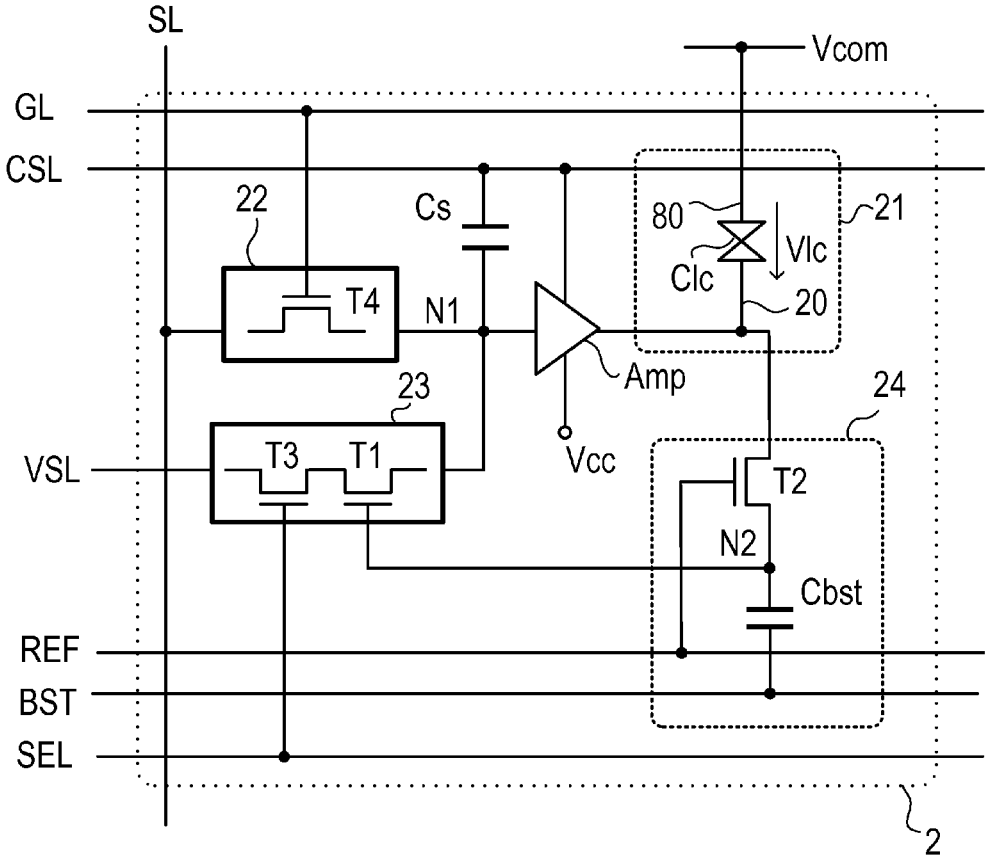
FIG. 45 is a circuit diagram showing still another basic circuit configuration of the pixel circuit according to the present invention.

<4> According to the above embodiment, it is assumed that the display element part 21 of the pixel circuit 2 is only composed of the unit liquid crystal display element Clc, but as shown in FIG. 45, an analog amplifier Amp (voltage amplifier) may be provided between the internal node N1 and the pixel electrode 20. In FIG. 45, as one example, the auxiliary capacitance line CSL and a power supply line Vcc are inputted as power supply lines of the analog amplifier Amp.

In this case, the voltage applied to the internal node N1 is amplified at an amplification factor $\eta$ set by the analog amplifier Amp, and the amplified voltage is supplied to the pixel electrode 20. Thus, a fine voltage change of the internal node N1 can be reflected on the display image. In addition, the pixel circuit of the group X is shown in FIG. 45, but the same can be implemented with respect to the pixel circuits of the groups W and Y as a matter of course.

<5> According to the above embodiment, the voltage values of the first and second voltage states of the voltage VN1 at the internal node N1 and the opposite voltage Vcom in the constant display mode are assumed to be 5 V and 0 V, respectively, and accordingly the voltage values applied to the signal lines are set to −5 V, 0 V, 5 V, 8 V, and 10 V, but these voltage values can be appropriately changed according to the characteristics (such as a threshold voltage) of the liquid crystal element and the transistor element to be used.

<6> According to the above embodiment, the description has been given of the liquid crystal display device, but the present invention is not limited to this, and the present invention can be applied to any display device as long as it has capacitance corresponding to the pixel capacitance Cp for holding the pixel data, and displays an image based on a voltage held in the capacitance.

Figure 46:
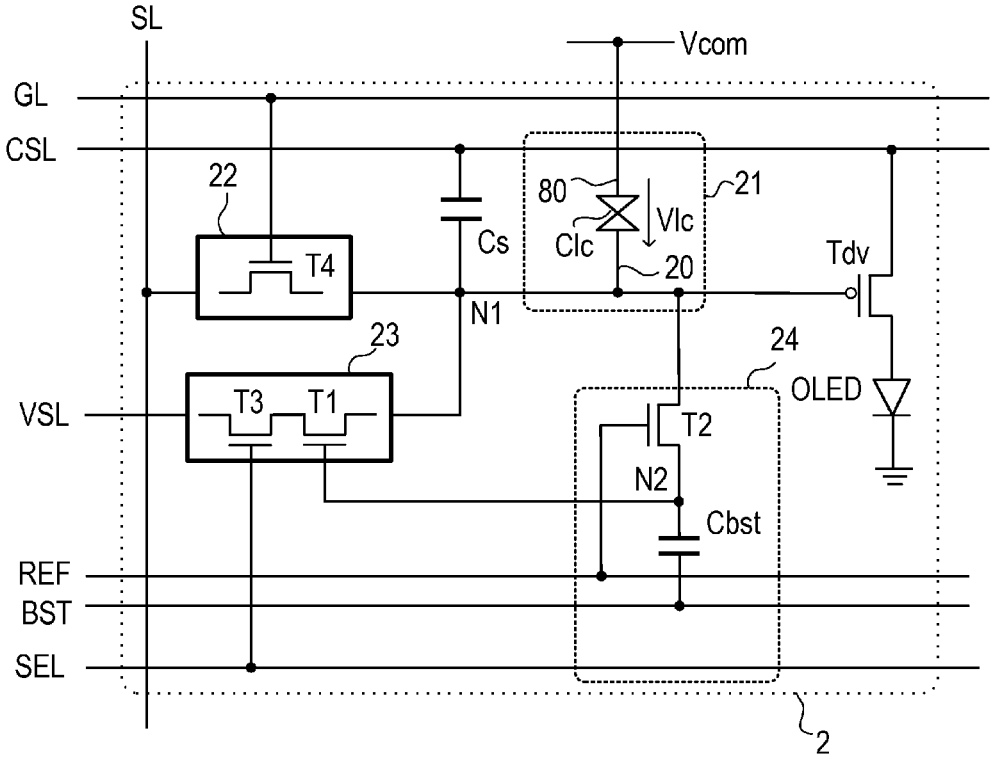
FIG. 46 is a circuit diagram showing still another basic circuit configuration of the pixel circuit according to the present invention.

For example, in a case of an organic EL (Electroluminescence) display device which displays an image with a voltage corresponding to pixel data held in capacitance corresponding to pixel capacitance, the present invention can be applied to the self refreshing action especially. FIG. 46 is a circuit diagram showing one example of a pixel circuit of the organic EL display device. As for this pixel circuit, a voltage held in the auxiliary capacitance Cs as the pixel data is applied to a gate terminal of a driving transistor Tdv composed of a TFT, and a current corresponding to the voltage flows to a light emitting element OLED through the driving transistor Tdv. Therefore, the auxiliary capacitance Cs corresponds to the pixel capacitance Cp in the each of above embodiments. In addition, the example of the pixel circuit of the group X is shown in FIG. 46, but the same can be implemented with respect to the pixel circuits of the groups W and Y as a matter of course.

EXPLANATION OF REFERENCES

1: Liquid crystal display device
2: Pixel circuit
2A, 2B, 2B, 2C, 2D, 2E, 2F, 2H: Pixel circuit
2*a*, 2*b*, 2*b*, 2*c*, 2*e*, 2*e*, 2*f*, 2*h*: Pixel circuit
10: Active matrix substrate
11: Display control circuit
12: Opposite electrode drive circuit
13: Source driver
14: Gate driver
20: Pixel electrode
21: Display element part
22: First switch circuit
23: Second switch circuit
24: Control circuit
31: Delay circuit
74: Sealing material
75: Liquid crystal layer
80: Opposite electrode
81: Opposite substrate
Amp: Analog amplifier
BST: Boost line
Cbst: Boost capacitive element
CD: Delay capacitive element
Clc: Liquid crystal display element
CML: Opposite electrode wiring
CSL: Auxiliary capacitance line
Cs: Auxiliary capacitive element
Ct: Timing signal DA: Digital image signal
Dv: Data signal
GL (GL1, GL2, . . . , GLn): Gate line
Gtc: Scan side timing control signal
N1: Internal node
N2: Output node
OLED: Light emitting element
REF: Reference line
Sc1, Sc2, . . . , Scm: Source signal
SEL: Selection line
SL (SL1, SL2, . . . , SLm): Source line
Stc: Data side timing control signal
T1, T2, T3, T4, T5: Transistor
TD1, TD2: Delay transistor
Tdv: Driving transistor
Vcom: Opposite voltage
Vlc: Liquid crystal voltage
VN1: Internal node potential,
VN2: Output node potential
VSL: Voltage supply line

The invention claimed is:

1. A display device having a pixel circuit group provided by arranging a plurality of pixel circuits, wherein each of the pixel circuits comprises:

a display element part including a unit display element, an internal node serving as a part of the display element part, and holding a voltage of pixel data applied to the display element part, a first switch circuit transferring the voltage of the pixel data supplied from a data signal line to the internal node through at least a predetermined switch element, a second switch circuit transferring a voltage supplied to a predetermined voltage supply line to the internal node without passing through the predetermined switch element, and a control circuit holding a predetermined voltage corresponding to the voltage of the pixel data held in the internal node, at one end of a first capacitive element, and controlling on/off of the second switch circuit, the second switch circuit has a first transistor element, and the control circuit has a second transistor element, each of the first and second transistor elements having a first terminal, a second terminal, and a control terminal controlling conduction between the first and the second terminals, the control circuit comprises a series circuit of the second transistor element and the first capacitive element, one end of the first switch circuit is connected to the data signal line, one end of the second switch circuit is connected to the voltage supply line, the other end of the first switch circuit, the other end of the second switch circuit, and the first terminal of the second transistor element are connected to the internal node, the control terminal of the first transistor element, the second terminal of the second transistor element, and the one end of the first capacitive element are connected to each other to form an output node of the control circuit, the control terminal of the second transistor element is connected to a first control line, the other end of the first capacitive element is connected to a second control line, the predetermined switch element is a third transistor element having a first terminal, a second terminal, and a control terminal controlling conduction between the first and second terminals, the control terminal being connected to a scan signal line, the display device comprises a data signal line drive circuit driving the data signal line separately, a control line drive circuit driving the first control line, the second control line, and the voltage supply line separately, and a scan signal line drive circuit driving the scan signal line, at a time of a self refreshing action to compensate voltage fluctuation of the internal node in each of the plurality of pixel circuits at the same time by activating the second switch circuit and the control circuit, the data signal line drive circuit, the control line drive circuit, and the scan signal line drive circuit control the action according to a predetermined sequence, and the predetermined sequence comprises:

a first step in which the scan signal line drive circuit applies a first scan voltage to the scan signal line connected to each of the pixel circuits included in the pixel circuit group to turn off the third transistor element, a second step in which the control line drive circuit applies a first control voltage to the first control line so that when a voltage state of binary pixel data held by the internal node is a first voltage state, a current from the one end of the first capacitive element toward the internal node is cut off by the second transistor element, and when the voltage state is a second voltage state, the second transistor element is turned on, a third step in which after the first and second steps, the control line drive circuit applies a first boost voltage to the second control line to apply a voltage change generated due to capacitive coupling through the first capacitive element, to the one end of the first capacitive element, so that when a voltage of the internal node is in the first voltage state, the voltage change is not suppressed and the first transistor element is turned on, and when the voltage of the internal node is in the second voltage state, the first transistor element is turned off, a fourth step in which after the third step, the control line drive circuit changes the voltage applied to the first control line to a second control voltage to cut off the current from the one end of the first capacitive element toward the internal node by the second transistor element regardless of whether the voltage state of the internal node is the first voltage state or the second voltage state, a fifth step in which after the fourth step, the scan signal line drive circuit applies a second scan voltage to the scan signal line connected to each of the pixel circuits included in the pixel circuit group to turn on the third transistor element, and the data line drive control circuit applies the voltage of the pixel data in the second voltage state to the data signal line, and a sixth step in which after the fifth step, the scan signal line drive circuit applies the first scan voltage to the scan signal line connected to each of the pixel circuits included in the pixel circuit group to turn off the third transistor element, and the control line drive circuit applies a voltage of the pixel data in the first voltage state to each of the voltage supply lines connected to the pixel circuits that are a target of the self refreshing action.

2. The display device according to claim 1, wherein the second switch circuit comprises a series circuit of a fourth transistor element having a control terminal connected to a third control line and the first transistor element, the control line drive circuit drives the third control line in addition to the first and the second control lines, and the sixth step of the predetermined sequence is an action in which the control line drive circuit applies a predetermined voltage to the third control line to turn on the fourth transistor element, and then applies the voltage of the pixel data in the first voltage state to the voltage supply line connected to each of the pixel circuits that are the target of the self refreshing action.

3. The display device according to claim 2, wherein the data signal line also serves as the voltage supply line, and the sixth step of the predetermined sequence is an action in which instead of the control line drive circuit, the data line drive circuit applies the voltage of the pixel data in the first voltage state to the data signal line also serving as the voltage supply line connected to each of the pixel circuits that are the target of the self refreshing action.

4. The display device according to claim 2, wherein each of the pixel circuits further comprises a second capacitive element having one end connected to the internal node, and the other end connected to a fourth control line, the fourth control line also serves as the voltage supply line, and the predetermined sequence has an action in which the control line drive circuit applies the voltage of the pixel data in the first voltage state to the fourth control line connected to each of the pixel circuits that are the target of the self refreshing action during the first to sixth steps.

5. The display device according to claim 2, wherein the first switch circuit of each of the pixel circuits comprises a series circuit of the fourth transistor element in the second switch circuit and the third transistor element, or a series circuit of a fifth transistor having a control terminal connected to the control terminal of the fourth transistor element in the second switch circuit and the third transistor element, and the predetermined sequence has an action in which the control line drive circuit applies a predetermined voltage to the third control line to turn on the fourth transistor element in at least the fifth step and the sixth step.

6. The display device according to claim 1, wherein the second switch circuit comprises a series circuit of a fourth transistor element having a control terminal connected to the second control line and the first transistor element.

7. The display device according to claim 6, wherein the data signal line also serves as the voltage supply line, and the sixth step in the predetermined sequence is an action in which instead of the control line drive circuit, the data line drive circuit applies the voltage of the pixel data in the first voltage state to the data signal line also serving as the voltage supply line connected to each of the pixel circuits that are the target of the self refreshing action.

8. The display device according to claim 6, wherein the first switch circuit of each of the pixel circuits comprises a series circuit of the fourth transistor element in the second switch circuit and the third transistor element, or a series circuit of a fifth transistor having a control terminal connected to the control terminal of the fourth transistor element in the second switch circuit and the third transistor element.

9. The display device according to claim 1, wherein the predetermined sequence has a seventh step in which after the sixth step, the control line drive circuit changes the voltage applied to the first control line to a third control voltage to turn on the second transistor element regardless of whether the voltage state of the internal node is the first voltage state or the second voltage state, and equalize potentials of the internal node and the output node.

* * * * *